US008083308B2

(12) United States Patent
Sugahara

(10) Patent No.: US 8,083,308 B2
(45) Date of Patent: Dec. 27, 2011

(54) LIQUID CARTRIDGE AND LIQUID EJECTING SYSTEM

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 452 days.

(21) Appl. No.: 12/412,985

(22) Filed: Mar. 27, 2009

(65) Prior Publication Data

US 2009/0179925 A1 Jul. 16, 2009

Related U.S. Application Data

(63) Continuation-in-part of application No. PCT/JP2007/069093, filed on Sep. 28, 2007.

(30) Foreign Application Priority Data

Sep. 29, 2006 (JP) ..... 2006-269973
Sep. 29, 2006 (JP) ..... 2006-269974
Nov. 30, 2006 (JP) ..... 2006-324492

(51) Int. Cl.
*B41J 29/393* (2006.01)
*B41J 2/195* (2006.01)
*B41J 2/175* (2006.01)

(52) U.S. Cl. ..... 347/7; 347/19; 347/86

(58) Field of Classification Search ..... 347/7, 19, 347/86

See application file for complete search history.

(56) References Cited

U.S. PATENT DOCUMENTS 6,378,971 B1 4/2002 Tamura et al.
6,796,627 B2 * 9/2004 Kimura et al. ..... 347/7
7,357,494 B2 4/2008 Katayama et al.
2001/0007615 A1 7/2001 Kawakami
2002/0005869 A1 * 1/2002 Locher et al. ..... 347/7
2005/0195225 A1 * 9/2005 Takagi et al. ..... 347/7

FOREIGN PATENT DOCUMENTS

EP 0955169 A2 11/1999
EP 1520706 A2 4/2005
EP 1570994 A1 9/2005
JP S63-115757 A 5/1988

(Continued)

OTHER PUBLICATIONS

International Bureau; Notification of Transmittal of Translation of the International Preliminary Report on Patentability in International Application No. PCT/JP2007/069093 mailed Apr. 30, 2009.

European Patent Office; European Search Report in Application No. 07828834.7 mailed Oct. 21, 2009.

*Primary Examiner* — Julian Huffman
(74) *Attorney, Agent, or Firm* — Baker Botts L.L.P.

(57) ABSTRACT

A liquid cartridge is detachably mounted in a liquid ejecting device, and supplies liquid to the liquid ejecting device when mounted. The liquid cartridge includes a liquid accommodating chamber, a float member movably disposed in the liquid accommodating chamber, and a detection member moving in conjunction with the float member and being subject to be detected by an external light detector for determining remaining amounts of liquid in the liquid accommodating chamber. A part of the detection member is located at a detection position located above an uppermost liquid surface reached when a predetermined maximum amount of liquid is accommodated in the liquid accommodating chamber. At least a part of the liquid accommodating chamber has light transmissive characteristics so that light from the light detector can reach the detection position. The detection member passes the detection position in conjunction with the float member.

12 Claims, 28 Drawing Sheets

FOREIGN PATENT DOCUMENTS

| | | | |
|---|---|---|---|
| JP | S63-252747 | A | 10/1988 |
| JP | H08-025646 | A | 1/1996 |
| JP | 2001-287380 | A | 10/2001 |
| JP | 2004-034406 | A | 2/2004 |
| JP | 2005-125738 | A | 5/2005 |
| JP | 2005-254734 | A | 9/2005 |

* cited by examiner

LIQUID CARTRIDGE AND LIQUID EJECTING SYSTEM

CROSS REFERENCE TO RELATED APPLICATION

This application claims priorities from Japanese Patent Application Nos. 2006-269973 filed Sep. 29, 2006, 2006-269974 filed Sep. 29, 2006, and 2006-324492 filed Nov. 30, 2006. This application is also a continuation-in-part of International Application No. PCT/JP2007/069093 filed Sep. 28, 2007 in Japan Patent Office as a Receiving Office. The contents of these applications are incorporated herein by reference.

TECHNICAL FIELD

The present invention relates to a liquid cartridge, and more particularly to a liquid cartridge mountable in a liquid ejecting device and supplying liquid to the liquid ejecting device. The present invention also relates to a liquid ejecting system including the liquid cartridge.

BACKGROUND

In a conventional cartridge mountable in a liquid ejecting device and supplying the liquid ejecting device with liquid, Japanese Patent Application Publication No. 2005-125738 discloses a liquid cartridge that can detect an amount of liquid left in the liquid cartridge. This patent document includes a detection member within the liquid cartridge. A float member is fixed to the detection member. The float member moves in response to the amount of liquid in the liquid cartridge and the detection member also moves along with the movement of the float member. The liquid cartridge according to patent reference 1 detects a position of the detection member with an optical sensor, thereby detecting the mount of liquid remaining in the liquid cartridge.

However, this patent document assumes that the position of the detection member detected by the optical sensor exists in the liquid. Therefore, if the liquid in the liquid cartridge has a tendency not to transmit light, such as black pigment ink, for example, accurate detection of the position of the detection member may sometimes become difficult.

SUMMARY

In view of the forgoing, it is an object of the present invention to provide a liquid cartridge and a liquid ejecting system that can easily detect an amount of liquid left in the liquid cartridge with an optical sensor, regardless of the optical transparency of the liquid.

In order to achieve the above object, the present invention provides a liquid cartridge including a liquid accommodating chamber accommodating liquid therein, a float member movably disposed in the liquid accommodating chamber to be movable in accordance with change in liquid surface of the liquid accommodated in the liquid accommodating chamber, a detection member that moves in conjunction with the float member, and restricting portion that restricts movements of the float member and the detection member to be movable along a predetermined path. Mass per unit volume of the float member is designed to be smaller than mass per unit volume of the liquid. The detection member is subject to be detected by an external light detector for determining remaining amounts of liquid accommodated in the liquid accommodating chamber. A part of the detection member is located at a detection position located above an uppermost liquid surface reached when a predetermined maximum amount of liquid is accommodated in the liquid accommodating chamber. At least a part of the liquid accommodating chamber is configured to have light transmissive characteristics so that light from the external light detector can reach the detection position without passing through the liquid, and the detection member passes the detection position in conjunction with the float member that moves following the liquid surface of liquid in the liquid accommodating chamber.

Further, according to another aspect of the present invention, there is provided a liquid ejecting system including a liquid cartridge and a liquid ejecting device. The liquid ejecting device includes a mount section in which the liquid cartridge is mounted, a liquid ejecting head that ejects liquid supplied from the liquid cartridge mounted in the mount section, and a light detector provided at an upper side of the mount section. The liquid cartridge includes a liquid accommodating chamber accommodating liquid therein, a float member movably disposed in the liquid accommodating chamber to be movable in accordance with change in liquid surface of the liquid accommodated in the liquid accommodating chamber, mass per unit volume of the float member being smaller than mass per unit volume of the liquid, a detection member that moves in conjunction with the float member and is subject to be detected by the light detector for determining remaining amounts of liquid accommodated in the liquid accommodating chamber, and a restricting portion that restricts movements of the float member and the detection member to be movable along a predetermined path. A part of the detection member is located at a detection position located above an uppermost liquid surface reached when a predetermined maximum amount of liquid is accommodated in the liquid accommodating chamber. At least a part of the liquid accommodating chamber is configured to have light transmissive characteristics so that light from the light detector can reach the detection position without passing through the liquid, and the detection member passes the detection position in conjunction with the float member that moves following the liquid surface of liquid in the liquid accommodating chamber.

According to the liquid cartridge or the liquid ejecting system of the present invention, light coming from an eternal optical sensor reaches the detection position through a region of the ink accommodating chamber having light transmissive characteristics. The detection member follows the liquid surface in the liquid accommodating chamber and passes the detection position. Therefore, detecting passage of the detection member thorough the light transmissive region with the optical sensor enables residual amounts of liquid in the accommodating chamber to be detected. On the other hand, the detection position is located at a position above the liquid surface when the liquid is accommodated in the liquid accommodating chamber to the maximum amount. That is, light from the light detector can arrive at the detection position without passing through the liquid regardless of the amounts of liquid in the liquid accommodating chamber. Accordingly, compared with a liquid cartridge in which a detection position is arranged inside the liquid, there is realized a liquid cartridge that allows easy detection of residual liquid regardless of the optical transparency of the liquid.

Further, in the present invention, accommodation of the predetermined maximum amount of liquid corresponds to the liquid surface is higher than or equal to 70% of and lower than 90% of height of the liquid accommodating chamber. With this construction, amounts of the liquid accommodated in the liquid accommodating chamber can be sufficiently secured, while light from the light detector can be scattered as little as possible by link droplets adhering to portions corresponding to the detection position of the inner wall of the liquid accommodating chamber, leading to a prevention of a problem that correct detection of light may not be performed.

Further, in the present invention, the detection member is preferably configured to have light blocking characteristics and the liquid accommodating chamber includes a pair of wall sections with a portion of the detection member interposed therebetween, the portion being located at the detection position. And at least a part of each of the pair of wall sections preferably has light transmissive characteristics so that light entering from the light detector can exit outside via the detection position. With this construction, even if the detection member is located at the detection position, light is not blocked when the light passes thorough the portion of light transmissive characteristics formed in each of the pair of wall sections. Hence, whether the detection member is located at the detection position can be detected by receiving light coming from one of the wall sections at the other wall section and by detecting intensity of the received light.

In the present invention, it is preferable that the float member and the detection member are integrally formed and also that the restricting portion pivotally supports the integrally formed float member and the detection member. With this construction, the detection member pivotally moves in accordance with the movement of the float member. Hence, the restricting portion can easily restrict the movement of the detection member so that the detection member can pass the detection position as the liquid decreases.

Further, in the present invention, the detection member is preferably provided with a light transmission section that transmits light, and the light transmission section passes detection position when the detection member moves along the predetermined path in accordance with movement of the float member. With this construction, in accordance with changes in the amount of liquid, each of regions having light blocking characteristics and the light transmission sections in the detection member can pass the detection position. Hence, the detection member allows to distinguish a state where the light transmission section is located at the detection position from a state where the region with light blocking characteristics is located at the detection position, thereby enabling amounts of liquid in the liquid accommodating chamber to be detected in greater detail.

Further, in the present invention, the detection member is preferably of a disk-shaped having a circumference along which a plurality of light transmission sections is formed at an equi-interval. With this construction, the detection member allows to distinguish between states where each light transmission section is located at the detection position, thereby enabling amounts of liquid in the liquid accommodating chamber to be detected in greater detail.

In the present invention, preferably one of the plurality of light transmission sections away farthest from the uppermost liquid surface has a larger width along the circumference than width of any other light transmission section. Among the plurality of light transmission sections, the light transmission section away farthest from the liquid surface of liquid accommodated in the liquid accommodating chamber to the maximum amount is the light transmission section located at the detection position when the liquid inside the liquid accommodating chamber has decreased to a minimum amount. With this construction, since the light transmission section has a larger width than that of any other light transmission section, the liquid cartridge allows a user to confirm that the liquid in the liquid accommodating chamber is at the minimum amount.

In the present invention, the disk-shaped detection member is preferably pivotally movable about a center thereof. If the detection member has a shape other than a disk, such as a rectangular shape for example, the detection member necessarily has a planar end surface. If the end surface passes through the liquid surface when the detection member pivotally moves, air bubbles may adhere to the end surface. Adherence of air bubbles to the end surface prevents the detection member from moving smoothly, thereby leading to unstable detection of the residual amounts of the liquid. In contrast, if the detection member has a disk shape, no planar end surface is formed as in the rectangular shaped detection member. Hence, air bubbles do not easily adhere when the detection member pivotally moves, thereby leading to stable detection of the residual amounts of liquid. Moreover, if the detection member has a shape other than a disk, area of portions of the detection member soaked in the liquid is subject to change depending on positions of the detection member with respect to the pivotally moving direction. In contrast, according to the above described configuration, since the detection member is disk-shaped, area of the portions soaked in the liquid remains constant when the detection member pivotally moves. Hence, a frictional force applied from the liquid stays constant, thereby facilitating smooth movement of the detection member.

In the present invention, the light transmission section is preferably a slit extending in a radial direction of the disk-shaped detection member. With this construction, the plurality of light transmission sections can be easily formed. Especially, a larger number of light transmission sections can be formed in the detection member.

Further, in the present invention, the light transmission section is preferably a through-hole. With this configuration, compared to a case in which the light transmission section is a slit extending in a radial direction of the disk-shaped detection member, resistance of the liquid becomes smaller when the disk-shaped detection member pivotally moves about the center thereof. Hence, the detection member can make pivotal movements under small load.

In the present invention, the light transmission section is preferably made of a material having light transmissive characteristics. The detection member can be made of a material having light transmissive characteristics, while light blocking sections may be formed simply by attaching seal members to positions corresponding to the light blocking sections in the detection member. Thus, the detection member can be easily formed.

Further, in the present invention, the liquid accommodated in the liquid accommodating chamber may have characteristics that do not transmit light. Even if such liquid is employed, the ink cartridge according to the present invention can easily detect how much amount of liquid is left inside.

BRIEF DESCRIPTION OF THE DRAWINGS

FIG. 7(*b*) A graph showing intensity of light that a light receiving element receives in the state of FIG. 7(*a*);

FIG. 7(*c*) A partial enlarged view of FIG. 6 showing detachment of the ink cartridge according to the first embodiment when smaller amount of ink remains in the ink cartridge;

FIG. 7(*d*) A graph showing intensity of light that the light receiving element receives in the state of FIG. 7(*c*);

FIG. 7(*e*) A partial enlarged view of FIG. 6 showing detachment of the ink cartridge according to the first embodiment when further smaller amount of ink is left in the ink cartridge;

FIG. 7(*f*) A graph showing intensity of light that the light receiving element receives in the state of FIG. 7(*e*);

FIG. 7(*g*) A partial enlarged view of FIG. 6 showing detachment of the ink cartridge according to the first embodiment when almost no ink is left in the ink cartridge;

FIG. 7(*h*) A graph showing intensity of light that the light receiving element receives in the state of FIG. 7(*g*);

FIG. 9(*b*) A cross-sectional view taken along a line IXB-IXB in FIG. 9(*a*);

FIG. 9(*c*) A cross-sectional view showing the detailed configuration around the ink cartridge according to the third embodiment when smaller amount of ink is left in the ink cartridge;

FIG. 9(*d*) A cross-sectional view showing the detailed configuration around the ink cartridge according to the third embodiment when almost no ink remains in the ink cartridge;

FIG. 9(*e*) A graph showing changes in intensity of light that the light receiving element receives as the amount remaining in the ink cartridge according to the third embodiment changes as shown in FIGS. 9(*a*) through 9(*d*);

FIG. 14(*b*) A cross-sectional view taken along a line XIVB-XIVB in FIG. 14(*a*);

FIG. 14(*c*) A cross-sectional view showing the detailed configuration around the ink cartridge according to the eighth embodiment when less amount of ink is left in the ink cartridge;

FIG. 14(*d*) A cross-sectional view showing the detailed configuration around the ink cartridge according to the eighth embodiment when almost no ink remains in the ink cartridge;

FIG. 14(*e*) A graph showing changes in intensity of light that a light receiving element receives as the amount remaining in the ink cartridge according to the eighth embodiment changes as shown in FIGS. 14(*a*) through 14(*d*);

FIG. 14(*f*) A graph showing changes in intensity of light that the light receiving element receives when the liquid surface of the ink according to the eighth embodiment vibrates;

DETAILED DESCRIPTION

Hereinafter, one of preferred embodiments of the present invention will be described. Note that the following includes descriptions for a plurality of embodiments. First, descriptions for a configuration common to these embodiments will be provided. Next, descriptions for configurations specific to each embodiment will be given sequentially. Finally, relationships between the inventions embodied in the present embodiments and each embodiment will be described. In the following description, unless otherwise stated, "upper" and "lower" are used to define that each represents upper and lower respectively in a vertical direction in a state where an ink cartridge of the present invention is mounted in a printer.

<Common Configuration>

Figure 1:
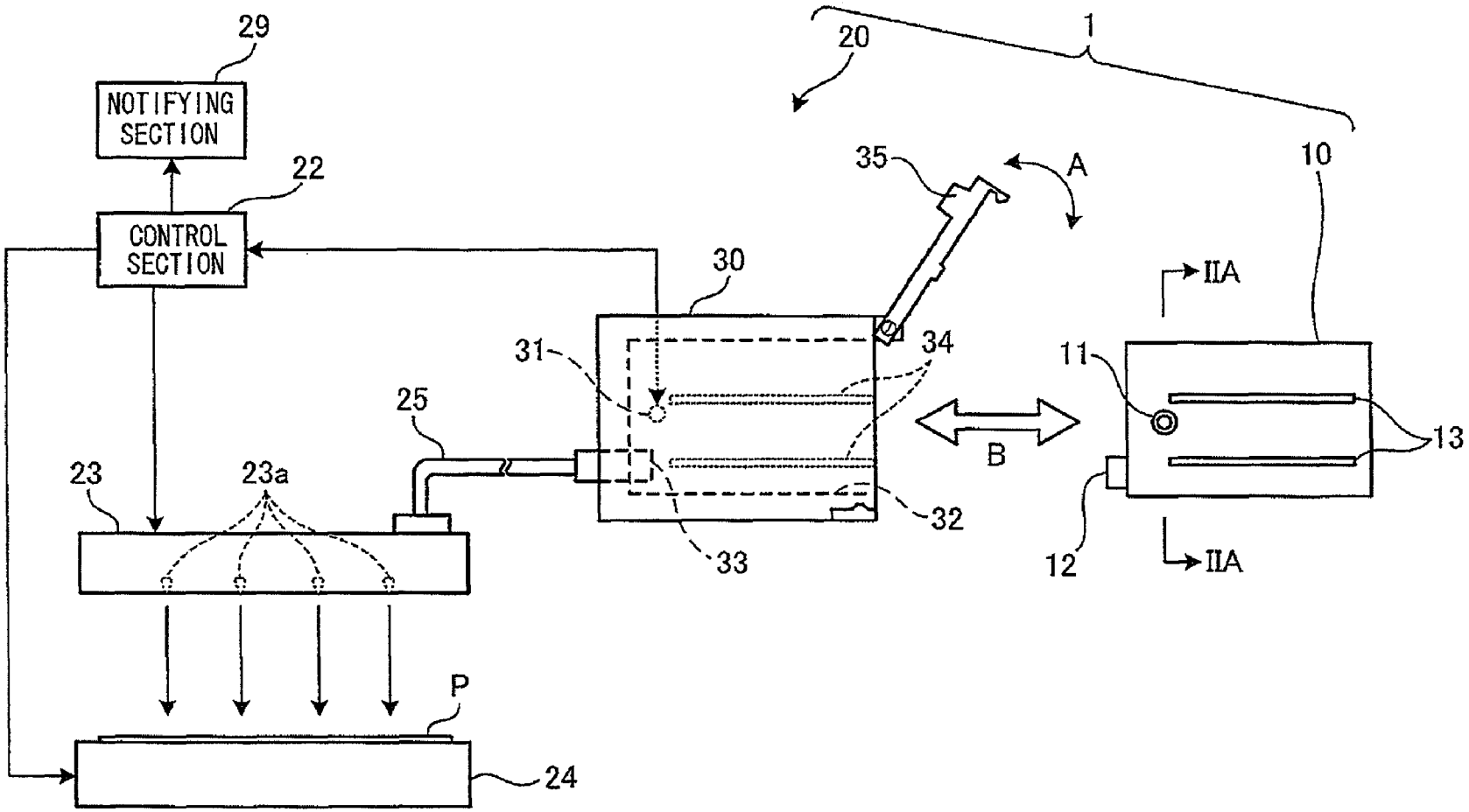
FIG. 1 A schematic view explaining a configuration of a printer system according to first to fourteenth embodiments and variations of the present invention.

FIG. 1 is a view showing a schematic configuration of a printer system 1 according to all the embodiments included in this specification. The printer system 1 includes an ink cartridge 10 and an inkjet printer 20. The inkjet printer 20 (hereinafter referred to as "printer 20") includes a control section 22, a notifying section 29, an inkjet head 23, a conveying unit 24, and an accommodating case 30. The control section 22 controls operations of the printer 20. The notifying section 29 notifies a user of the printer 20 of various information on operation status of the printer 20 in accordance with the instructions of the control section 22. For example, the notifying section 29 may include a display, so that various information can be displayed on the display to notify the user of the information.

The inkjet head 23 has a plurality of nozzles 23*a*. An ink channel (not shown) is formed inside the inkjet head 23. Ink supplied from the ink channel is ejected downward from the nozzles 23*a*. The conveying unit 24 conveys printing paper P to a position below the inkjet head 23. The ink ejected from the inkjet head 23 falls onto the printing paper P conveyed by the conveying unit 24. The control section 22 controls ink ejection from the inkjet head 23 and conveyance of the printing paper P by the conveying unit 24, based on image data transmitted from a personal computer or the like connected to the printer 20. Thus, the printer 20 forms an image corresponding to the image data on the printing paper P.

The accommodating case 30 is a case that accommodates the ink cartridge 10. An accommodating space 32 having substantially a rectangular parallelepiped shape is formed within the accommodating case 30. The ink cartridge 10 is mounted in and dismounted from the accommodating space 32 along a direction shown by an arrow B. Concave sections 34 are formed in the accommodating space 32 within the accommodating case 30 (on an inner surface of the accommodating case 30) that defines the accommodating space 32. The concave sections 34 extend from the opening of the accommodating space 32 to the far side of the accommodating space 32 along the direction B.

Further, the accommodating case 30 includes an optical sensor section 31, an ink inlet port 33, and a lid section 35. The optical sensor section 31 is provided such that the optical sensor section 31 is exposed to the accommodating space 32 within the accommodating case 30. The ink inlet port 33 is an opening connecting to an ink outlet port 12 of the ink cartridge 10 so that ink flowing out of the ink outlet port 12 can flow into the ink inlet port 33, when the ink cartridge 10 is mounted in the accommodating case 30. The ink inlet port 33 is in communication with the ink channel within the inkjet head 23 via an ink tube 25. Thus, the ink from the ink cartridge 10 is introduced to the ink channel inside the inkjet head 23. The lid section 35 opens and closes the opening serving as an entrance/exit of the accommodating case 30, and is provided to the accommodating case 30 so as to be capable of swinging in a direction of an arrow A. The lid section 35 opens the opening of the accommodating case 30 when the ink cartridge 10 is mounted in or dismounted from the accommodating case 30, and closes the opening of the accommodating case 30 once the ink cartridge 10 is mounted.

The ink cartridge 10 has substantially a rectangular parallelepiped shape that is approximately the same as the accommodating space 32, and is slightly smaller than the accommodating space 32. Convex sections 13 are formed on a side surface of the ink cartridge 10. The convex sections 13 have shapes that are substantially the same as the concave sections 34 formed in the accommodating case 30, and have sizes that can fit in the concave sections 34. Further, the ink cartridge 10 has a detection window section 11 and the ink outlet port 12. When the ink cartridge 10 is mounted in or dismounted from the accommodating case 30, the ink cartridge 10 is slid along the direction of the arrow B while the convex sections 13 of the ink cartridge 10 and the concave sections 34 of the accommodating case 30 are coupled to each other. That is, the convex sections 13 and the concave sections 34 are guide members that cause the ink cartridge 10 to move along the mount/dismount direction B. When the ink cartridge 10 is mounted in the accommodating case 30, the ink outlet port 12 is in communication with the ink inlet port 33, and the optical sensor section 31 and the detection window section 11 are arranged at a position the same with each other with respect to both up-down and left-right directions in FIG. 1.

Figure 2B:
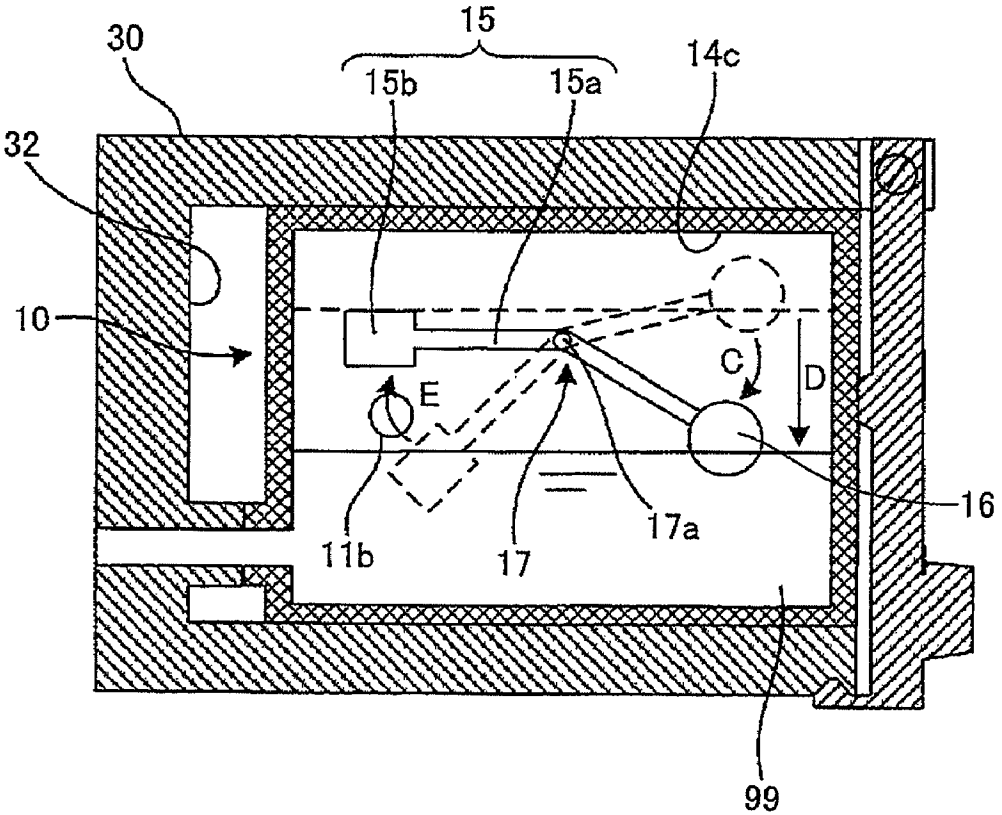
FIG. 2 A cross-sectional view showing a detailed configuration around an ink cartridge mounted in a printer shown in FIG. 1, wherein (a) is a cross-sectional view taken along a line IIA-IIA in FIG. 1, and (b) is a cross-sectional view taken along a line IIB-IIB in (a)
Figure 2A:
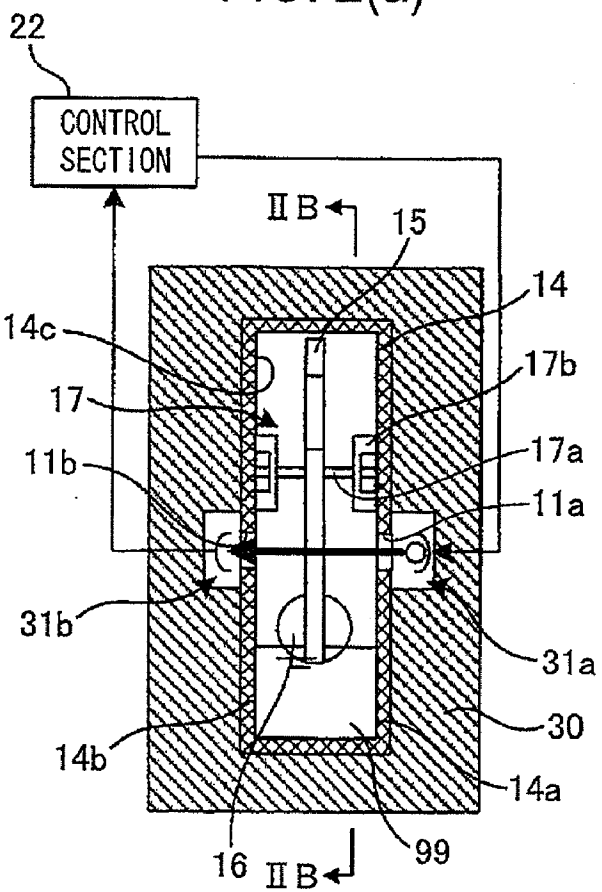

FIG. 2 is a cross-sectional view showing a configuration around the ink cartridge 10 in greater detail in a state where the ink cartridge 10 is mounted in the accommodating case 30. FIG. 2(*a*) is a cross-sectional view taken along a line IIA-IIA of FIG. 1, and FIG. 2(*b*) is a cross-sectional view taken along a line IIB-IIB of FIG. 2(*a*). Note that, in this specification, an attitude of an ink cartridge when mounted in the accommodating case as shown in FIG. 2 is referred to as "mounted attitude". The following description is given in a state where an ink cartridge is in the "mounted attitude".

The ink cartridge 10 has a cartridge casing 14 (hereinafter referred to as "casing 14"). A hollow ink accommodating chamber 14*c* is formed within the casing 14, and ink 99 is accommodated in the ink accommodating chamber 14*c*. That is, the casing 14 defines the ink accommodating chamber 14*c* (liquid accommodating chamber) that accommodates ink. Further, the ink accommodating chamber 14*c* is in communication with the ink outlet port 12 that allows ink to flow outside via a passage (not shown). An open/close mechanism (not shown) that opens and closes the ink outlet port 12 is provided within the passage. This open/close mechanism normally closes the ink outlet port 12, and opens the ink outlet port 12 when the ink outlet port 12 is connected to the ink inlet port 33 of the accommodating case 30.

A detection member 15 and a float member 16 are accommodated in the ink accommodating chamber 14*c*. The float member 16 is made of a material of resin or the like, and so configured that mass per unit volume thereof is made smaller than the density of ink 99. For example, the float member 16 may be made of a material of which specific gravity is smaller than ink, or may be formed as a hollow body having a cavity inside if the float member 16 is made of a material of which specific gravity is greater than ink. The detection member 15 is a plate-shaped member made of a material having light blocking characteristics. The detection member 15 of FIG. 2 has an arm section 15*a* and a detection section 15*b*, as a specific example. The float member 16 is fixed to the detection member 15 (a tip portion of the arm section 15*a*). That is, when the float member 16 moves, the detection member 15 moves in conjunction with the float member 16.

Further, a restricting member 17 is provided within the ink accommodating chamber 14*c*, the restricting member 17 restricting movements of the detection member 15 and the float member 16 to a predetermined path. FIG. 2 shows a pivot mechanism including a pivot shaft 17*a* fixed to the arm section 15*a* and a bearing 17*b* pivotally supporting the pivot shaft 17*a*, as a specific example of the restricting member 17. In this pivot mechanism, the position at which the pivot shaft 17*a* is supported is the pivot point.

The detection member 15 and the float member 16 move as described below, following the liquid surface of the ink within the ink accommodating chamber 14*c*. As described above, the mass per unit volume of the float member 16 is smaller than the density of ink. Thus, when ink is accommodated within the ink accommodating chamber 14*c*, the float member 16 moves up to the liquid surface of the ink. Then, when the liquid surface moves downward in an arrow D, for example, the float member 16 moves in a direction C, while the detection member 15 moves in a direction E in conjunction with the float member 16.

Further, the optical sensor section 31 includes a light emitting element 31*a* and a light receiving element 31*b*. The light emitting element 31*a* and the light receiving element 31*b* are arranged at a position the same with each other with respect to the up-down direction of the drawing. The light emitting element 31*a* is connected to the control section 22 and emits light in accordance with instructions from the control section 22. The light receiving element 31*b* is also connected to the control section 22. The light receiving element 31*b* receives the light and transmits, to the control section 22, a signal indicative of an intensity of the received light. On the other hand, the detection window section 11 is provided in the casing 14 of the ink cartridge 10. The detection window section 11 includes detection windows 11*a* and 11*b*. The detection windows 11*a* and 11*b* are formed in respective ones of a pair of left and right side plates 14*a* and 14*b* (a pair of wall sections) constituting the casing 14. The detection windows 11*a* and 11*b* are made of a material having light transmissive characteristics. Each of the detection windows 11*a* and 11*b* is arranged on a virtual straight line connecting the light emitting element 31*a* and the light receiving element 31*b*. Hence, unless a blocking object exists on a path of light within the ink accommodating chamber 14*c*, the light from the light emitting element 31*a* reaches the light receiving element 31*b* through the detection windows 11*a* and 11*b* along the above-mentioned virtual straight line. Note that, instead of forming the detection window section 11 in FIGS. 1 and 2, the entirety of the ink cartridge 10 may be made of a material having light transmissive characteristics. A portion of the casing 14 may be made of a material having light transmissive characteristics, the portion including a region through which the light from the light emitting element 31*a* passes when the ink cartridge 10 is in the mounted attitude.

With the above-described configuration, the position of the detection member 15 changes in response to the remaining amount of ink within the ink accommodating chamber 14*c*. For example, when the remaining amount of ink is a certain amount, the detection member 15 comes to a position in the ink accommodating chamber 14*c* where the detection member 15 blocks the path of light along the above-mentioned virtual straight line connecting the light emitting element 31*a* and the light receiving element 31*b* (hereinafter referred to as "detection position"). In contrast, when the remaining amount of ink is another amount, the detection member 15 is located at a position different from the detection position. When the detection member 15 is located at the detection position, the light from the light emitting element 31*a* is blocked by the detection member 15. Accordingly, the amount of light received by the light receiving element 31*b* when the detection member 15 is located at the detection position is smaller than the amount of light received by the light receiving element 31*b* when the detection member 15 is located at a position other than the detection position.

In this way, the control section 22 refers to the intensity of light indicated by the signal from the light receiving element 31*b*, and derives the remaining amount of ink within the ink cartridge 10 in the mounted attitude. Then, the control section 22 controls the notifying section 29 to notify the user of information on the remaining amount of ink, based on the derived remaining amount of ink.

Note that an ink cartridge and an accommodating case of embodiments to be described later have such a detection member, a float member, a restricting member, a casing, and a light sensor section as shown in FIG. 2, as a basic configuration. In some cases, however, specific structures of these configurations in each embodiment may become different from the structure of the casing 14, the detection member 15 (the arm section 15*a*), the float member 16, the restricting member 17, and the optical sensor section 31 shown in FIG. 2. That is, although each embodiment has a configuration that functions similarly to the casing 14, the detection member 15, the float member 16, the restricting member 17 and the optical sensor section 31, specific structures and more detailed functions may be different from those shown in FIG. 2.

EACH EMBODIMENT

Hereinafter, configurations specific to each embodiment will be described. In each embodiment, an ink cartridge and an accommodating case, especially, a detection member, a float member, a restricting member, and a light sensor section include specific configurations. Note that, in the following description, parts having structures similar to those in FIG. 2 are sometimes designated with the same reference numerals as FIG. 2 to avoid duplicating description and illustration of the parts.

First Embodiment

Figure 3A:
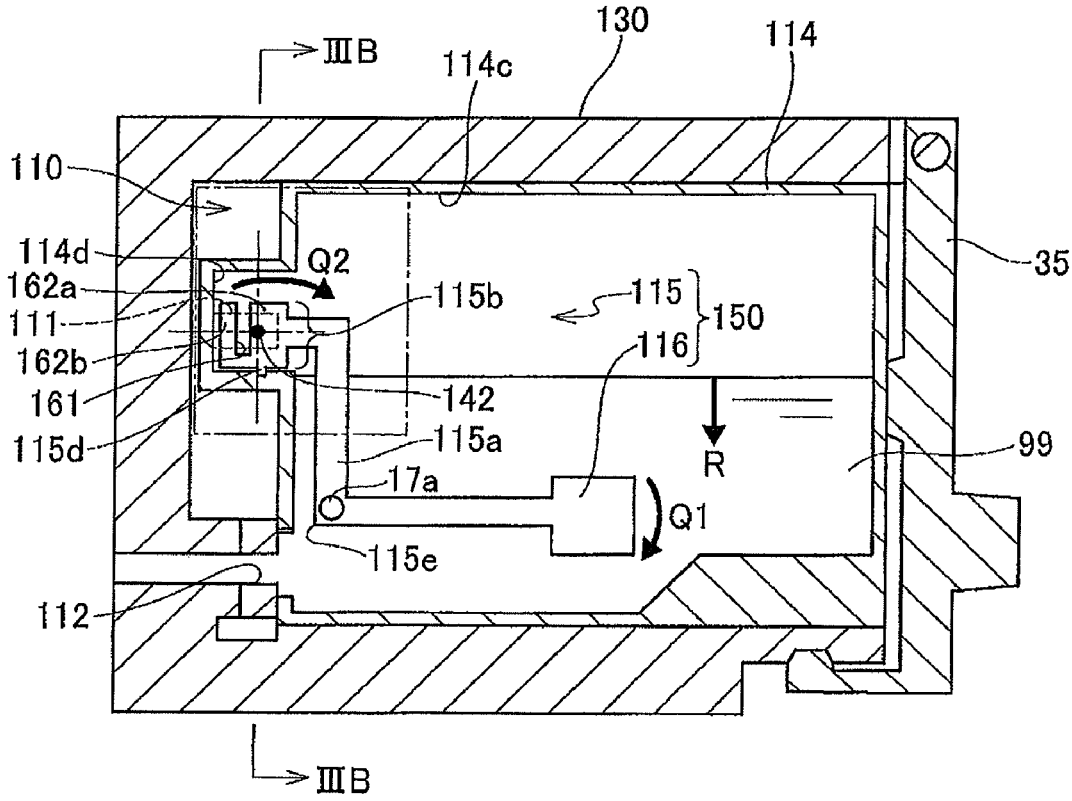
FIG. 3 (a) is a cross-sectional view showing a detailed configuration around an ink cartridge according to a first embodiment mounted in the printer of FIG. 1, and (b) is a cross-sectional view taken along a line IIIB-IIB in (a)
Figure 3B:
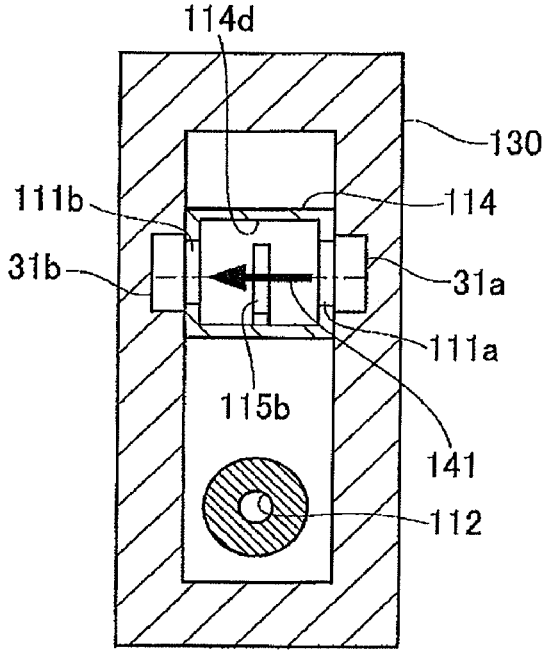
Figure 4A:
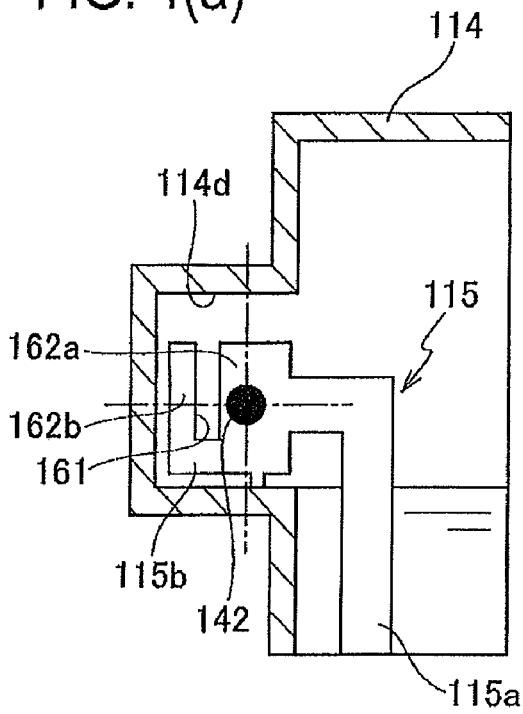
FIG. 4 Partial enlarged views showing positions of a remaining-amount detecting member in response to amounts of ink left in the ink cartridge according to the first embodiment, wherein (a) shows a position of the remaining-amount detecting member when the residual amount of ink is nearly at a maximum amount, (b) shows a position of the remaining-amount detecting member when the residual amount of ink becomes less than the maximum amount, (c) shows a position of the remaining-amount detecting member when the remaining amount of ink becomes even smaller than the state shown in (b), and (d) shows a position of the remaining-amount detecting member when the ink cartridge becomes almost empty.
Figure 4B:
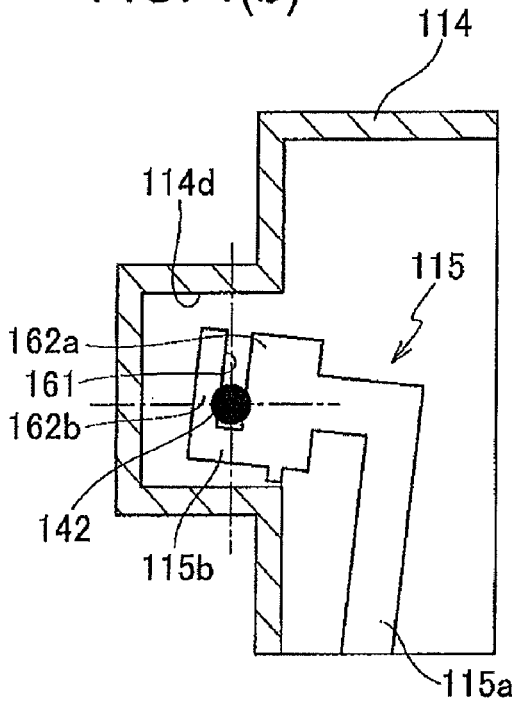
Figure 4C:
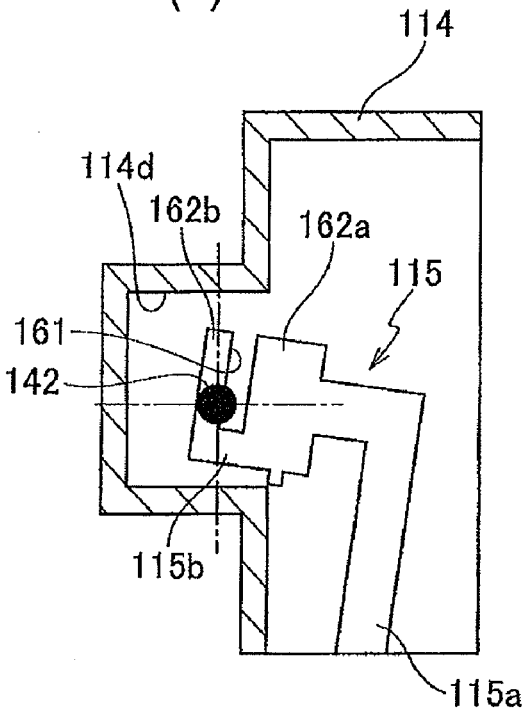
Figure 4D:
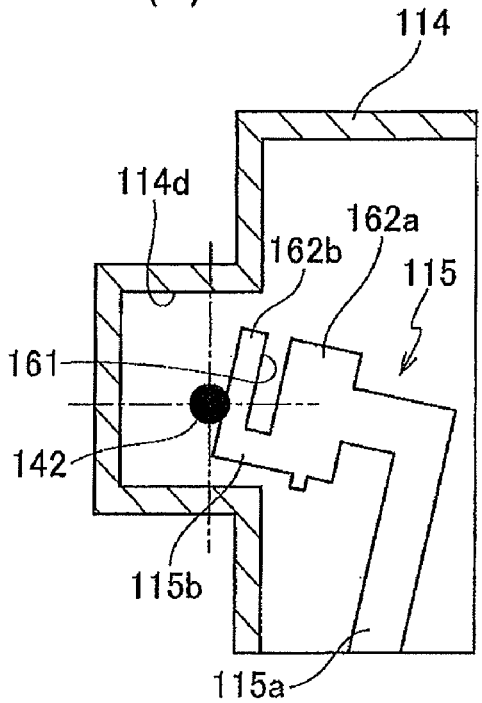

FIGS. 3(*a*) and 3(*b*) are views showing a configuration of an ink cartridge 110 and an accommodating case 130 according to a first embodiment. In FIGS. 3(*a*) and 3(*b*), the ink cartridge 110 is mounted in the accommodating case 130, thus being in the mounted attitude. FIG. 3(*a*) is a view corresponding to FIG. 2(*b*). FIG. 3(*b*) is a cross-sectional view taken along a line IIIB-IIIB of FIG. 3(*a*).

The ink cartridge 110 includes a casing 114 and a remaining-amount detecting member 150 disposed within the casing 114. An ink accommodating chamber 114*c* is formed within the casing 114. The casing 114 is formed in a cube shape as a whole. The casing 114 has a convex portion 114*d* protruding leftward therefrom in FIG. 3(*a*). The inner space of the convex portion 114*d* constitutes a portion of the ink accommodating chamber 114*c*. As shown in FIG. 3(*b*), in the first embodiment, the light emitting element 31*a* and the light receiving element 31*b* of the optical sensor section 31 are arranged such that the convex portion 114*d* is interposed between the light emitting element 31*a* and the light receiving element 31*b*. Further, a detection window section 111 is formed in the convex portion 114*d*. The detection window section 111 is disposed at a position the same as the optical sensor section 31 with respect to the up-down direction of FIGS. 3(*a*) and 3(*b*). Further, the detection window section 111 extends in an elongated shape in the left-right direction, from a position adjacent to a left inner wall surface of the convex portion 114*d* in FIG. 3(*a*) to a position rightward of the position of the optical sensor section 31. Thus, a path 141 of light emitted from the light emitting element 31*a* and reaching the light receiving element 31*b* is located within the convex portion 114*d*. Accordingly, as shown in FIG. 3(*a*), a detection position 142 is also located within the convex position 114*d*. That is, the detection position 142 is a position interposed between the light emitting element 31*a* and the light receiving element 31*b* when the ink cartridge 110 is mounted in the accommodating case 130. Note that an ink outlet port 112 is formed at a position below the convex portion 114*d*, the ink outlet port 112 allowing ink 99 within the ink accommodating chamber 114*c* to flow out to the accommodating case 130.

The remaining-amount detecting member 150 includes a detection member 115 and a float member 116. The detection member 115 is a plate-shaped member including an arm section 115*a* and a detection section 115*b*. The arm section 115*a* is bent twice approximately at right angles. One end of the arm section 115*a* is fixed to the detection section 115*b*, while the other end is fixed to the float member 116. The pivot shaft 17*a* is fixed to a corner section 115*e* which is one of the two bent portions in the arm section 115*a*. As shown in FIG. 2(*a*), the pivot shaft 17*a* is supported by the bearing 17*b*. The pivot shaft 17*a* is supported at a position close to the lower portion of the left inner wall surface of the ink accommodating chamber 114*c* in FIG. 3(*a*). Further, the position at which the pivot shaft 17*a* is supported is adjusted such that the float member 116 is arranged near the bottom surface within the ink accommodating chamber 114*c* in the up-down direction, and that the detection section 115*b* is arranged within the region of the convex portion 114*d* in the ink accommodating chamber 114*c*.

The detection section 115*b* has generally a square shape. A generally rectangular-shaped slit 161 is formed in the detection section 115*b*. The slit 161 extends downward from the upper end of the detection section 115*b* to a position close to the lower end of the detection section 115*b* in FIG. 3. Further, the slit 161 is arranged at a position slightly leftward of the center of the detection section 115*b* with respect to the left-right direction of FIG. 3. Further, light blocking sections 162*a* and 162*b* are formed such that the slit 161 is interposed therebetween. In the detection section 115*b*, the slit 161 is a portion through which light from the light emitting element 31*a* transmits, whereas the light blocking sections 162*a* and 162*b* are portions that block light from the light emitting element 31*a*.

Further, a protruding section 115*d* is formed on the lower end of the detection section 115*b*. The protruding section 115*d* makes contact with the convex portion 114*d*, thereby restricting the detection section 115*b* from moving further below from the position shown in FIG. 3. Thus, the remaining-amount detecting member 150 is maintained at a prescribed position, from a state in which a maximum amount of ink 99 is accommodated within the ink cartridge 110 to a state where the liquid surface of the ink 99 reaches the float member 116. Then, when the liquid surface of ink 99 lowers in a direction R and reaches the float member 116, the float member 116 follows the liquid surface of ink 99 and pivotally moves about the pivot shaft 17*a* in a direction Q1. In conjunction with this, the detection section 115*b* also moves in a direction Q2. Note that, as described above, the float member 116 is arranged at a position close to the bottom surface of the ink accommodating chamber 114*c*. Accordingly, when the liquid surface of ink 99 has lowered and reaches the float member 116, the amount of ink 99 left in the ink accommodating chamber 114*c* is small.

FIG. 4 is an enlarged view of a part enclosed by a single-dot chain line of FIG. 3. FIG. 4(*a*) shows a state before the liquid surface of ink 99 reaches the float member 116. FIG. 4(*b*) shows a state after the liquid surface of ink 99 has lowered and reached the float member 116, and the detection section 115*b* has moved a little in the direction Q2 of FIG. 3 from the position of FIG. 4(*a*). FIG. 4(*c*) shows a state after the liquid surface of ink 99 has lowered, and the detection section 115*b* has further moved from the position of FIG. 4(*b*). FIG. 4(*d*) shows a state after the liquid surface of ink 99 has lowered, and the detection section 115*b* has further moved from the position of FIG. 4(*c*).

The status of the detection section 115*b* changes depending on the amount of ink 99 within the ink cartridge 110, as described below. In FIG. 4(*a*), the detection section 115*b* is in a state where the light blocking section 162*a* is located at the detection position 142. In FIG. 4(*b*), the detection section 115*b* is in a state where the slit 161 is located at the detection position 142. In FIG. 4(*c*), the detection section 115*b* is in a state where the light blocking section 162*b* is located at the detection position 142. In FIG. 4(*d*), the detection section 115*b* is in a state where the detection section 115*b* has finished passing through the detection position 142 and is located at a position right side of the detection position 142.

Figure 5:
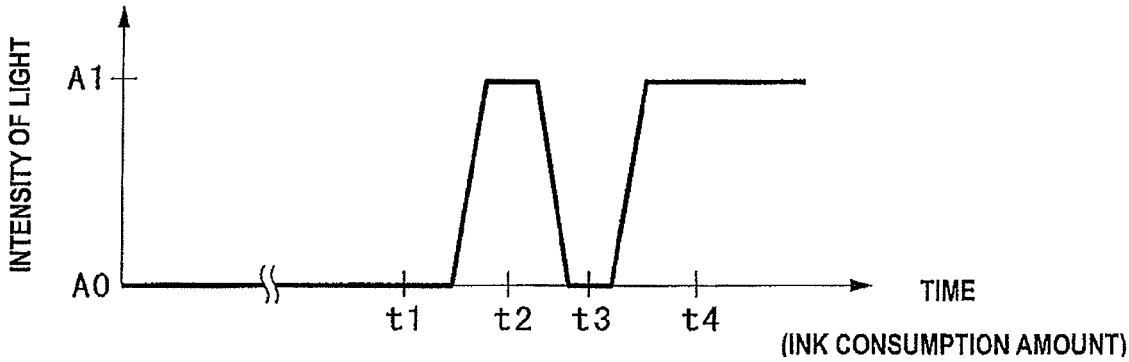
FIG. 5 A graph showing intensity of light that an optical sensor section detects in accordance with a decrease in the amount of ink in the ink cartridge according to the first embodiment.

FIG. 5 shows changes in intensity of light received by the light receiving element 31*b* when an irradiation range of light changes from FIG. 4(*a*) to FIG. 4(*d*). The horizontal axis of FIG. 5 represents time (and the consumption amount of ink 99), whereas the vertical axis represents the intensity of light. A light intensity A1 indicates intensity when the light from the light emitting element 31*a* reaches the light receiving element 31*b* without being blocked by the detection member 115. A light intensity A0 indicates intensity when the light from the light emitting element 31*a* reaches the light receiving element 31*b* when blocked by the detection member 115.

Time t1-t4 corresponds to the time at which the detection section 115*b* is in each state of FIGS. 4(*a*)-4(*d*).

At t1, because the light is blocked by the light blocking section 162*a*, the intensity of light received by the light receiving element 31*b* is A0. At t2, because the light can is received by the light receiving element 31*b* through the slit 161, the intensity of light received by the light receiving element 31*b* is A1. At t3, the light is blocked by the light blocking section 162*b*. The intensity of light received by the light receiving element 31*b* is thus A0. At t4 and thereafter, the detection section 115*b* has finished passing through the detection position 142, and thus the intensity of light remains A1.

As described above, according to the first embodiment, when ink 99 within the ink accommodating chamber 114*c* decreases to a small amount, the liquid surface of ink 99 reaches the float member 116, and the float member 116 begins to move. As the ink 99 further decreases, the position of the detection member 115 changes in conjunction with the float member 116, sequentially from a first position to a fourth position: in the first position, the light blocking section 162*a* is located at the detection position 142; in the second position, the slit 161 is located at the detection position 142; in the third position, the light blocking section 162*b* is located at the detection position 142; and in the fourth position, the detection section 115*b* has finished passing through the detection position 142. Simultaneously, the status of light received by the light receiving element 31*b* sequentially changes from a first state to a fourth state: the intensity is A0 in the first state; the intensity is A1 in the second state; the intensity is A0 in the third state; and the intensity is A1 in the fourth state.

The control section 22 acquires which of the first through fourth states the current status corresponds to, thereby identifying how much amount of ink 99 is left in four stages. Specifically, the control section 22 counts how many times the status of light received by the light receiving element 31*b* switches between the light intensity A0 and the light intensity A1. Then, depending on the switched number of times being 0-3 times, the present status is determined to be any one of the first through fourth states. Then, the control section 22 notifies the user of information indicative of the remaining amount of ink 99 via the notifying section 29, based on a determined result on the residual amount of ink 99. For example, in accordance with each of the first through fourth states, a message may be shown on the display, the message informing that the remaining amount of ink 99 is still sufficient, the remaining amount of ink 99 is small, the remaining amount of ink 99 is further small, or the remaining amount of ink 99 is nearly empty.

Figure 6:
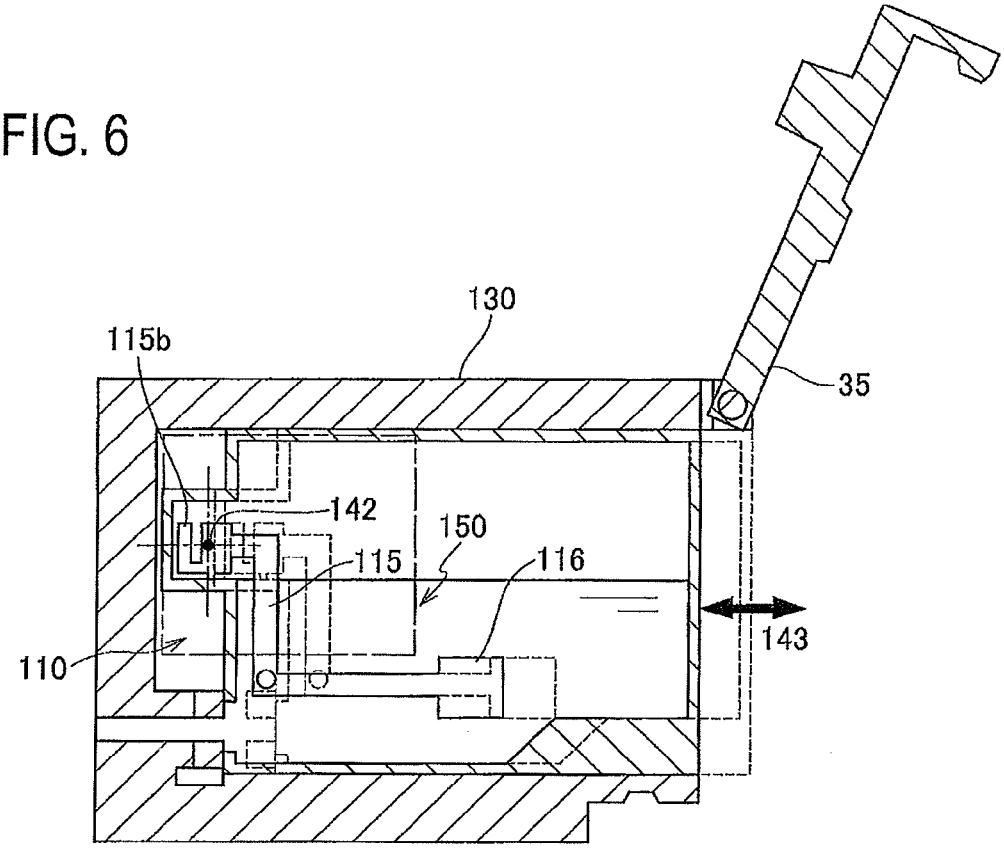
FIG. 6 A cross-sectional view showing a state in which the ink cartridge according to the first embodiment is being mounted in or dismounted from the printer.
Figure 7A:
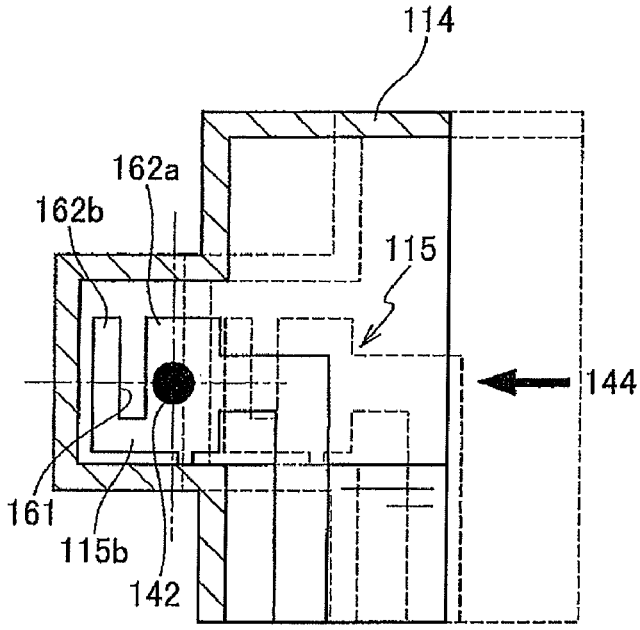
FIG. 7(*a*) A partial enlarged view of FIG. 6 showing detachment of the ink cartridge according to the first embodiment when substantial amount of ink remains in the ink cartridge.
Figure 7B:
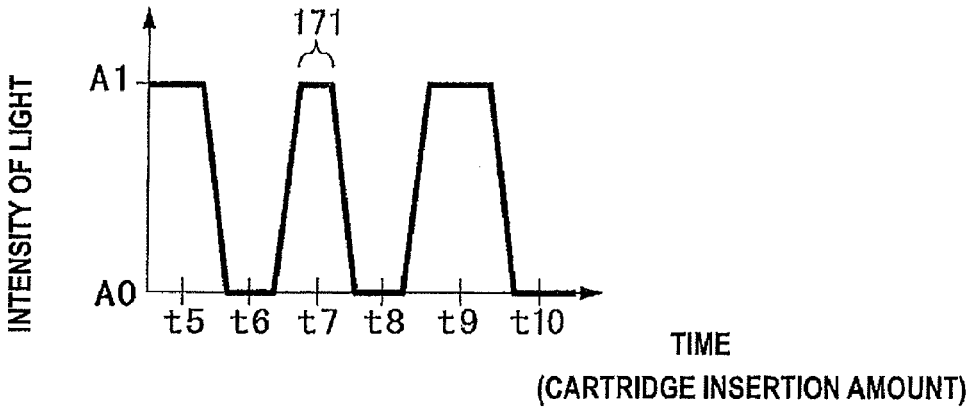
Figure 7C:
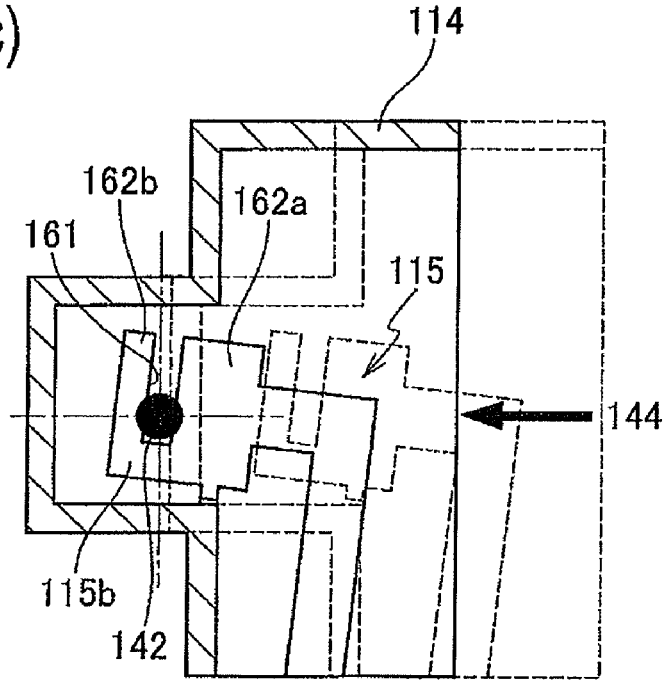
Figure 7D:
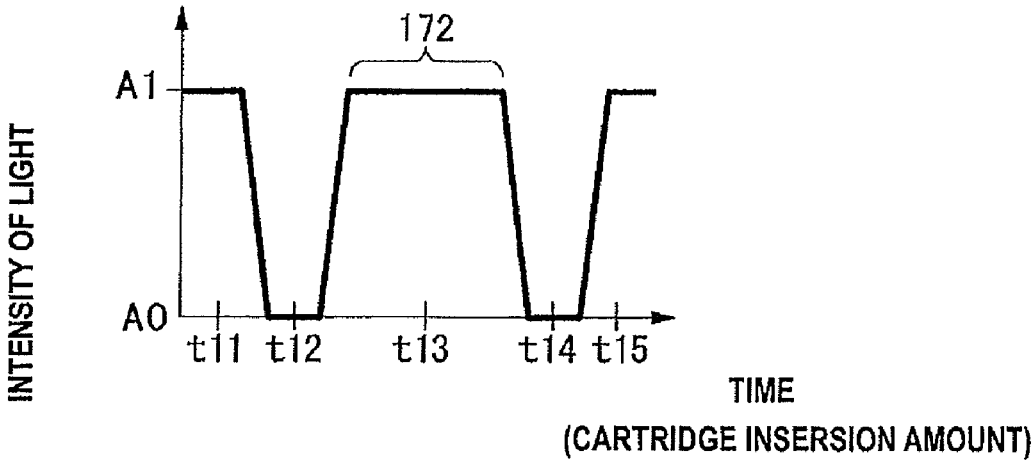
Figure 7E:
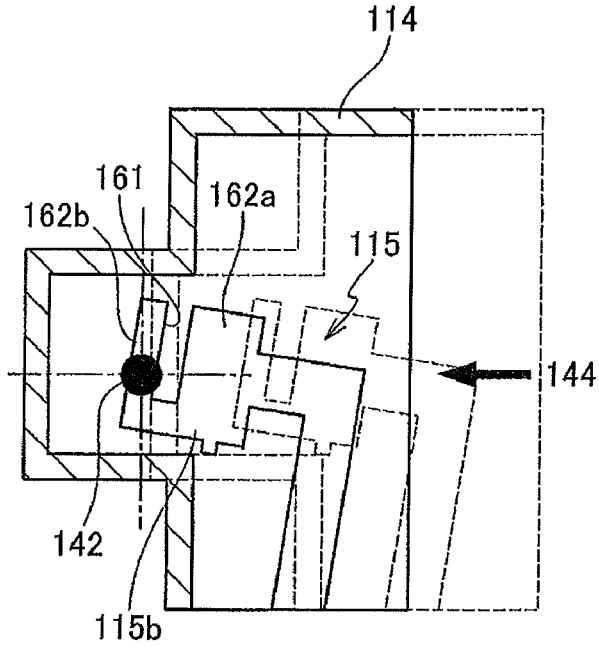
Figure 7F:
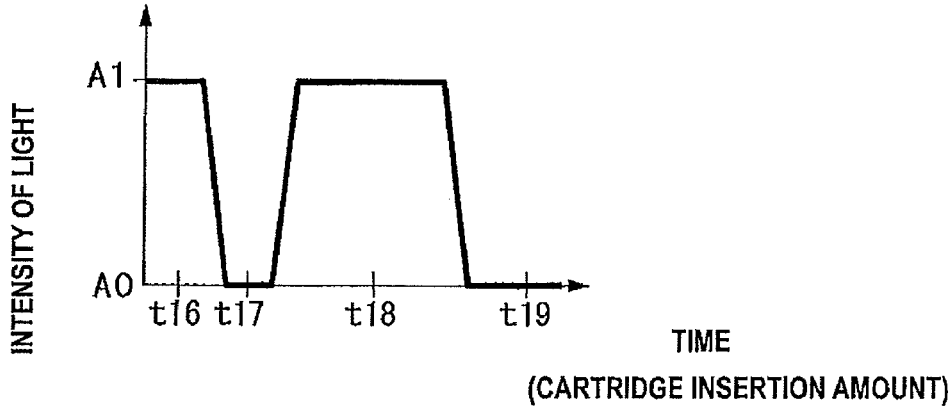
Figure 7G:
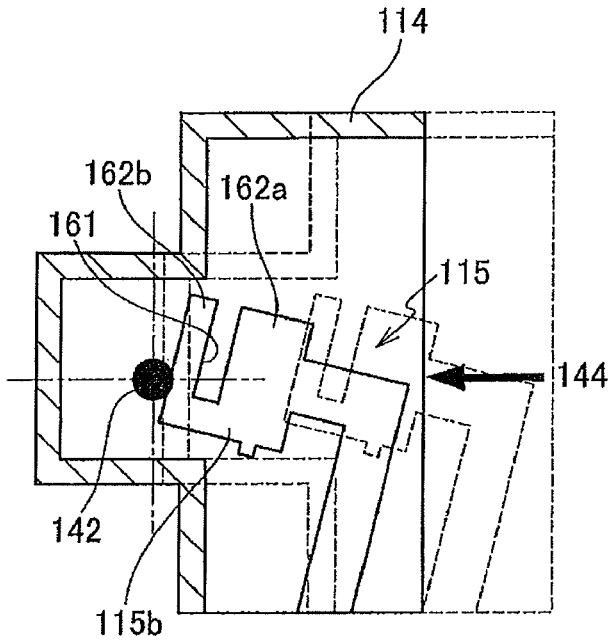
Figure 7H:
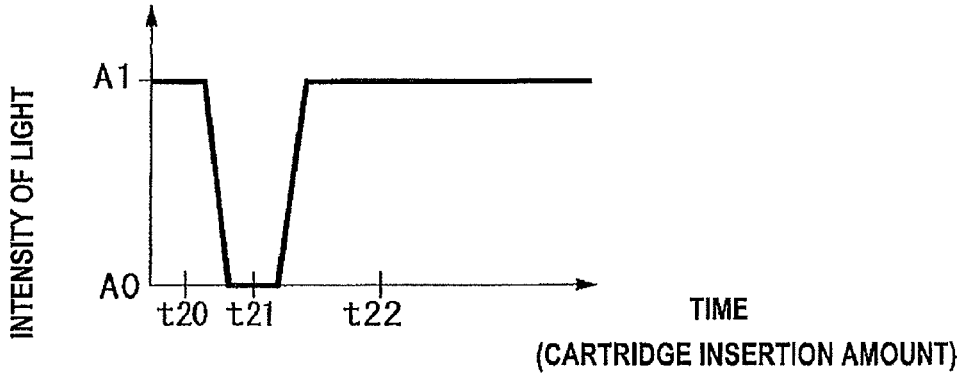

The above configuration of the first embodiment allows the amount of ink 99 left in the ink cartridge 110 to be grasped, not only when the ink cartridge 110 continues to be in the mounted attitude until present from the time the ink cartridge 110 was first used, but also when the ink cartridge 110 is being mounted in or dismounted from the accommodating case 130. FIG. 6 shows a state where the ink cartridge 110 is being mounted in or dismounted from the accommodating case 130. Broken lines represent a state of the ink cartridge 110 slid slightly rightward from the mounted attitude. When the ink cartridge 110 is being mounted in or dismounted from the accommodating case 130, the ink cartridge 110 moves between the position indicated by the broken lines and the mounted attitude. At this time, the detection position 142 moves relative to the detection section 115*b* such that the detection position 142 cuts across the detection section 115*b* along a direction parallel to a direction 143, for example. Here, as described above, the detection window section 111 is formed in an elongated shape in the left-right direction (see FIG. 3). Hence, when the ink cartridge 110 is being mounted in the accommodating case 130, for example, from when the left side wall of the casing 114 passes through the detection position 142 until when the ink cartridge 110 is in the mounted state, the light from the light emitting element 31*a* enters the ink accommodating chamber 114*c* through the detection window section 111 without being blocked by the casing 114. Note that, if the entirety of the casing 114 is made of a material having light transmissive characteristics, the detection window section 111 is not necessary to be formed.

FIG. 7(*a*), FIG. 7(*c*), FIG. 7(*e*), and FIG. 7(*g*) are enlarged views of a region enclosed by a single-dot chain line in FIG. 6. FIG. 7(*a*), FIG. 7(*c*), FIG. 7(*e*), and FIG. 7(*g*) show respective states in which the detection position 142 moves relative to the detection section 115*b* when the ink cartridge 110 having a different remaining amount of ink 99 is being mounted in the accommodating case 130 along an arrow 144. The remaining amounts of ink 99 in FIG. 7(*a*), FIG. 7(*c*), FIG. 7(*e*), and FIG. 7(*g*) respectively correspond to the remaining amounts of ink 99 in FIG. 4(*a*) through FIG. 4(*d*). In FIG. 7(*a*), FIG. 7(*c*), FIG. 7(*e*), and FIG. 7(*g*), solid lines indicate the ink cartridge 110 in the mounted attitude, whereas broken lines indicate the ink cartridge 110 immediately before the ink cartridge 110 takes the mounted attitude. Further, FIG. 7(*b*), FIG. 7(*d*), FIG. 7(*f*), and FIG. 7(*h*) are graphs that represent changes in the intensity of light received by the light receiving element 31*b* when the detection position 142 moves relative to the detection section 115*b* as shown in FIG. 7(*a*), FIG. 7(*c*), FIG. 7(*e*), and FIG. 7(*g*), respectively.

In case of FIG. 7(*a*), the intensity of light received by the light receiving element 31*b* changes as shown in FIG. 7(*b*). First, prior to a state shown by the broken lines in FIG. 7(*a*), light from the light emitting element 31*a* is received by the light receiving element 31*b* without being blocked. At this time, the intensity of light is A1 (t5). Next, when the detection position 142 reaches the casing 114 (the left side wall section of the convex portion 114*d*) of the ink cartridge 110, the path of light is blocked by the casing 114. At this time, the intensity of light is A0 (t6). Next, when the detection position 142 has finished passing through the casing 114, the path of light is formed in a space between the casing 114 and the detection section 115*b*, and thus the intensity of light is A1 (t7). Next, after the detection position 142 reaches the detection section 115*b*, the detection position 142 passes through the light blocking section 162*b* and the slit 161 sequentially. Accordingly, the intensity of light once changes to A0 (t8), and thereafter becomes A1 (t9). Next, when the detection position 142 passes through the slit 161 and reaches the light blocking section 162*a*, the intensity of light becomes A0 (t10). Then, in the mounted attitude shown by the solid lines in FIG. 7(*a*), because the light blocking section 162*a* is at the detection position 142, the intensity of light becomes A0 at t10 and thereafter.

In case of FIG. 7(*c*), the intensity of light received by the light receiving element 31*b* changes as shown in FIG. 7(*d*). First, prior to a state shown by the broken lines in FIG. 7(*c*), light from the light emitting element 31*a* is received by the light receiving element 31*b* without being blocked. At this time, the intensity of light is A1 (till). Next, when the detection position 142 reaches the casing 114 of the ink cartridge 110, the path of light is blocked by the casing 114. At this time, the intensity of light is A0 (t12). Next, when the detection position 142 has finished passing through the casing 114, the path of light is formed in a space between the casing 114 and the detection section 115*b*, and thus the intensity of light is A1 (t13). Next, when the detection position 142 reaches the detection section 115*b*, the detection position 142 passes through the light blocking section 162*b* and moves to the slit 161. Accordingly, the intensity of light once changes to A0 (t14), and thereafter becomes A1 (t15). Here, in the mounted attitude shown by the solid lines in FIG. 7(*c*), because the slit 161 is at the detection position 142, the intensity of light is A1 at t15 and thereafter.

In case of FIG. 7(*e*), the intensity of light received by the light receiving element 31*b* changes as shown in FIG. 7(*f*). First, prior to a state shown by the broken lines in FIG. 7(*e*), light from the light emitting element 31*a* is received by the light receiving element 31*b* without being blocked. At this time, the intensity of light is A1 (t16). Next, when the detection position 142 reaches the casing 114 of the ink cartridge 110, the path of light is blocked by the casing 114. At this time, the intensity of light is A0 (t17). Next, when the detection position 142 has finished passing through the casing 114, the path of light is formed in a space between the casing 114 and the detection section 115*b*, and thus the intensity of light is A1 (t18). Then, when the detection position 142 reaches the light blocking section 162*b*, the intensity of light becomes A0 (t19). Here, in the mounted attitude shown by the solid lines in FIG. 7(*e*), the light blocking section 162*b* is located at the detection position 142. Accordingly, the intensity of light is A0 at t19 and thereafter.

In case of FIG. 7(*g*), the intensity of light received by the light receiving element 31*b* changes as shown in FIG. 7(*h*). First, prior to a state shown by the broken lines in FIG. 7(*g*), light from the light emitting element 31*a* is received by the light receiving element 31*b* without being blocked. At this time, the intensity of light is A1 (t20). Next, when the detection position 142 reaches the casing 114 of the ink cartridge 110, the path of light is blocked by the casing 114. At this time, the intensity of light is A0 (t21). Next, when the detection position 142 has finished passing through the casing 114, the path of light is formed in a space between the casing 114 and the detection section 115*b*, and thus the intensity of light is A1 (t22). Here, in the mounted attitude shown by the solid lines in FIG. 7(*g*), the detection position 142 is located between the detection section 115*b* and the casing 114. Accordingly, the intensity of light is A0 at t21 and thereafter.

As described above, when the ink cartridge 110 is mounted in the accommodating case 130, the intensity of light received by the light receiving element 31*b* shows different patterns of change depending on the amount of ink 99 left in the mounted ink cartridge 110, as shown in FIG. 7(*b*), FIG. 7(*d*), FIG. 7(*f*), and FIG. 7(*h*).

Hence, the control section 22 acquires the residual amount of ink 99 in the ink cartridge 110 when the ink cartridge 110 is being mounted in the accommodating case 130, based on signals from the light receiving element 31*b*. Specifically, for example, the control section 22 includes a memory for storing data indicative of the patterns of change of the light intensity such as those shown in FIG. 7(*b*), FIG. 7(*d*), FIG. 7(*f*), and FIG. 7(*h*), in association with the remaining amounts of ink 99 corresponding to the respective patterns of change. The control section 22 determines which of the changing patterns stored in the memory corresponds to the changes in the light intensity indicated by the signal from the light receiving element 31*b*, and acquires the remaining amount of ink 99 from the determined results. The control section 22 then notifies the user of the acquired residual amount of ink 99 via the notifying section 29. For example, depending on respective patterns of change shown in FIG. 7(*b*) through FIG. 7(*h*), a message may be shown on the display. The message may be such that the amount of ink 99 left in the mounted ink cartridge 110 is still sufficient, small, further small, or nearly empty, depending on the remaining amounts of ink 99.

Note that, in the first embodiment, the residual amount of ink 99 can be known in at least four stages while the ink cartridge 110 is being mounted, as shown in FIG. 7. However, the remaining amount of ink 99 can be grasped in more than four stages. For example, as shown in FIG. 7(*a*) and FIG. 7(*c*), a distance by which the detection section 115*b* and the casing 114 are separated is different depending on the remaining amounts of ink 99. Accordingly, as shown in FIG. 7(*b*) and FIG. 7(*d*), lengths of a time period 171 and a time period 172 during which the intensity of light remains A1 are different from each other. Based on this difference, the remaining amount of ink 99 can be known in more than or equal to five stages in total, by determining that the remaining amount of ink 99 is smaller as the time period 172 becomes longer.

The above description explains a case in which the remaining amount of ink 99 is acquired when the ink cartridge 110 is being mounted. However, the remaining amount of ink 99 can also be grasped when the ink cartridge 110 is being dismounted from the accommodating case 130. When the ink cartridge 110 is being dismounted from the accommodating case 130, changes in the intensity of light received by the light receiving element 31*b* are shown in temporally-reversed patterns of the changes shown in FIG. 7(*b*) and the like. Accordingly, the remaining amount of ink 99 during a period when the ink cartridge 110 is being dismounted from the accommodating case 130 can also be known by comparing a pattern of change in the intensity of light actually received by the light receiving element 31*b* with the patterns of change obtained by reversing the patterns shown in FIG. 7(*b*) and the like in terms of time.

In the first embodiment, the slit 161 is formed in the detection section 115*b*, extending in the up-down direction. In such a case, the pivot shaft 17*a* may be preferably located as directly below a detection section 115*b* as possible. With this structure, compared with a case in which the pivot shaft 17*a* is located at a side rightward of the detection section 115*b* (see FIG. 8), for example, the detection section 115*b* can make a greater movement with respect to the left-right direction when the remaining-amount detecting member 115 pivotally moves about the pivot shaft 17*a*. Accordingly, the slit 161 can readily pass through the detection position 142 and the intensity of light can vary greatly, thereby facilitating detection of the residual ink 99 by the ink cartridge 110.

Alternatively, in the configuration of the first embodiment, the path of light is blocked by the casing 114 (the left side wall section of the convex portion 114*d* in FIG. 3(*a*)) when the ink cartridge 110 is being mounted. However, the entirety of the casing 114 may be made of a light transmissive member so that the casing 114 does not block the path of light. Even in this configuration, the changes in intensity of light shown in FIG. 7(*b*), FIG. 7(*d*), FIG. 7(*f*), and FIG. 7(*h*) can show different patterns of change respectively from one another, and thus the control section 22 can distinguish one from another. In case of FIG. 7(*h*), however, the intensity of light does not change (remains A1), and therefore cannot be differentiated from a case where the ink cartridge 110 is not mounted. Hence, for distinction, a switch is necessary to be provided separately for detecting whether the ink cartridge 110 exists in the mounted position.

Second Embodiment

Figure 8:
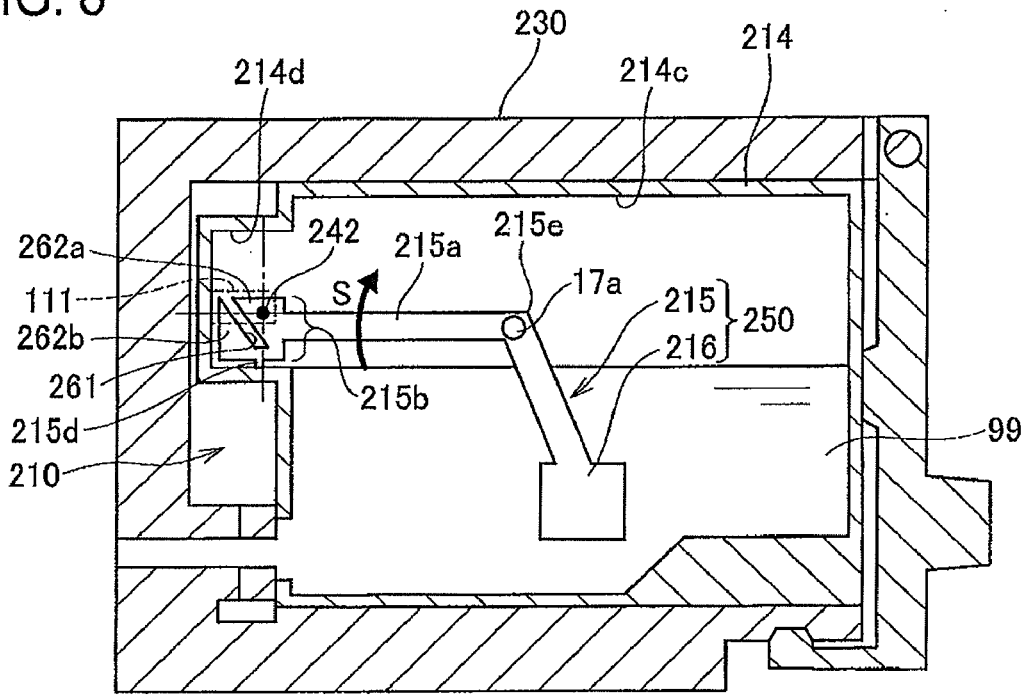
FIG. 8 A cross-sectional view showing a detailed configuration around an ink cartridge according to a second embodiment.
Figure 9A:
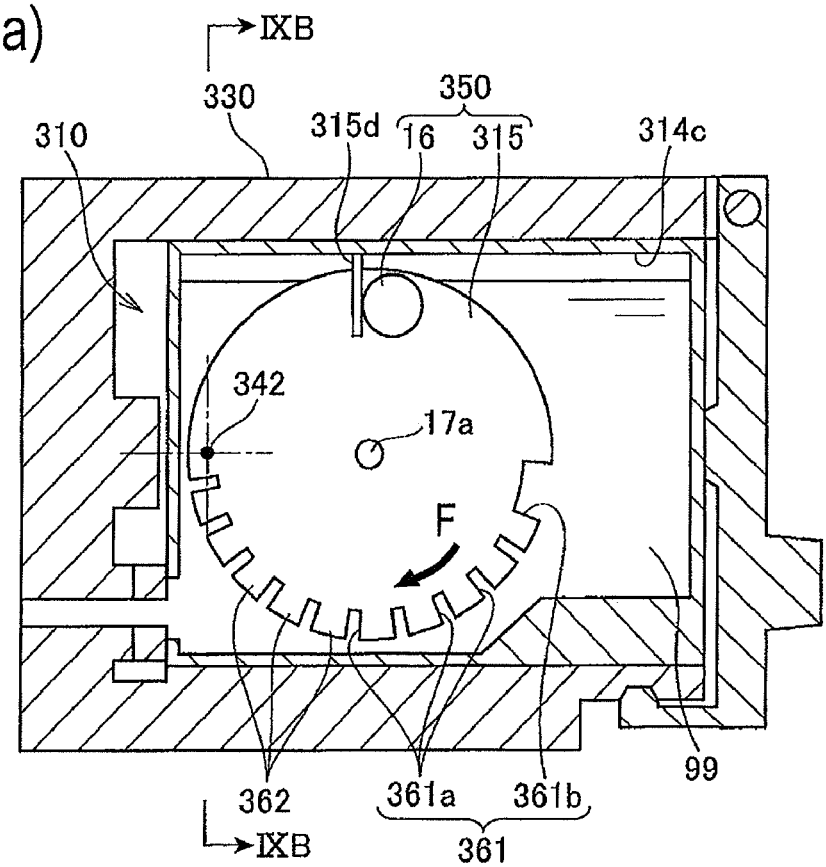
FIG. 9(*a*) A cross-sectional view showing a detailed configuration around an ink cartridge according to a third embodiment mounted in the printer of FIG. 1.
Figure 9B:
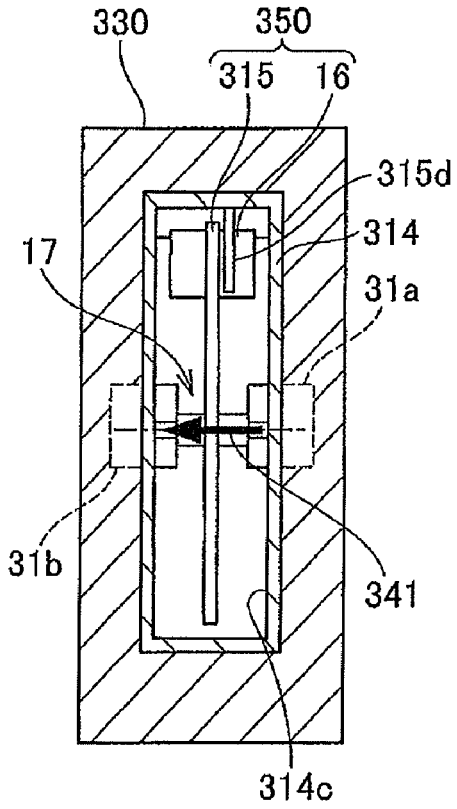
Figure 9C:
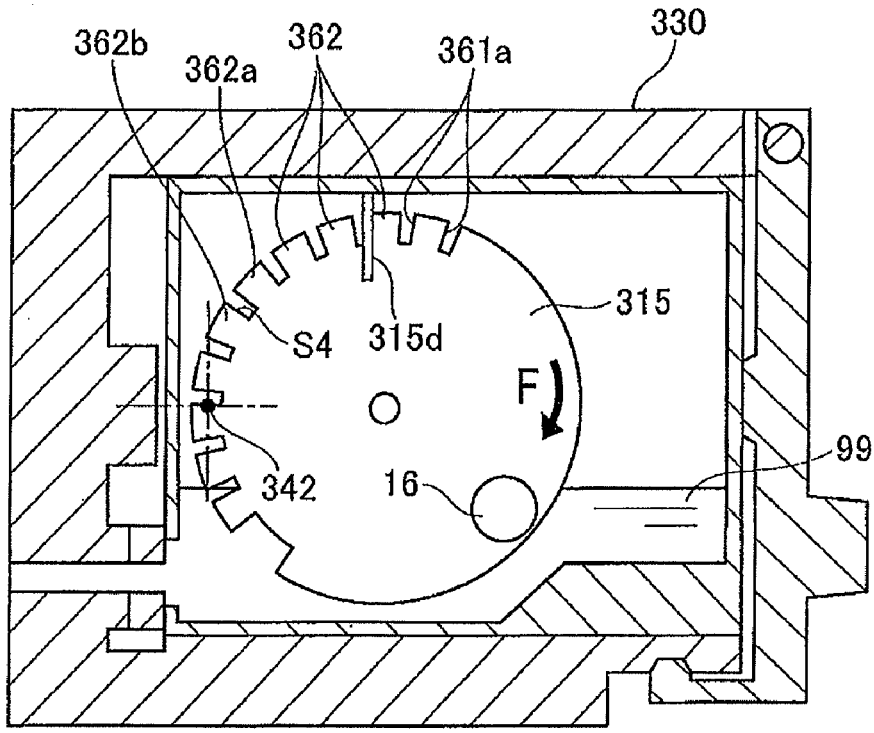
Figure 9D:
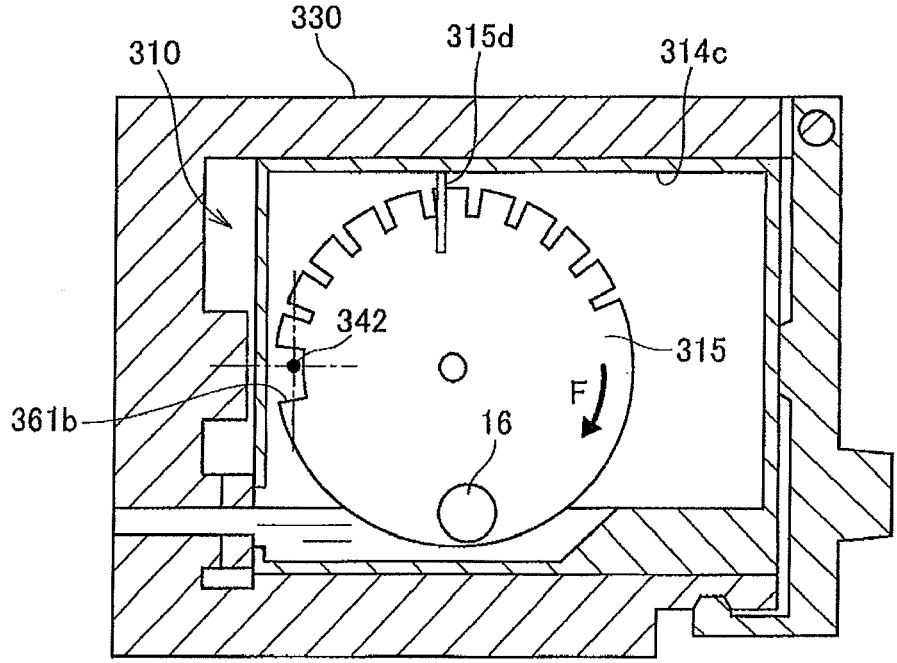
Figure 9E:
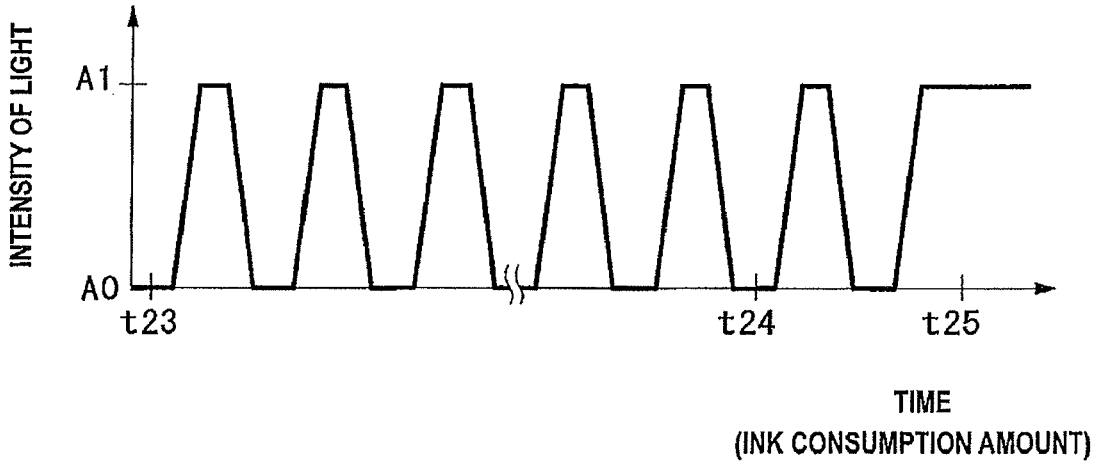

FIG. 8 is a cross-sectional view of an ink cartridge 210 and an accommodating case 230 according to a second embodiment. FIG. 8 is a view that corresponds to FIG. 2(*b*).

The ink cartridge 210 includes a casing 214 and a remaining-amount detecting member 250 provided within the casing 214. An ink accommodating chamber 214*c* is formed within the casing 214. A convex portion 214*d* is formed at a left end of the ink accommodating chamber 214*c*, protruding leftward toward outside of the ink cartridge 210. The convex portion 214*d* is formed longer in the up-down direction than the convex portion 114*d* of the first embodiment. Further, the convex portion 214*d* is provided with the detection window section 111 elongated in the left-right direction in FIG. 8, as in the first embodiment.

The remaining-amount detecting member 250 includes a detection member 215 and a float member 216. The detection member 215 includes an arm section 215*a* and a detection section 215*b*. The arm section 215*a* is bent at a corner section 215*e* at an angle greater than 90 degrees. The detection section 215*b* is fixed to one end of the arm section 215*a*, whereas the float member 216 is fixed to the other end. The pivot shaft 17*a* is fixed in the vicinity of the corner section 215*e*. The pivot shaft 17*a* is supported by the bearing 17*b* (see FIG. 2) at a position rightward of the convex portion 214*d* in FIG. 8. The position of the remaining-amount detecting member 250 is adjusted such that the float member 216 is located near the bottom surface of the ink accommodating chamber 214*c*, and that the detection section 215*b* is in contact with the inner bottom surface of the convex portion 214*d* from above, when the liquid surface of ink 99 is located above the float member 216.

The detection section 215*b* has a configuration similar to the detection section 115*b* of the first embodiment. The detection section 215*b* includes a protruding section 215*d*, a slit 261, and light blocking sections 262*a* and 262*b* with the slit 261 interposed therebetween, each corresponding to the protruding section 115*d*, the slit 161, the light blocking section 162*a* and the light blocking section 162*b*, respectively. Unlike the slit 161, however, the slit 261 cuts obliquely the detection section 215*b* with respect to the four sides thereof, from the left upper corner toward the right lower corner of the detection section 215*b* in FIG. 8.

In the second embodiment, when the remaining amount of ink 99 becomes small and the liquid surface reaches the float member 216, the float member 216 begins to move. In conjunction with this, the arm section 215*a* pivotally moves about the pivot shaft 17*a* in a direction S. Accordingly, the detection section 215*b* moves from a position where the light blocking section 262*a* is located at a detection position 242 to a position where the detection section 215*b* has passed the detection position 242, via a position where the slit 261 is located at the detection position 242 and via a position where the light blocking section 262*b* is located at the detection position 242. Here, like the first embodiment, light received by the light receiving element 31*b* changes sequentially as follows: a first state where the intensity is A0, a second state where the intensity is A1, a third state where the intensity is A0, and a fourth state where the intensity is A1. Accordingly, the remaining amount of ink 99 can also be grasped in four stages in the second embodiment, as in the first embodiment.

Further, the slit 261 is formed in the detection section 215*b*. Thus, as in the first embodiment, when the ink cartridge 210 is being mounted in the accommodating case 230, the patterns of change in the intensity of light received by the light receiving element 31*b* is different depending on the amounts of ink 99 left in the mounted ink cartridge 210. Accordingly, in the second embodiment, detecting the remaining amount of ink 99 when the ink cartridge 210 is being mounted in the accommodating case 230 becomes possible, like the first embodiment.

Here, in the second embodiment, unlike the first embodiment, the pivot shaft 17*a* is located at a position rightward of the detection section 215*b* at a height approximately the same as that of detection section 215*b*. Hence, when ink 99 decreases, the detection section 215*b* moves substantially upward. Accordingly, if a slit extending in the up-down direction is formed in the detection section 215*b*, the slit does not pass through the detection position 242 readily. That is, the intensity of light received by the light receiving element 31*b* is hard to change in accordance with the residual amounts of ink 99, and the patterns of change in the intensity of light become also hard to be differentiated when the ink cartridge 210 is being mounted in the accommodating case 230.

In contrast, the slit 261 of the second embodiment cuts the detection section 215*b* obliquely with respect to the four sides thereof in the cross-section shown in FIG. 8. Accordingly, when the detection section 215 moves upward, the slit 261 can reliably pass through the detection position 242. Further, when the ink cartridge 210 is being mounted in the accommodating case 230, differences among the patterns of change in the intensity of light can become distinct from one another depending on the remaining amounts of ink 99. Thus, if the pivot shaft 17*a* is located at a height approximately the same as that of the detection section 215*b*, detection of the residual amount of ink 99 can be reliably performed.

Third Embodiment

Hereinafter, a third embodiment will be described. FIGS. 9(*a*) through 9(*d*) are views showing a configuration of an ink cartridge 310 and an accommodating case 330 according to the third embodiment. FIG. 9(*a*) and FIG. 9(*b*) are views that correspond to FIG. 2(*b*) and FIG. 2(*a*), respectively.

The ink cartridge 310 includes a remaining-amount detecting member 350 having substantially a disk shape. The remaining-amount detecting member 350 is integrally formed of a disk-shaped detection member 315 and the float member 16. The float member 16 is fixed to a position close to the periphery of the detection member 315. A rod-shaped reverse-rotation preventing member 315*d* is provided on the ceiling of an ink accommodating chamber 314*c* at a position left side of the float member 16 in FIG. 9(*a*). The reverse-rotation preventing member 315*d* contacts the float member 16 and restricts the movement of the float member 16. On the other hand, the pivot shaft 17*a* is fixed to the center of the disk-shaped detection member 315. The pivot shaft 17*a* is supported by the bearing 17*b*, such that the detection member 315 can pivotally move (can rotate). The reverse-rotation preventing member 315*d* restricts the movement of the float member 16, thereby preventing the detection member 315 from rotating in a reverse direction and enabling the detection member 315 to rotate in a circumferential direction F. For example, when the liquid surface of ink 99 moves down as shown in FIG. 9(*c*) from a state in which ink 99 is accommodated within the ink cartridge 310 to a maximum amount, the float member 16 follows the liquid surface of ink 99 and moves downward. In conjunction with this, the detection section 315 is about to rotate. At this time, because the reverse-rotation preventing member 315*d* restricts rotation in the reverse direction, the detection member 315 rotates in the direction F. Note that the reverse-rotation preventing member 315*d* need not necessarily be provided. Similar operations are made possible if the float member 16 is disposed at a position moved in the normal rotational direction from a position directly above in FIG. 9(*a*) (the twelve o'clock position in a clock) when the remaining amount of ink 99 is close to the maximum amount. However, providing the reverse-rotation preventing member 315*d* can more reliably prevent the detection member 315 from rotating in the reverse direction, even in disturbances such as vibrations.

Further, a plurality of slits 361 is formed along the circumference of the disk of the detection member 315. These slits 361 are arranged at equal intervals in the circumferential direction F of the detection member 315. Each slit 361 extends from the periphery of the detection member 315 toward the center thereof and has a length the same with each other. Further, each slit 361 penetrates the detection member 315 in the thickness direction thereof. Of the slits 361, a slit 361*b* closest to the float member 16 in the circumferential direction F is formed with a larger width with respect to the circumferential direction F than that of other slits 361*a*. The widths of the slits 361*a* in the circumferential direction F are identical to each other. Light blocking sections 362 are formed between each of the slits 361.

On the other hand, a light path 341 is formed on the virtual straight line connecting the light emitting element 31*a* and the light receiving element 31*b*. The light path 341 is located at a position approximately center of the ink cartridge 310 with respect to the up-down direction in FIG. 9(*b*). The detection member 315 is located at a position approximately center of the ink cartridge 310 with respect to the left-right direction in FIG. 9(*b*) so that the detection member 315 can block the light path 341. A detection position 342 is a position at which the light path 341 intersects with the detection member 315 in FIG. 9(*b*). The detection position 342 is located at a position adjacent to the left end of the detection member 315 in FIG. 9(*a*). Note that, although not shown in FIGS. 9(*a*) and 9(*b*), the detection windows 11*a* and 11*b* are formed in a casing 314 of the ink cartridge 310, the detection windows 11*a* and 11*b* being located on an extension line of the light path 341.

FIG. 9(*a*) shows a state where ink 99 is accommodated within the ink accommodating chamber 314*c* of the ink cartridge 310 nearly to a maximum extent. FIG. 9(*c*) shows a state where ink 99 has decreased from the state of FIG. 9(*a*). FIG. 9(*d*) shows a state where ink 99 has further decreased from the state of FIG. 9(*c*) and ink 99 within the ink accommodating chamber 314*c* is nearly empty. The float member 16 is made of a resin material of which specific gravity is smaller than ink, or is formed with a cavity inside if the float member 16 is made of a material whose specific gravity is greater than ink. Thus, as a whole, the float member 16 has smaller specific gravity than ink 99. In addition, as can be understood from FIG. 9(*b*), since the float member 16 is larger than the detection member 315 with respect to a direction of the pivot shaft 17*a*, the float member 16 can occupy a relatively large volume so that buoyancy can be ensured readily. As shown in FIGS. 9(*a*) through 9(*d*), as the ink 99 accommodated within the ink accommodating chamber 314*c* decreases, the float member 16 rotates about the pivot shaft 17*a* in the circumferential direction F. The detection member 315 also rotates about the pivot shaft 17*a* in the circumferential direction F in conjunction with the float member 16.

Here, during a transition period from the state of FIG. 9(*a*) to the state of FIG. 9(*c*), a state where the slit 361*a* is located at the detection position 342 (corresponding to a state where the detection member 315 is at a first position) and a state where the light blocking section 362 is located at the detection position 342 (corresponding to a state where the detection member 315 is at a second position) repeat alternately. More specifically, as ink 99 decreases, a state where one light blocking section 362*a* of the two light blocking sections 362 with a slit s4 interposed therebetween is located at the detection position 342, for example, changes to a state where the other light blocking section 362*b* of the above-mentioned two light blocking sections 362 is located at the detection position 342, via a state where the slit s4 is located at the detection position 342. As the ink 99 decreases, these changes are repeated.

Further, during another transition period from the state of FIG. 9(*c*) to the state of FIG. 9(*d*), similar to the above period, the state where the slit 361*a* is located at the detection position 342 and the state where the light blocking section 362 is located at the detection position 342 are alternately repeated. Then, the slit 361*b* comes to the detection position 342 as shown in FIG. 9(*d*). Note that, in the present embodiment, when the ink 99 within the ink accommodating chamber 314*c* is empty, the slit 361*b* is located at the detection position 342.

By the time the ink 99 within the ink cartridge 310 becomes empty after being consumed from its maximum amount, the detection member 315 moves as described above as the ink 99 in the ink accommodating chamber 314*c* decreases. At this time, the intensity of light received by the light receiving element 31*b* changes as shown in FIG. 9(*e*). In FIG. 9(*e*), a horizontal axis represents time, whereas a vertical axis represents the intensity of light. Because the ink 99 within the ink cartridge 310 is consumed as the time goes by, the horizontal axis of FIG. 9(*e*) can also represents consumption amounts of ink 99 as well as time. In FIG. 9(*e*), the light intensity A1 indicates the intensity of light received by the light receiving element 31*b* when the detection member 315 does not block the light path 341 connecting the light emitting element 31*a* and the light receiving element 31*b*.

In FIG. 9(*e*), time t23, t24, and t25 respectively indicate a point of time shown in FIG. 9(*a*), FIG. 9(*c*), and FIG. 9(*d*). At the time t23, the detection member 315 blocks the light path 341 at the detection position 342. Accordingly, at the time t23, the intensity of light is A0 which is smaller than A1.

During a period between t23 and t24, the state where the light blocking section 362 is located at the detection position 342 and the state where the slit 361*a* is located at the detection position 342 are repeated as described above. When the light blocking section 362 is located at the detection position 342, the light path 341 is blocked by the light blocking section 362 and thus the intensity of light is A0. When the slit 361*a* is located at the detection position 342, the light path 341 is not blocked and thus the intensity of light is A1.

Then, at the time t25, the slit 361*b* comes to the detection position 342. Accordingly, at t25, the intensity of light is A1. The slit 361*b* has a larger width in the circumferential direction F than that of the slits 361*a*. Hence, if a speed at which the ink 99 is consumed remains approximately constant over an entire service period of the ink cartridge 310, the time period during which the intensity is A1 continues for a long time.

As described above, according to the present embodiment, as the ink 99 in the ink cartridge 310 is consumed, the intensity of light received by the light receiving element 31*b* is that shown in FIG. 9(*e*). Accordingly, the control section 22 can tell how much amount of the ink 99 is left in the ink cartridge 310 in multiple stages, based on signals from the light receiving element 31*b*. For example, at the time t23, the state where the intensity of light becomes A1 has not appeared yet. In contrast, by the time t24, the state where the intensity of light is A1 appears many times as time passes. Accordingly, the control section 22 can detect in multiple stages how much amount of the ink 99 remains at present, by counting how many times the intensity of light A1 and the intensity of light A0 have appeared by that time.

The state where the intensity of light is A1 corresponds to the state where the light blocking section 362 is located at the detection position 342, whereas the state where the intensity of light is A0 corresponds to the state where the slit 361 is located at the detection position 342. Hence, in how many stages in total the remaining amount of ink 99 can be grasped depends on how many the slits 361 and the light blocking sections 362 are formed in the detection member 315. For example, in the present embodiment, the remaining amount of ink 99 can be grasped in 22 stages in total: one stage for the state shown in FIG. 9(*a*), one stage for the state shown in FIG. 9(*d*), 10 stages for the state where the light blocking section 362 is located at the detection position 342 during the time period between FIG. 9(*a*) and FIG. 9(*d*), and 10 stages for the state where the slit 361*a* is located at the detection position 342 during the time period between FIG. 9(*a*) and FIG. 9(*d*).

The control section 22 counts how many times the state where the intensity of light is A1 and the state where the intensity of light is A0 have appeared up until present, thereby identifying in multiple stages how much amount of the ink 99 is left and notifying the user of the obtained information via the notifying section 29.

Further, if the ink 99 remaining in the ink cartridge 310 becomes nearly empty as shown in FIG. 9(*d*), as described above, the intensity of light A1 continues for a long time, compared with the period before the time t24. Based on this information, the control section 22 determines that the remaining amount of ink 99 is small, and notifies the user that a small amount of ink 99 is left via the notifying section 29.

Fourth Embodiment

Figure 10:
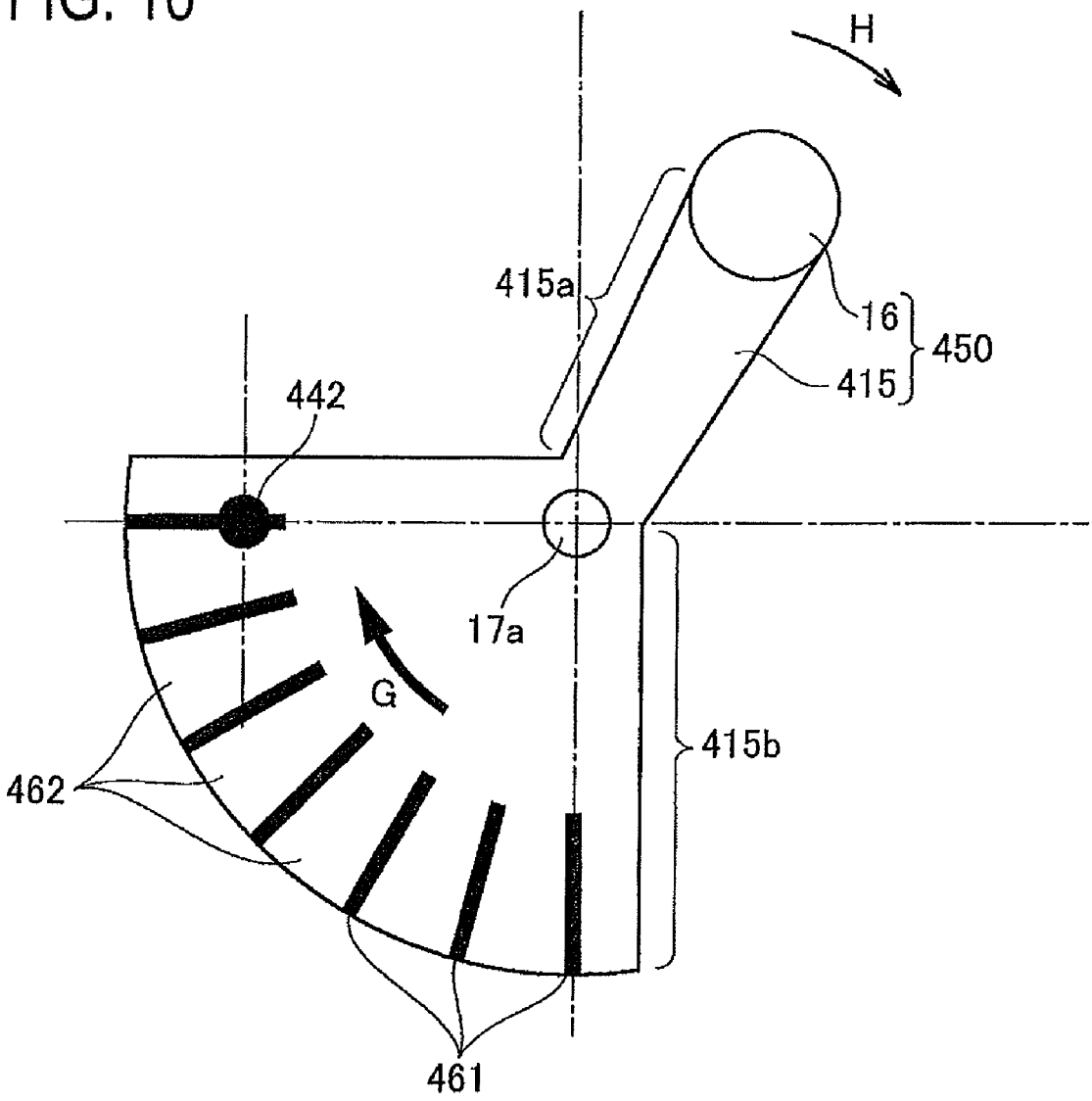
FIG. 10 An elevation view of a remaining-amount detecting member in an ink cartridge according to a fourth embodiment.

In a fourth embodiment, the remaining-amount detecting member 350 in the third embodiment is replaced by a remaining-amount detecting member 450 in FIG. 10. The remaining-amount detecting member 450 includes a detection member 415 and the float member 16. The detection member 415 is a plate-shaped member including a detection section 415*b* having a fan-like or sector shape and an arm section 415*a* extending from a central portion of the fan shape of the detection section 415*b*. The pivot shaft 17*a* is fixed to a position vicinity of the center of the fan shape of the detection section 415*b*. The pivot shaft 17*a* is supported by the bearing 17*b* in a region not shown in the drawing, so that the remaining-amount detecting member 450 can pivotally move in a direction G. The float member 16 is fixed to an end of the arm section 415*a* away from the pivot shaft 17*a*.

A plurality of slits 461 is formed along the circumference of the fan shape of the detection section 415*b* at equal intervals. Each of the slits 461 has a length identical to each other and extends from the circumference of the fan shape toward the pivot shaft 17*a*. The length of the slit 461 is adjusted so that a detection position 442 in the fourth embodiment can be located on the slit 461. A plurality of light blocking sections 462 is formed between the slits 461.

In the fourth embodiment, the remaining-amount detecting member 450 with the above-described configuration is provided within the ink cartridge. In the fourth embodiment, as the ink 99 within the ink cartridge decreases, the float member 16 moves in a direction H, and also the detection section 415*b* pivotally moves in the direction G. At this time, a state where the light blocking section 462 is located at the detection position 442 and a state where the slit 461 is located at the detection position 442 are repeated alternately. Accordingly, in the fourth embodiment, like the third embodiment, the control section 22 can grasp in multiple stages how much amount of ink 99 is left at present, by counting how many times the state where the intensity of light is A1 and the state where the intensity of light is A0 have appeared by that time.

Fifth Embodiment

Figure 11:
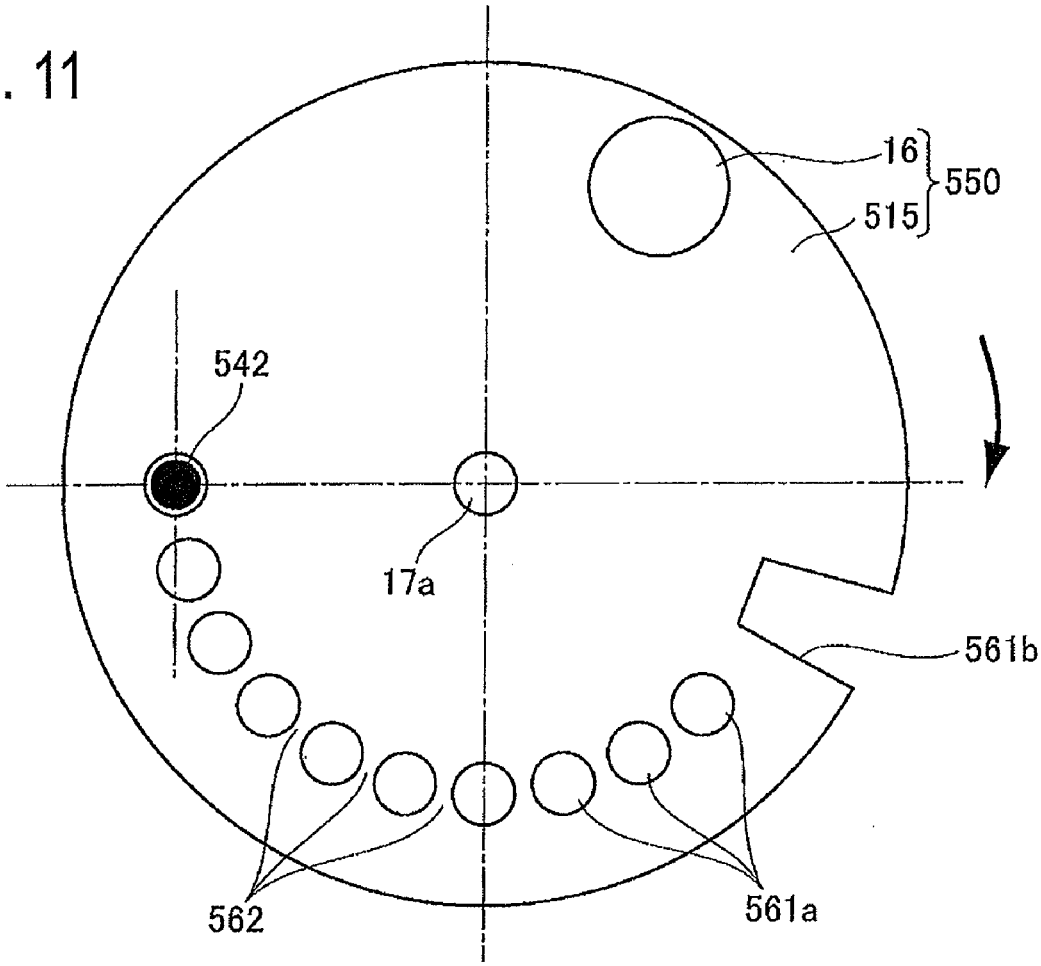
FIG. 11 An elevation view of a remaining-amount detecting member in an ink cartridge according to a fifth embodiment.

In a fifth embodiment, the remaining-amount detecting member 350 in the third embodiment is replaced by a remaining-amount detecting member 550 in FIG. 11. The differences between the remaining-amount detecting member 550 and the remaining-amount detecting member 350 are the shapes of slits 561 and light blocking sections 562 formed in a detection member 515. The other parts of the fifth embodiment are identical to those in the third embodiment.

A plurality of through-holes 561*a* is formed along the circumferential direction of the detection member 515 at equal intervals. Each of the through-holes 561*a* has a circular shape of an identical size. Further, each of the through-holes 561*a* is arranged at a position toward the pivot shaft 17*a* from the circumference of the detection member 515, the position being away from the pivot shaft 17*a* by a distance exactly the same as the distance by which a detection position 542 is distanced from the pivot shaft 17*a*. The detection member 515 is further formed with a slit 561*b*. The slit 561*b* is arranged adjacent to one of the through-holes 561*a* which is the closest to the float member 16 in the circumferential direction. The slit 561*b* is cut from the circumference of the detection member 515 toward the pivot shaft 17*a* in a trapezoidal shape. The length of the slit 561*b* in the circumferential direction is longer than the diameters of the through-holes 561*a*. Further, the light blocking sections 562 are formed between the respective ones of the slits 561.

In the fifth embodiment, when the ink 99 within the ink cartridge decreases, the remaining-amount detecting member 550 rotates in the direction of the arrow in FIG. 11. At this time, the state where the light blocking section 562 is located at the detection position 542 and the state where the through-hole 561*a* is located at the detection position 542 are repeated alternately. Accordingly, the control section 22 can know in multiple stages how much amount of the ink 99 is currently left, by counting how many times the state where the intensity of light is A1 and the state where the intensity of light is A0 have appeared by the present time.

Further, in the fifth embodiment, the shape of the slit 561*b* is different from the shape of the through-holes 561*a*. Accordingly, change in the intensity of light received by the light receiving element 31*b* is different in terms of time between the state where the through-hole 561*a* is located at the detection position 542 and the state where the slit 561*b* is located at the detection position 542. Thus, the slit 561*b* functions similarly to the slit 361*b* in the third embodiment. That is, in the fifth embodiment, like the third embodiment, the control section 22 can determine that the remaining amount of ink 99 is small.

Sixth Embodiment

Figure 12:
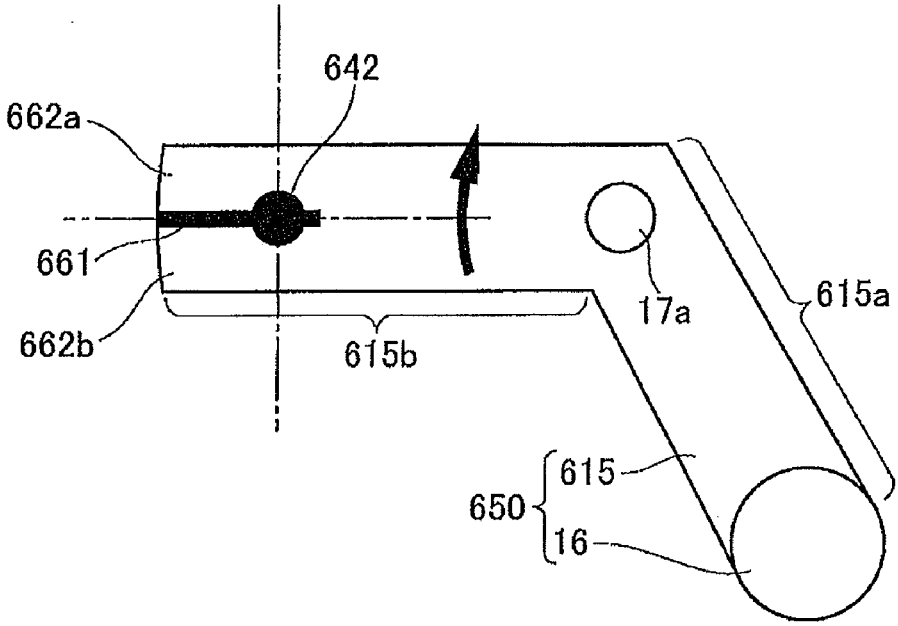
FIG. 12 An explanatory view of a remaining-amount detecting member in an ink cartridge according to a sixth embodiment.

In a sixth embodiment, the remaining-amount detecting member 350 in the third embodiment is replaced by a remaining-amount detecting member 650 in FIG. 12. The remaining-amount detecting member 650 includes a detection member 615 and the float member 16. The detection member 615 includes an arm section 615*a* extending obliquely from the pivot shaft 17*a* toward the right-lower side in FIG. 12, and an arm section 615*b* extending toward the left side in FIG. 12. The float member 16 is fixed to a distal end of the arm section 615*a*, whereas a slit 661 is formed at a distal end of the arm section 615*b*. The slit 661 extends toward the pivot shaft 17*a* from the distal end of the arm section 615*b* to a detection position 642. Thus, light blocking sections 662*a* and 662*b* are formed such that the slit 661 is interposed between the light blocking section 662*a* and the light blocking section 662*b*. Further, in the sixth embodiment, the structures of the remaining-amount detecting member 650, the restricting member 17, the detection position 642 and the like are adjusted so that the arm section 615*b* can pass through the detection position 642 in a direction of an arrow in FIG. 12 when the ink 99 within the ink cartridge decreases and the ink 99 becomes close to empty.

In the sixth embodiment, when the remaining amount of ink 99 within the ink cartridge becomes small, the state of the remaining-amount detecting member 650 changes sequentially from a state where the arm section 615*b* is located at a position below the detection position 642, to a state where the light blocking section 662*a* is located at the detection position 642, to a state where the slit 661 is located at the detection position 642, then to a state where the light blocking section 662*b* is located at the detection position 642, and finally to a state where the arm section 615*b* is located at a position above the detection position 642. Accordingly, in the sixth embodiment, the control section 22 can detect the residual amount of ink 99 in five stages in total.

Seventh Embodiment

Figure 13B:
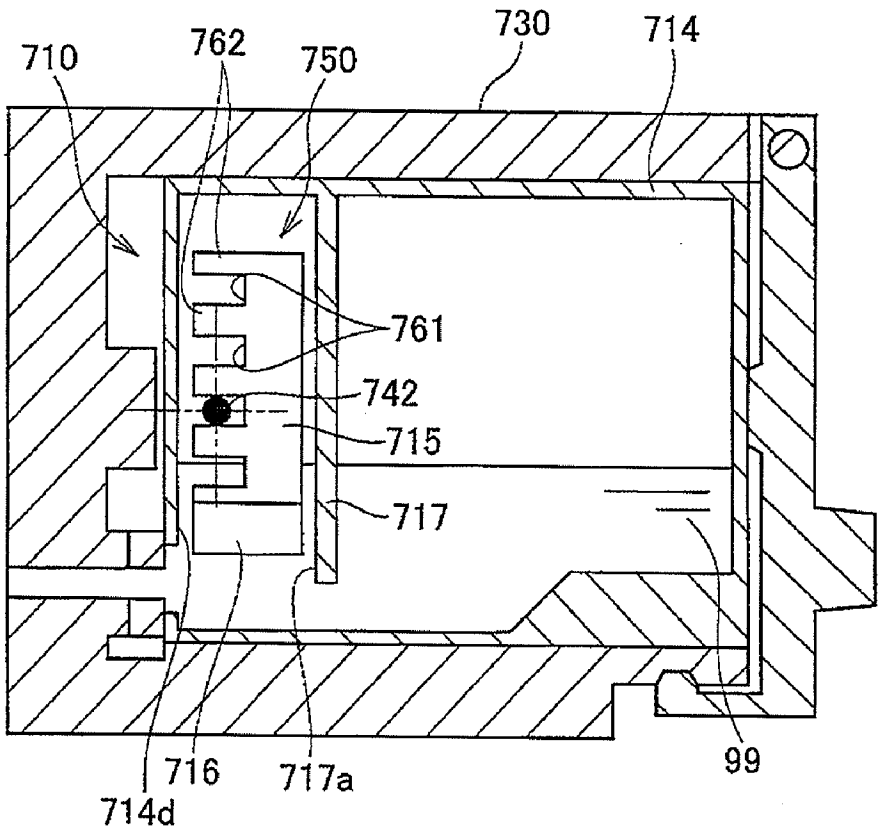
FIG. 13 (a) is a cross-sectional view showing a detailed configuration around an ink cartridge according to a seventh embodiment mounted in the printer of FIG. 1, and (b) is a cross-sectional view taken along a line XIIIB-XIIIB in (a)
Figure 13A:
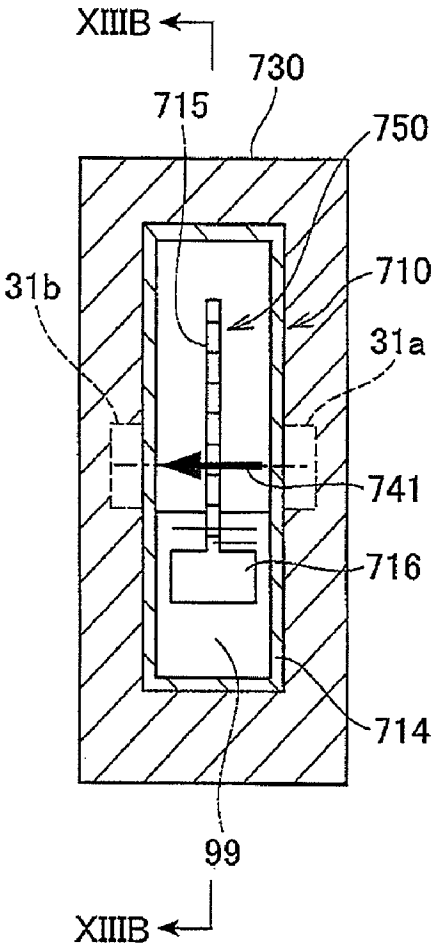
Figure 14A:
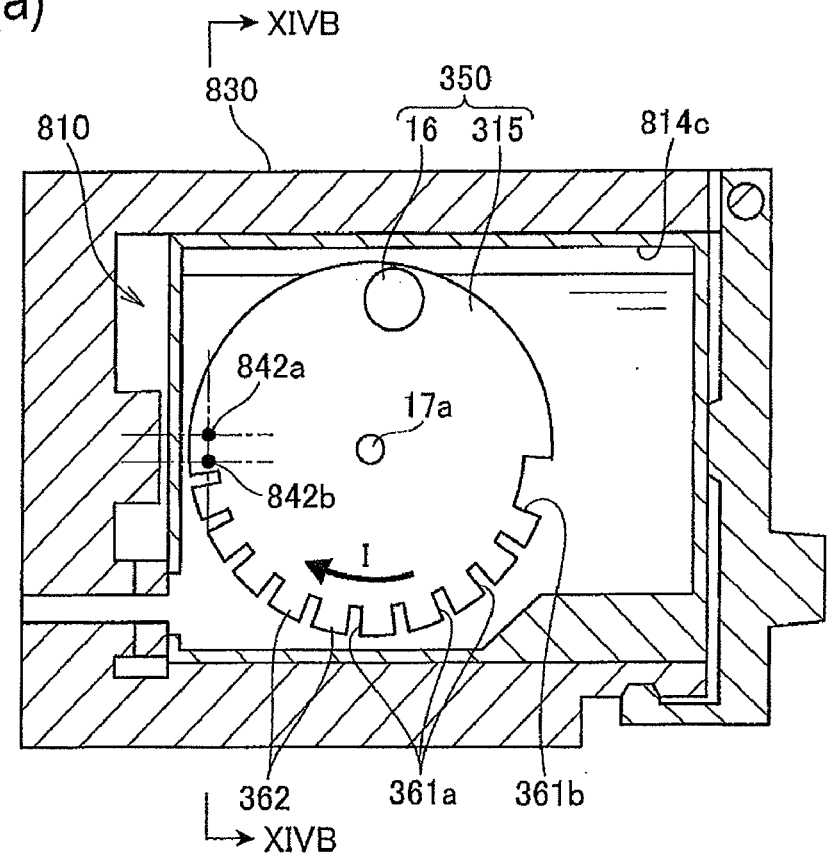
FIG. 14(*a*) A cross-sectional view showing a detailed configuration around an ink cartridge according to an eighth embodiment.
Figure 14B:
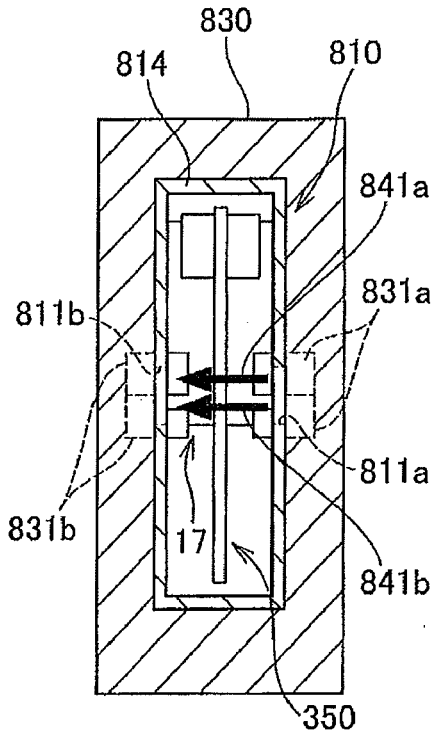
Figure 14C:
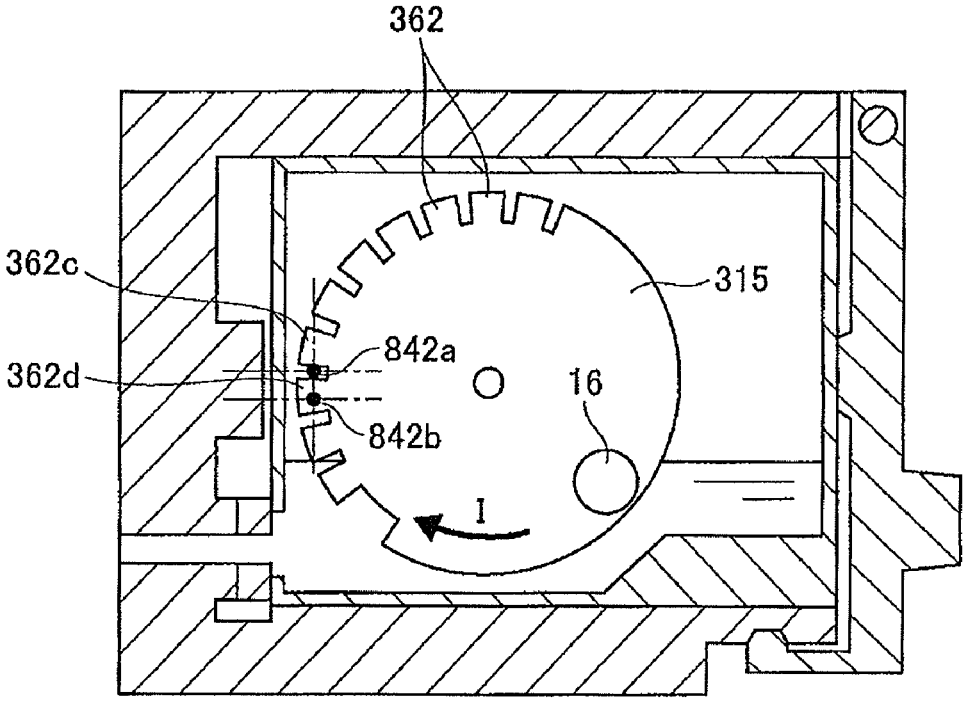
Figure 14D:
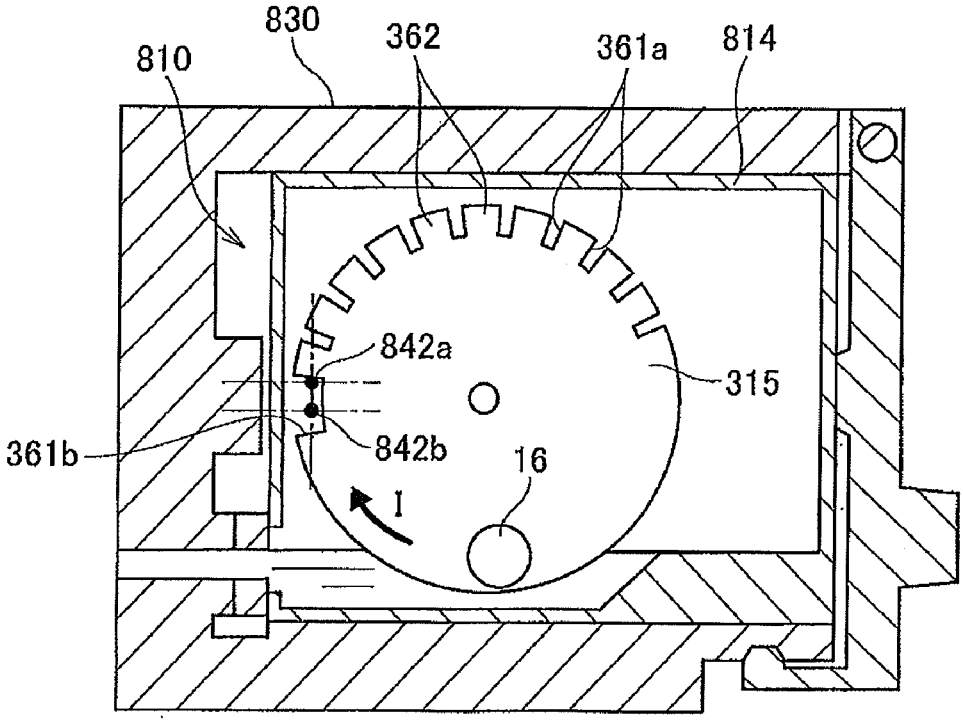
Figure 14E:
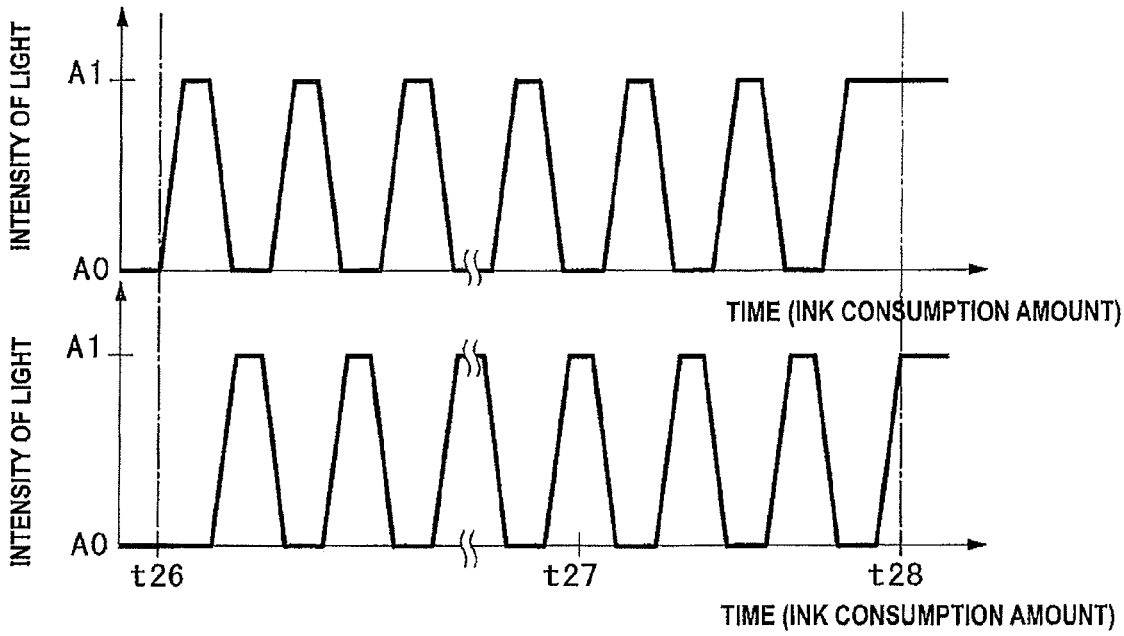
Figure 14F:
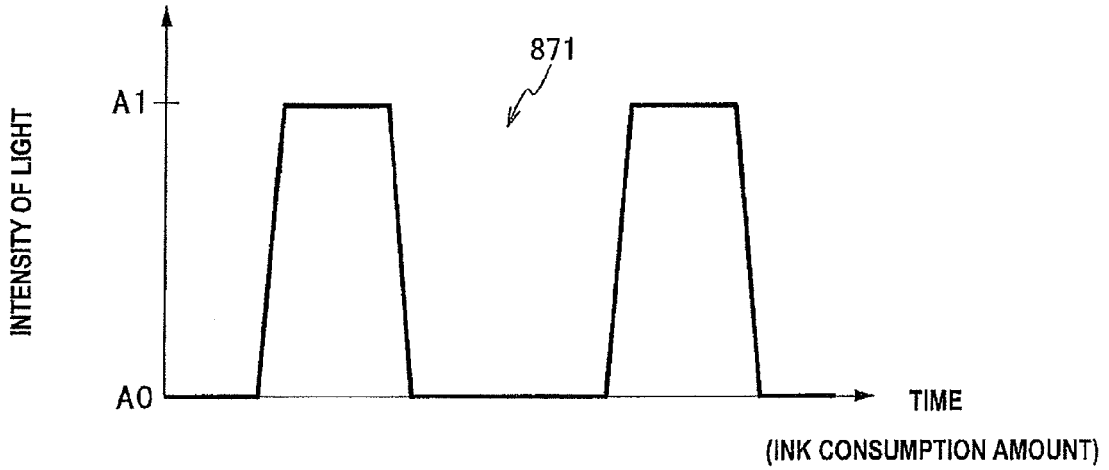
Figure 14F:
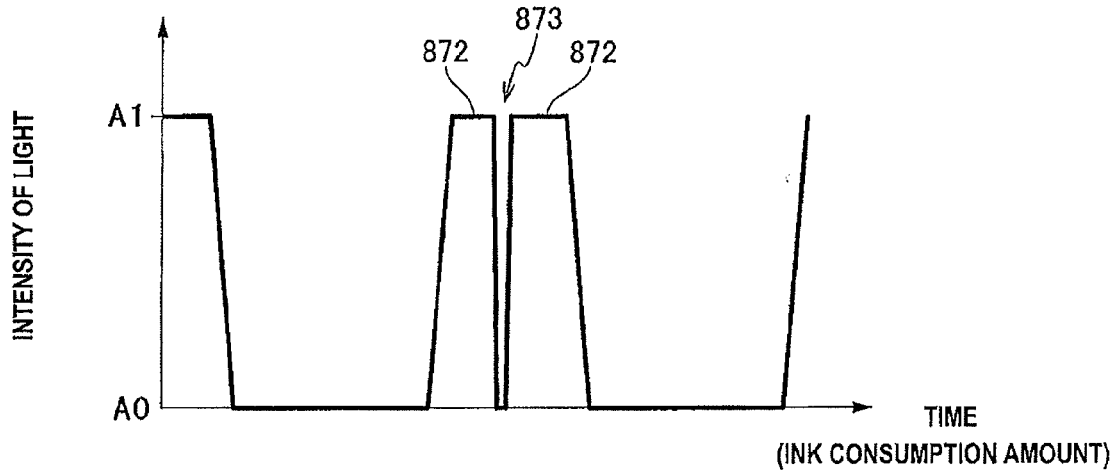

FIG. 13 is a cross-sectional view showing a configuration of an ink cartridge 710 and an accommodating case 730 according to a seventh embodiment. FIG. 13(*a*) corresponds to FIG. 2(*a*), and FIG. 13(*b*) corresponds to FIG. 2(*b*) respectively.

A remaining-amount detecting member 750 according to the seventh embodiment integrally includes a detection member 715 and a float member 716. The float member 716 has an approximately rectangular parallelepiped shape, and has a mass per unit volume that is smaller than the density of ink 99. The detection member 715 is a plate-shaped member whose thickness direction is parallel to the left-right direction of FIG. 13(*a*). The float member 716 is fixed to a lower end of the detection member 715.

A plurality of slits 761 is formed in the detection member 715, the plurality of slits 761 being arranged in the up-down direction of FIG. 13. Each of the slits 761 has an identical shape and an identical size to each other. The slits 761 are arranged at equal intervals in the up-down direction. Light blocking sections 762 are formed between the slits 761. As shown in FIG. 13, the detection member 715 is arranged at a position where the detection member 715 blocks a light path 741 connecting the light emitting element 31*a* and the light receiving element 31*b*.

A restricting member 717 is integrally fixed to a casing 714 of the ink cartridge 710. The restricting member 717 is a plate-shaped member extending downward perpendicularly from the ceiling surface within the casing 714. The restricting member 717 is formed with a restricting surface 717*a* which is in parallel with the up-down direction. On the other hand, a left-side inner wall surface 714*d* of the casing 714 extends in parallel with the restricting surface 717*a*, and is in confrontation with the restricting surface 717*a* in the left-right direction in FIG. 13(*b*). The restricting member 717 is arranged such that the separation distance between the inner wall surface 714*d* and the restricting surface 717*a* is slightly larger than the maximum width of the remaining-amount detecting member 750 in the left-right direction. Further, the remaining-amount detecting member 750 is arranged between the inner wall surface 714*d* and the restricting surface 717*a*. The restricting surface 717*a* and the inner wall surface 714*d* restrict the movement of the remaining-amount detecting member 750 in the left-right direction.

In the seventh embodiment, as the ink 99 within the ink cartridge 710 decreases, the float member 716 moves down with the downward movement of the ink surface. In conjunction with this, the entirety of the remaining-amount detecting member 750 moves down. Because the remaining-amount detecting member 750 is restricted from moving in the left-right direction of FIG. 13(*b*) by the inner wall surface 714*d* and the restricting surface 717*a*, the light blocking sections 762 do not move away from a detection position 742 with respect to the left-right direction. With the downward movement of the remaining-amount detecting member 750, a state where the light blocking section 762 is located at the detection position 742 and a state where the slit 761 is located at the detection position 742 are repeated alternately. Accordingly, in the seventh embodiment, like the first through sixth embodiments, the control section 22 can grasp in multiple stages how much amount of ink 99 is left at present, by counting how many times the state where the intensity of light is A1 and the state where the intensity of light is A0 have appeared up to now.

Eighth Embodiment

FIG. 14 is a cross-sectional view showing a configuration of an ink cartridge 810 and an accommodating case 830 according to an eighth embodiment. FIG. 14(*a*) and FIG. 14(*b*) correspond to FIG. 2(*b*) and FIG. 2(*a*), respectively.

In the accommodating case 830 of the eighth embodiment, the optical sensor section 31 in the accommodating case 330 of the third embodiment is replaced by an optical sensor section 831. The optical sensor section 831 includes two light emitting elements 831*a* and two light receiving elements 831*b*. The two light emitting elements 831*a* are aligned with each other in the up-down direction. The two light receiving elements 831*b* are also aligned with each other in the up-down direction. Further, these light emitting elements 831*a* and light receiving elements 831*b* are arranged such that each of the light emitting elements 831*a* is in confrontation with the corresponding one of the light receiving elements 831*b* with respect to the left-right direction of FIG. 14(*b*). Accordingly, a light path 841*a* connecting one of the light emitting elements 831*a* and one of the light receiving elements 831*b* and a light path 841*b* connecting the other one of the light emitting elements 831*a* and the other one of the light receiving elements 831*b* are formed within the ink cartridge 810. Thus there become two detection positions 842*a* and 842*b* as a detection position by the optical sensor section 831. The detection positions 842*a* and 842*b* correspond to the light paths 841*a* and 841*b*, respectively.

As shown in FIGS. 14(*a*) and 14(*b*), the ink cartridge 810 of the eighth embodiment may include a configuration approximately the same as that of the ink cartridge 310 of the third embodiment. However, light transmissive portions, such as detection windows 811*a* and 811*b* that transmit light, must be formed in a casing 814, and shapes, sizes, and positions of these portions need to be adjusted such that both of the light paths 841*a* and 841*b* be secured when the ink cartridge 810 is in the mounted attitude.

Further, the remaining-amount detecting member 350 provided within the ink cartridge 810 has a configuration similar to that in the third embodiment, but the slits 361 and the light blocking sections 362 of the detection member 315 need to be adjusted as described below. That is, the widths of the slits 361*a*, 361*b* and the light blocking sections 362 in a circumferential direction I and the separation distance between the two light emitting elements 831*a* are required to be adjusted to satisfy a relationship: the width of the slit 361*a*<the separation distance between the light emitting elements 831*a*<the width of the light blocking section 362<the width of the slit 361*b*.

FIG. 14(*a*) shows a state where the ink 99 is accommodated within the ink cartridge 810 nearly to a maximum amount. FIG. 14(*c*) shows a state where the ink 99 has decreased from the state of FIG. 14(*a*). FIG. 14(*d*) shows a state where the ink 99 has further decreased from the state of FIG. 14(*c*) and the ink 99 within the ink cartridge 810 becomes nearly empty. As the ink 99 decreases, the remaining-amount detecting member 350 rotates in the circumferential direction I. During a time period from FIG. 14(*a*) to FIG. 14(*d*), a state where the light blocking section 362 is located at a detection position 842*b* and a state where the slit 361*a* is located at the detection position 842*b* are repeated. In FIG. 14(*d*), the slit 361*b* is located at the detection position 842*b*. Meanwhile, during a time period from FIG. 14(*a*) to FIG. 14(*d*), each slit 361*a* and each light blocking section 362 pass a detection position 842*a* located above the detection position 842*b*, slightly after the slit 361*a* and the light blocking section 362 pass through the detection position 842*b*. Then, in FIG. 14(*d*), the slit 361*b* is located at both of the detection positions 842*a* and 842*b*.

FIG. 14(*e*) shows an example of graphs indicating respective changes in intensity of light received by the two light receiving elements 831*b*, from the state where the ink 99 within the ink cartridge 810 is at the maximum amount to the state where the ink 99 has been consumed to be empty. In each of the upper and lower graphs in FIG. 14(*e*), the horizontal axis represents time (and the consumption amount of ink 99), whereas the vertical axis represents the intensity of light. Time t26-t28 is time corresponding to FIGS. 14(*a*) through 14(*d*), respectively. The upper graph in FIG. 14(*e*) shows the intensity of light received by the lower one of the two light receiving elements 831*b*, whereas the lower graph in FIG. 14(*e*) shows the intensity of light received by the upper one of the two light receiving elements 831*b*. That is, the upper graph in FIG. 14(*e*) shows that the slits 361 and the light blocking sections 362 pass through the detection position 842*b* sequentially. Further, the lower graph in FIG. 14(*e*) shows that the slits 361 and the light blocking sections 362 pass through the detection position 842*a* sequentially.

As described above, each slit 361*a* and each light blocking section 362 pass through the detection position 842*a*, slightly after the slit 361*a* and the light blocking section 362 pass through the detection position 842*b*. Accordingly, in FIG. 14(*e*), the time period during which the intensity of light is A1, for example, appears in the lower graph at a timing slightly later than the timing in the upper graph.

Further, as described above, the relationship "the width of the slit 361*a*<the separation distance between the light emitting elements 831*a*<the width of the light blocking section 362<the width of the slit 361*b*" is satisfied. That is, the separation distance between the detection positions 842*a* and 842*b* is smaller than the width of the light blocking section 362 and is greater than the width of the slit 361*a* in the circumferential direction I. Accordingly, the state where the slit 361*a* is located at the detection position 842*a* and the state where the slit 361*a* is located at the detection position 842*b* do not appear at the same time. Thus, the time period during which the intensity of light is A1 in the upper graph of FIG. 14(*e*) and the time period during which the intensity of light is A1 in the lower graph of FIG. 14(*e*) appear alternately with passage of time.

At time t28 corresponding to FIG. 14(*d*), the slit 361*b* is located at both the detection positions 842*a* and 842*b*, and therefore the intensity of light is A1 in the upper graph and in the lower graph of FIG. 14(*e*).

In the eighth embodiment, as shown in FIG. 14(*e*), the state where the intensity of light received by both of the two light receiving elements 831*b* becomes A1 does not occur until the state of FIG. 14(*d*) comes. Accordingly, the control section 22 can grasp readily and reliably that the ink 99 within the ink cartridge 810 is nearly empty, by determining whether the intensity of light received by both of the two light receiving elements 831*b* becomes A1. Conversely, the fact that the intensity of light received by one of the two light receiving elements 831*b* is not A1 means that the ink 99 within the ink cartridge 810 is not nearly empty.

The control section 22 may be configured to notify the user via the notifying section 29 that the ink 99 still remains, if it is detected that the ink cartridge 810 is about to be dismounted from the printer 20 when the ink 99 within the ink cartridge 810 is not nearly empty. Alternatively, the printer 20 may be configured to lock the lid section 35 so that the ink cartridge 810 cannot be dismounted as long as the control section 22 detects that the ink cartridge 810 is about to be dismounted from the printer 20 when the ink 99 within the ink cartridge 810 is not nearly empty.

Further, in the eighth embodiment, the residual amount of ink 99 can be grasped accurately, compared with the first through seventh embodiments, as will be described below. The liquid surface of ink 99 within the ink cartridge 810 sometimes moves up and down due to vibrations caused when the printer 20 operates, for example. Concurrently, if the remaining-amount detecting member 350 vibrates in the circumferential direction I, detection errors may be generated as described below.

For example, FIG. 14(*c*) shows a state immediately after a light blocking section 362*c* has passed the detection position 842*a*. Here, if the remaining-amount detecting member 350 vibrates as described above, due to the vibration, the light blocking section 362*c* may move once to the detection position 842*a* in a direction opposite to the circumferential direction I, and thereafter return again to the position shown in FIG. 14(*c*). At this time, in a configuration where only one light receiving element 31*b* detects the intensity of light as in the third embodiment, the control section 22 may possibly detect the passage of the light blocking section erroneously, by determining that one of the light blocking sections has normally passed the detection position 842*a* in the circumferential direction I, although the light blocking section 362*c* has moved to the detection position 842*a* merely temporarily due to the vibration.

In contrast, according to the eighth embodiment, even when the light blocking section 362*c* has moved to the detection position 842*a* temporarily due to vibration, a state where a light blocking section 362*d* is located at the detection position 842*b* is maintained. During this time, the state where the intensity of light is A1 is detected twice at the detection position 842*a*, interposing a state in which the light blocking section 362*c* temporarily blocks the light path 841*a* due to vibration. That is, the intensity of light detected by the two light receiving elements 831*b* changes as shown in FIG. 14(*f*). The upper graph of FIG. 14(*f*) represents the intensity of light received by the light receiving element 831*b* corresponding to the detection position 842*b*, whereas the lower graph represents the intensity of light received by the light receiving element 831*b* corresponding to the detection position 842*a*. As shown in FIG. 14(*f*), while a state 871 in which the intensity of light is A0 at the detection position 842*b* continues, a state 872 in which the intensity of light is A1 at the detection position 842*a* is detected twice. On the other hand, if the intensity of light has been detected normally, the two light receiving elements 831*b* should detect the intensity of light A1 alternately, as shown in FIG. 14(*e*).

The control section 22 of the eighth embodiment corrects, to a correct count value, the counted value on how many times the light receiving element 831*b* has detected the state where the intensity of light is A1, based on the detection results shown in FIG. 14(*f*) which is different from the normal detection results. Specifically, for example, while the state in which the intensity of light is A0 at one of the light receiving elements 831*b* continues, the state in which the intensity of light is A1 at the other one of the light receiving elements 831*b* is detected twice via the state where the intensity of light is A0 is detected once. In this case, the two detections are counted as a single detection. Accordingly, in the eighth embodiment, even when the liquid surface of ink 99 vibrates, the remaining amount of ink 99 can be grasped accurately, compared with the first through seventh embodiments.

Ninth Embodiment

Figure 15B:
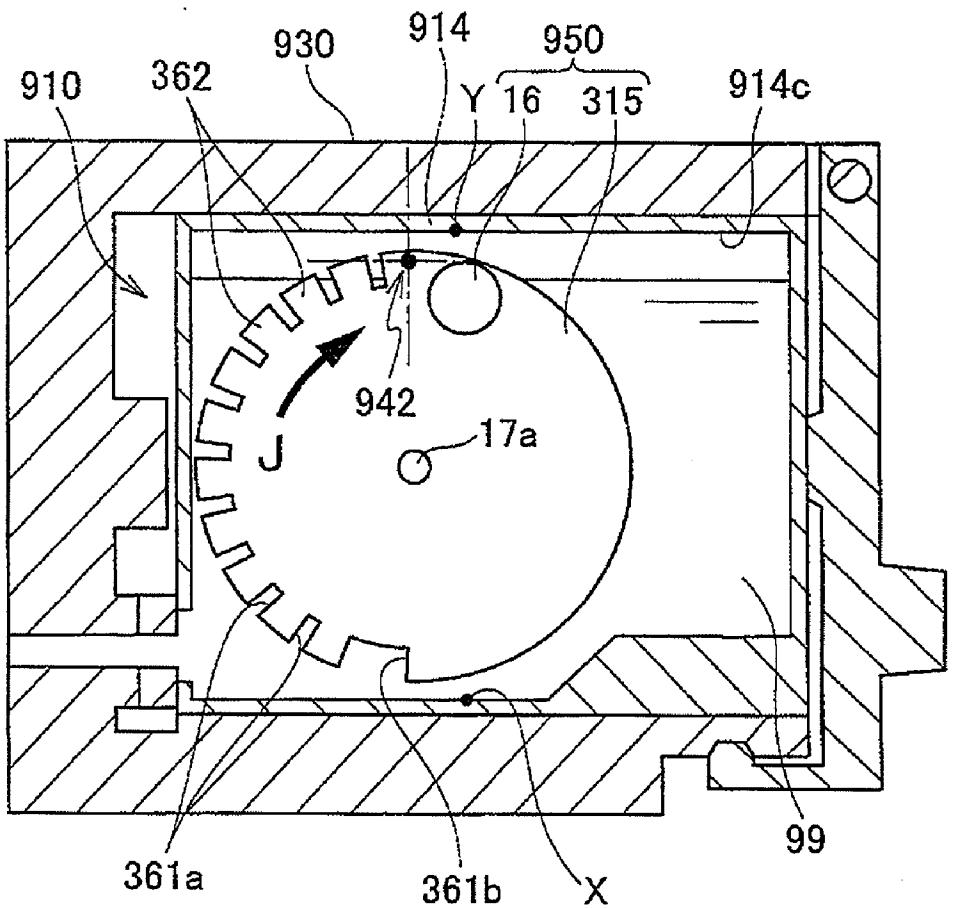
FIG. 15 (a) is a cross-sectional view showing a detailed configuration around an ink cartridge according to a ninth embodiment mounted in the printer of FIG. 1, and (b) is a cross-sectional view taken along a line XVB-XVB in (a)
Figure 15A:
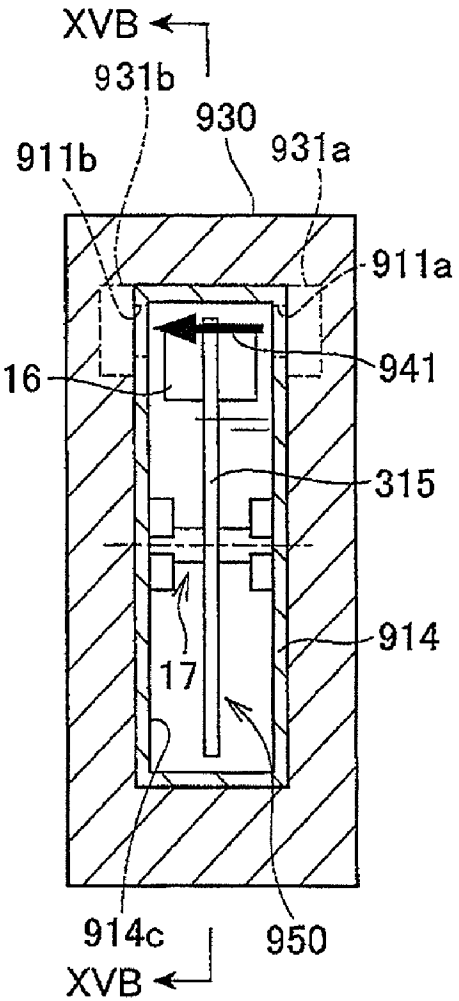

FIG. 15 is a cross-sectional view showing a configuration of an accommodating case 930 and an ink cartridge 910 according to a ninth embodiment. FIG. 15(*a*) and FIG. 15(*b*) correspond to FIG. 2(*a*) and FIG. 2(*b*), respectively. Each of FIG. 15(*a*) and FIG. 15(*b*) shows a case where the ink 99 is accommodated within the ink cartridge 910 to a predetermined maximum amount.

A light emitting element 931*a* and a light receiving element 931*b* of the accommodating case 930 are arranged respectively in a position in confrontation with each other in an uppermost portion of the ink cartridge 910. More specifically, the light emitting element 931*a* and the light receiving element 931*b* are arranged such that a light path 941 is located above the liquid surface of ink 99, when the ink 99 within an ink accommodating chamber 914*c* is accommodated to the predetermined maximum amount in the mounted attitude of the ink cartridge 910. Thus, in FIG. 15(*b*), a detection position 942 is located above the liquid surface of ink 99. A casing 914 of the ink cartridge 910 is formed with detection windows 911*a* and 911*b* on a virtual line connecting the light emitting element 931*a* and the light receiving element 931*b*.

Here, assume that a level of a lowermost position X in the ink accommodating chamber 914*c* is 0, while a level of an uppermost position Y in the ink accommodating chamber 914*c* is 100 with respect to up-down direction. The predetermined maximum amount of ink 99 accommodated within the ink accommodating chamber 914*c* is preferably set such that the level of the liquid surface is higher than or equal to 70 and lower than 90 when the predetermined maximum amount is accommodated in the ink accommodating chamber 914*c*. The reason is as follows. If ink droplets adhere to a portion of the detection position 942 of the inner wall of the casing 914, light emitted from the light emitting element 931*a* is scattered by the ink droplets, which decreases the amount of received light at the light receiving element 931*b*. If a drop in the amount of received light is large, there arises a problem that normal detections cannot be made. Hence, although the detection position 942 should desirably be located at a position always higher than the liquid surface of ink, the liquid surface of ink comes up and down when the ink cartridge 910 receives external vibrations. Hence, the maximum level of the liquid surface of ink is set to a value lower than 90, so that the detection position 942 can always be located above the liquid surface of ink even if vibrations occur. On the other hand, such a problem does not occur if the amount of ink accommodated within the ink accommodating chamber 914*c* is small. However, because printing on a large number of sheets cannot be performed if the amount of ink is too small, the minimum level of the liquid surface of ink is set to a value higher than or equal to 70.

A remaining-amount detecting member 950 is provided within the ink accommodating chamber 914*c*. The pivot shaft 17*a* is fixed to the remaining-amount detecting member 950, and the pivot shaft 17*a* is supported by the bearing 17*b*. The size of the remaining-amount detecting member 950 and the location of the bearing 17*b* are adjusted so that an upper end of the remaining-amount detecting member 950 can be located above the liquid surface of ink 99 in a state of FIG. 15 where the ink 99 is accommodated within the ink accommodating chamber 914*c* to the predetermined maximum amount.

Further, the remaining-amount detecting member 950 includes the detection member 315 of the third embodiment and the float member 16 fixed to the detection member 315. The float member 16 of the remaining-amount detecting member 950 is fixed to a position close to the circumference of the detection member 315. However, unlike the third embodiment, the float member 16 of the remaining-amount detecting member 950 is fixed to a position in proximity to the region where the slits 361*a* are formed. More specifically, the fixing position of the float member 16 is adjusted so that the detection position 942 can be arranged between the slit 361*a* closest to the float member 16 and the float member 16, in a state of FIG. 15 where the ink 99 is accommodated within the ink accommodating chamber 914*c* to the predetermined maximum amount.

In the ninth embodiment, as the ink 99 within the ink cartridge 910 decreases, the remaining-amount detecting member 950 rotates in a direction J. At this time, a state where the light blocking section 362 is located at the detection position 942 and a state where the slit 361*a* is located at the detection position 942 are repeated alternately. Accordingly, the control section 22 can grasp in multiple stages how much amount of ink 99 is left at present, by counting how many times the state where the intensity of light is A1 and the state where the intensity of light is A0 have appeared by that time.

Further, according to the ninth embodiment, even in a state where the ink 99 is accommodated within the ink accommodating chamber 914*c* to the maximum amount, the detection position 942 is located above the liquid surface of ink 99. That is, when light from the light emitting element 931*a* propagates to the light receiving element 931*b* along the light path 941, light does not pass through the ink 99 internally. In contrast, if an ink cartridge is configured such that light from the light emitting element 931*a* passes inside the ink 99 and reaches the light receiving element 931*b*, whether the light passes through the ink 99 differs depending on the level of the liquid surface of ink 99. Hence, the intensity of light received by the light receiving element 931*b* may become unstable. Especially, if ink that transmits little light (for example, black pigment ink) is used, accurate detection of the residual amount of ink 99 may sometimes become completely impossible to be performed in an ink cartridge that uses a light sensor section where light passes through the ink 99. In contrast, in the present embodiment, light does not pass through the ink 99 internally regardless of the remaining amount of ink 99, thereby enabling the intensity of light received by the light receiving element 31*b* to be stable. Hence, the control section 22 can grasp the remaining amount of ink 99 more accurately.

Tenth Embodiment

Figure 16:
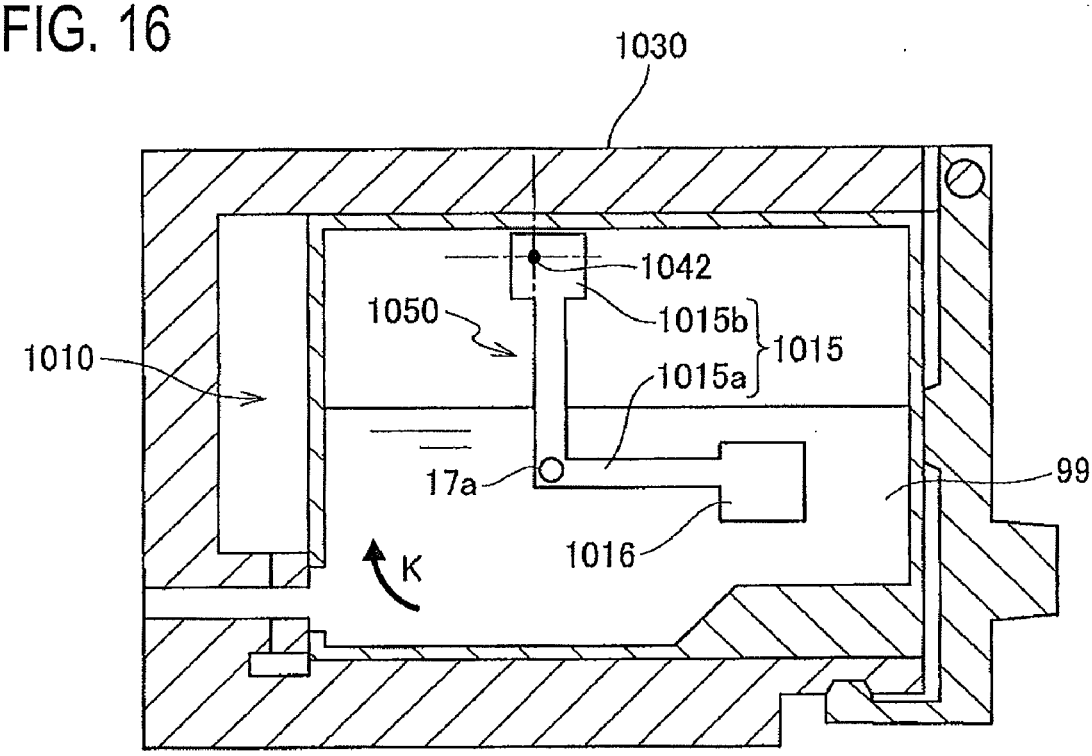
FIG. 16 A cross-sectional view showing a detailed configuration around an ink cartridge according to a tenth embodiment mounted in the printer of FIG. 1.

FIG. 16 is a cross-sectional view showing a configuration of an ink cartridge 1010 and an accommodating case 1030 according to a tenth embodiment. FIG. 16 corresponds to FIG. 2(*b*).

As in the ninth embodiment, in the tenth embodiment a detection position 1042 is designed to be located above the liquid surface of ink 99, in a state where the ink 99 is accommodated within the ink cartridge 1010 to the maximum amount. Further, the remaining-amount detecting member 950 in the ink cartridge 910 of the ninth embodiment is replaced by a remaining-amount detecting member 1050 in the ink cartridge 1010 of the tenth embodiment. The remaining-amount detecting member 1050 includes a detection member 1015 and a float member 1016. The detection member 1015 includes an arm section 1015*a* and a detection section 1015*b*. The arm section 1015*a* is a plate-shaped member that is bent approximately perpendicularly. The detection section 1015*b* is fixed to one distal end of the arm section 1015*a*, whereas the float member 1016 is fixed to the other distal end. The pivot shaft 17*a* is fixed to a bent corner section of the arm section 1015*a*. As the ink 99 within the ink cartridge 1010 decreases, the remaining-amount detecting member 1050 pivotally moves about the pivot shaft 17*a* in a direction K. The shape of the remaining-amount detecting member 1050, the position of the pivot shaft 17*a*, and the like are adjusted such that the detection section 1015*b* passes through the detection position 1042 in the direction K of FIG. 16 when the remaining amount of ink 99 is small.

In the tenth embodiment, when the remaining amount of ink 99 within the ink cartridge 1010 becomes small, the status of the remaining-amount detecting member 1050 changes from a state before the detection section 1015*b* passes through the detection position 1042, to a state after the detection section 1015*b* has passed the detection position 1042, via a state where the detection section 1015*b* is located exactly at the detection position 1042. Accordingly, the intensity of light received by the light receiving element 931*b* changes twice. Thus, the control section 22 can grasp the remaining amount of ink 99 in three stages based on signals from the light receiving element 931*b*.

Further, according to the tenth embodiment, like the ninth embodiment, because light does not pass through inside the ink 99 regardless of the remaining amount of ink 99, the intensity of light received by the light receiving element 931*b* is stable. Hence, the control section 22 can grasp the remaining amount of ink 99 more accurately.

Eleventh Embodiment

Figure 17:
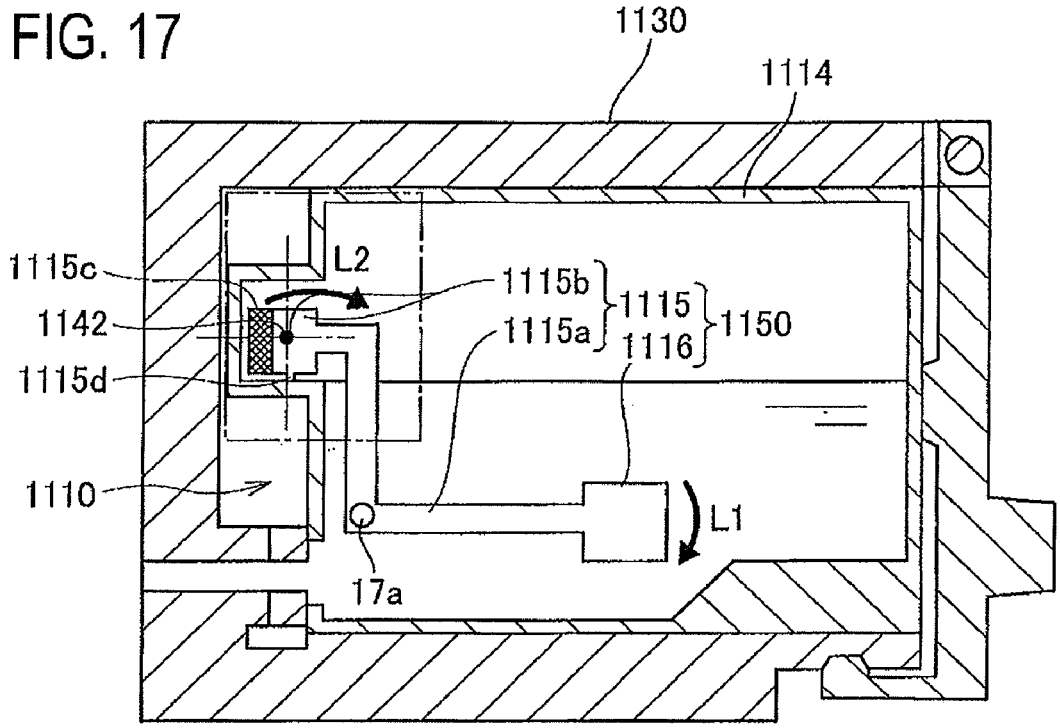
FIG. 17 A cross-sectional view showing a detailed configuration around an ink cartridge according to an eleventh embodiment mounted in the printer of FIG. 1.

FIG. 17 is a cross-sectional view showing a configuration of an ink cartridge 1110 and an accommodating case 1130 according to an eleventh embodiment. FIG. 17 corresponds to FIG. 2(*b*).

The ink cartridge 1110 includes a remaining-amount detecting member 1150. The remaining-amount detecting member 1150 includes a detection member 1115 and a float member 1116. The detection member 1115 includes an arm section 1115*a* and a detection section 1115*b*. The arm section 1115*a* is a plate-shaped member which is bent approximately at a right angle. The detection section 1115*b* is fixed to one end of the arm section 1115*a*, whereas the float member 1116 is fixed to the other end. The pivot shaft 17*a* is fixed to a bent corner section of the arm section 1115*a*. The position at which the pivot shaft 17*a* is supported by the ink cartridge 1110 is adjusted such that the float member 1116 fixed to the other end of the arm section 1115*a* comes to a position near the bottom surface within an ink accommodating chamber 1114*c*. The detection section 1115*b* includes a slit-formed section 1115*c* in which fine slits are formed. The slit-formed section 1115*c* is formed in the left end portion of the detection section 1115*b* in FIG. 17, and has a band-like zone spanning from the upper end to the lower end of the detection section 1115*b*.

Further, a protruding section 1115*d* is formed at the lower end of the detection section 1115*b*. The protruding section 1115*d* contacts a casing 1114 of the ink cartridge 1110, thereby restricting the movement of the detection section 1115*b* so that the detection section 1115*b* cannot move lower than a position shown in FIG. 17. Hence, the remaining-amount detecting member 1150 is held at a prescribed position from a state where the ink 99 is accommodated within the ink cartridge 1110 to a maximum amount to a state where the liquid surface of ink 99 reaches the float member 1116. When the liquid surface of ink 99 moves down to reach the float member 1116, the float member 1116 follows the liquid surface of ink 99 and moves in a direction L1. In conjunction with this, the detection section 1115*b* also moves in a direction L2. Note that, as described above, the float member 1116 is arranged at the position near the bottom surface of the ink accommodating chamber 1114*c*. Accordingly, if the liquid surface of ink 99 moves down to reach the float member 1116, the remaining amount of ink 99 within the ink accommodating chamber 1114*c* becomes small.

Figure 18A:
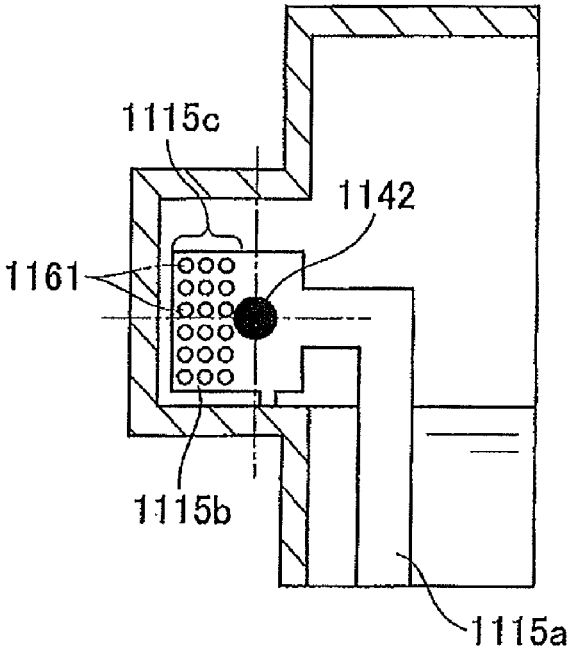
FIG. 18 Partial enlarged views of FIG. 17 showing positions of a remaining-amount detecting member in response to amounts of ink left in the ink cartridge according to the eleventh embodiment, wherein (a) shows a position of the remaining-amount detecting member when the remaining amount of ink is nearly at the maximum amount, (b) shows a position of the remaining-amount detecting member when the remaining amount of ink becomes less than the maximum amount, (c) shows a position of the remaining-amount detecting member when the remaining amount of ink becomes even less than the state shown in (b)
Figure 18B:
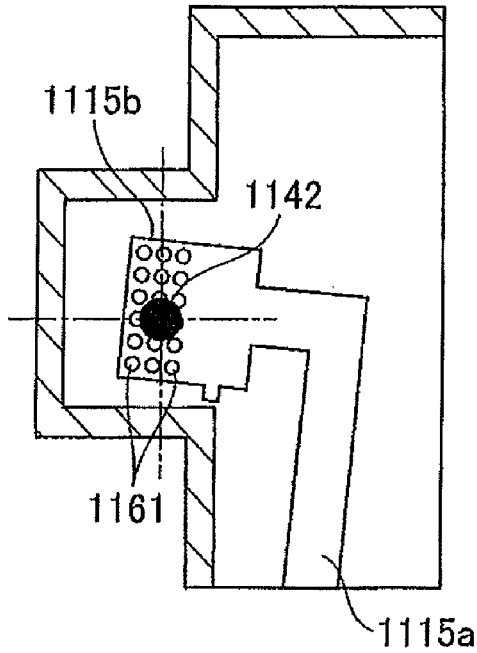
Figure 18C:
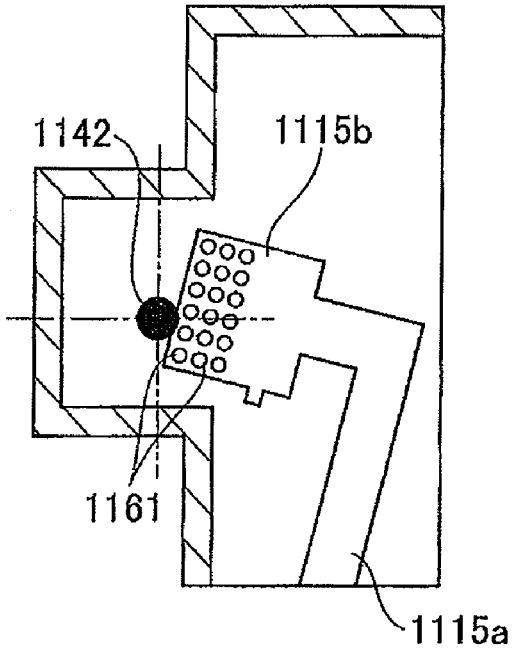

FIG. 18 is an enlarged view of an area enclosed by a single-dot chain line in FIG. 17. FIG. 18(*a*) shows a state before the liquid surface of ink 99 reaches the float member 1116. FIG. 18(*b*) shows a state after the liquid surface of ink 99 has moved down to reach the float member 1116, and the detection section 1115*b* has moved slightly from the position of FIG. 17 in the direction L2. FIG. 18(*c*) shows a state after the liquid surface of ink 99 has lowered, and the detection section 1115*b* has moved further from the position of FIG. 18(*b*). Note that, in the eleventh embodiment, a reference number 1142 indicates a range onto which light from the light emitting element 31*a* provided in the printer 20 is irradiated.

As shown in FIG. 18, a plurality of slits 1161 is formed in the slit-formed section 1115*c*. The slit 1161 penetrates the detection section 1115*b* in a thickness direction thereof, and has a circular shape in a cross-section perpendicular to the thickness direction. The slits 1161 are arranged in a lattice shape so that the slits 1161 can be distributed evenly in the zone from the upper end to the lower end of the left half of the detection section 1115*b* in FIG. 18. Light irradiated on the slit-formed section 1115*c* passes through the detection section 1115*b* via the slits 1161. These slits 1161 are formed such that the diameters of the slits 1161 are smaller than the diameter of the irradiation range 1142 of light, and that the distances between each slit 1161 are smaller than the diameter of the irradiation range 1142 on average.

The position of the irradiation range 1142 relative to the detection section 1115*b* changes in response to the amounts of ink 99 within the ink cartridge 1110, as described below. In the state of FIG. 18(*a*), the irradiation range 1142 is located in a region other than the slit-formed section 1115*c* in the detection section 1115*b*. In the state of FIG. 18(*b*), the irradiation range 1142 is located within the region of the slit-formed section 1115*c*. In the state of FIG. 18(*c*), the irradiation range 1142 is located outside the region of the detection section 1115*b*.

Figure 19:
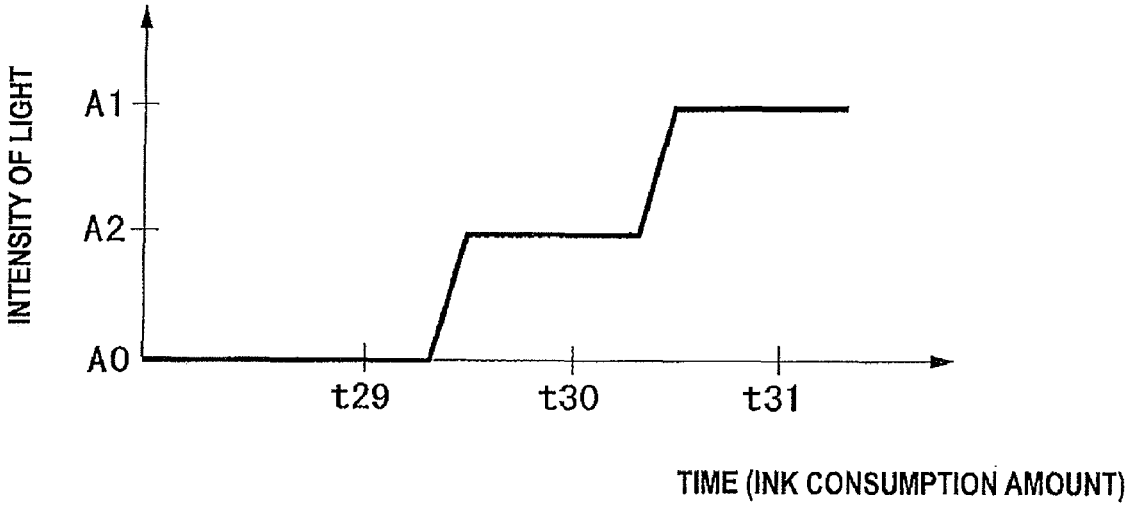
FIG. 19 A graph showing intensity of light that an optical sensor section detects in accordance with a decrease in the amounts of ink in the ink cartridge according to the eleventh embodiment.

FIG. 19 shows changes in the intensity of light received by the light receiving element 31*b* as the irradiation range of light changes from FIG. 18(*a*) to FIG. 18(*c*). The horizontal axis of FIG. 19 represents time (and the consumption amount of ink 99), whereas the vertical axis represents the intensity of light. Time t29-t31 correspond to time when the detection section 1115*b* is in the respective states of FIG. 18(*a*) through FIG. 18(*c*).

At t29, when the irradiation range 1142 is located in the region of the detection section 1115*b* other than the slit-formed section 1115*c*, light is blocked by the detection section 1115*b* and thus light received by the light receiving element 31*b* is A0. At t31, because light is received by the light receiving element 31*b* without passing through the detection section 1115*b*, the intensity of light received by the light receiving element 31*b* is A1. At t30, when the irradiation range 1142 is located within the range of the slit-formed section 1115*c*, light passes through the detection section 1115*b* via at least one of the slits 1161. On the other hand, because the slits 1161 are smaller than the irradiation range 1142, the irradiation range 1142 includes a region where the slits 1161 are not opened. Accordingly, part of light irradiated on the irradiation range 1142 is blocked by the region where the slits 1161 are not opened. Hence, intensity A2 of light received by the light receiving element 31*b* at t30 is greater than A0 at t29 and is smaller than A1 at t31.

As described above, according to the eleventh embodiment, the intensity of light received by the light receiving element 31*b* changes twice as the remaining amount of ink 99 becomes small. Hence, the remaining amount of ink 99 can be grasped in three stages by counting how many times the intensity of light has changed by the present time. Further, because the intensity of light changes in three stages of A0, A1, and A2, the remaining amount of ink 99 can be grasped in three stages by determining current intensity of light to be any one of A0-A2, without counting the number of changes in the intensity of light.

Figure 20:
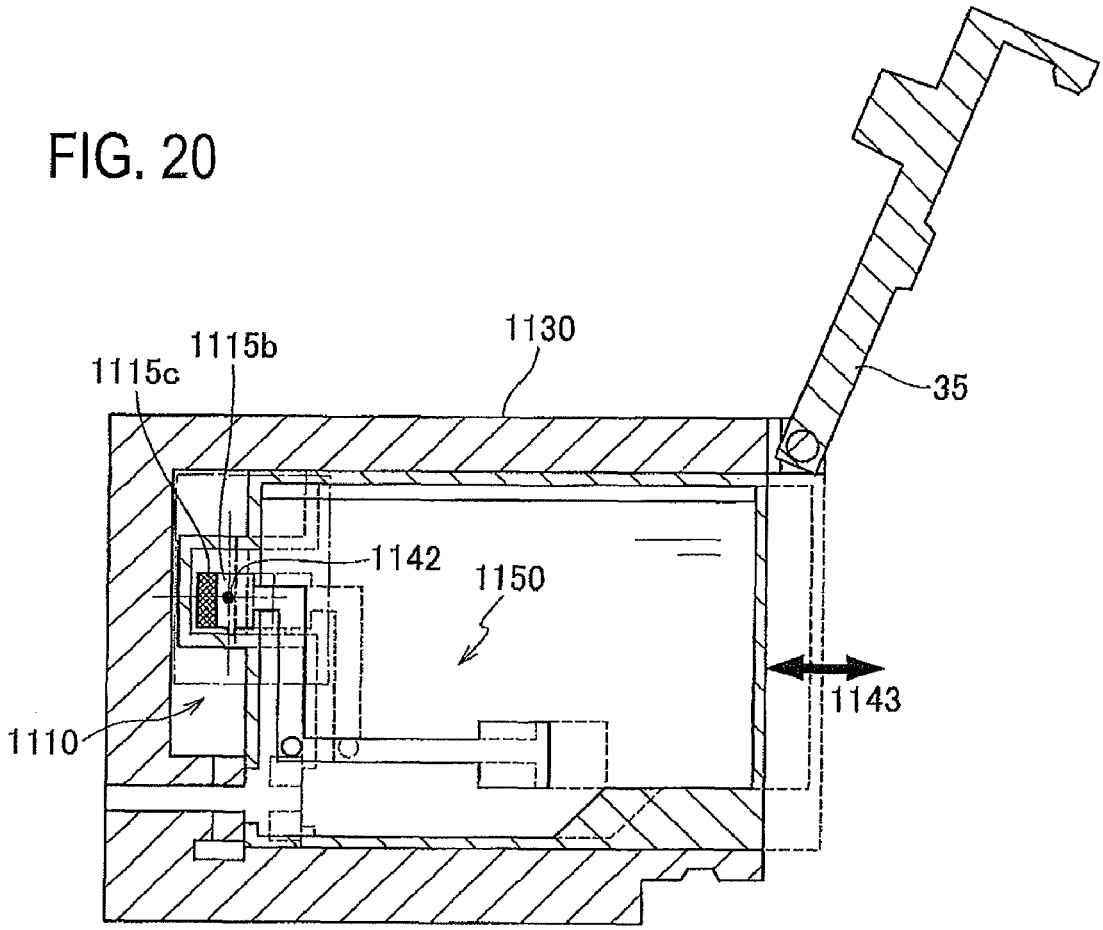
FIG. 20 A cross-sectional view showing a state in which the ink cartridge according to the eleventh embodiment is being mounted in or dismounted from the printer.
Figure 21A:
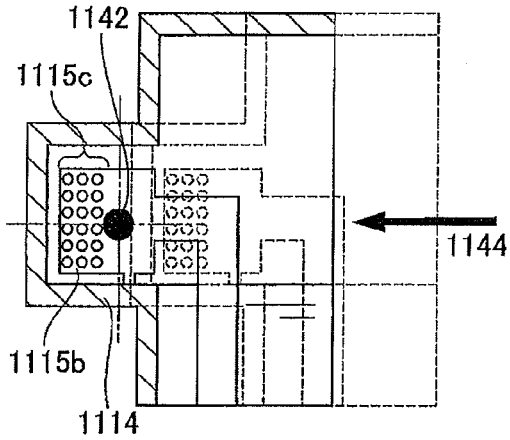
FIG. 21 Enlarged views of FIG. 20 showing states in which the ink cartridge according to the eleventh embodiment is being detached from/mounted in the printer in response to the amounts of ink remaining in the ink cartridge and corresponding graphs of intensity of light, wherein (a) is a view illustrating the position of the remaining-amount detecting member when the residual amount of ink is nearly at the maximum amount, (b) is a graph showing intensity of light that the optical sensor section of (a) detects, (c) is a view illustrating the position of the remaining-amount detecting member when the residual amount of ink becomes less than the state shown in (a), (d) is a graph showing intensity of light that the optical sensor section of (c) detects, (e) is a view illustrating the position of the remaining-amount detecting member when the residual amount of ink becomes even smaller, and (f) is a graph showing intensity of light that the optical sensor section of (e) detects.
Figure 21B:
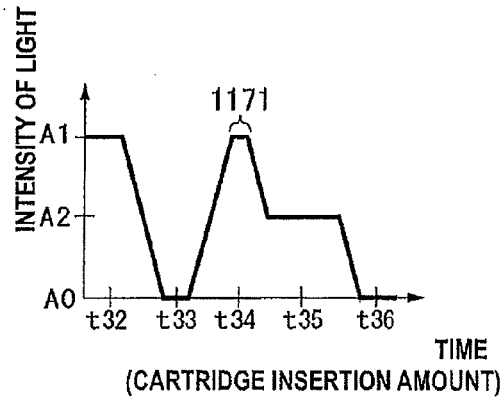
Figure 21C:
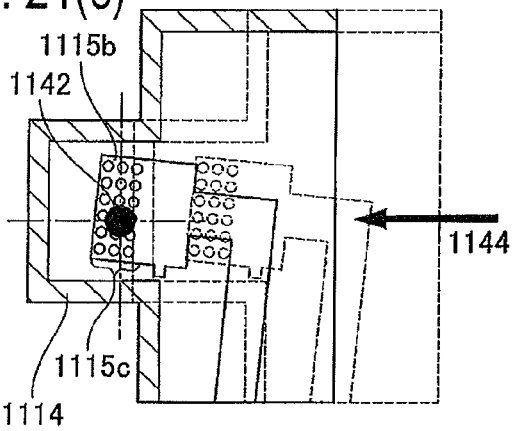
Figure 21D:
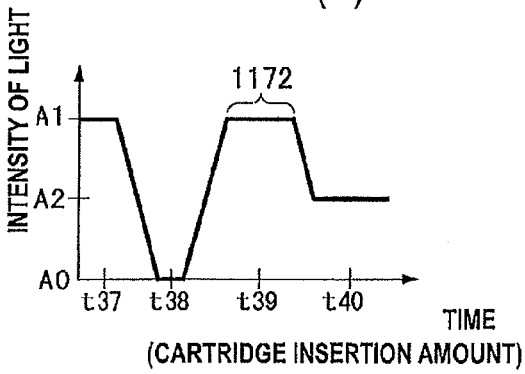
Figure 21E:
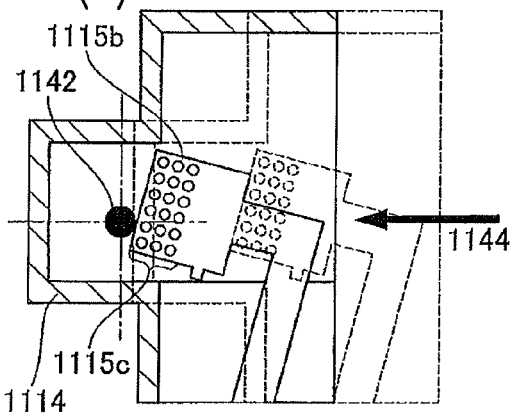
Figure 21F:
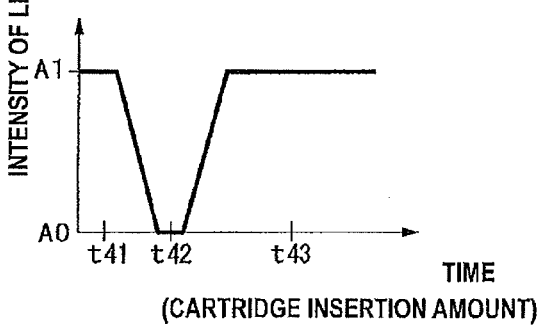

The eleventh embodiment shows a configuration that enables the remaining amount of ink 99 within the ink cartridge 1110 to be detected not only when the ink cartridge 1110 has been in the mounted attitude from the beginning of use up until present, but also when the ink cartridge 1110 is being mounted in or dismounted from the accommodating case 1130. FIG. 20 shows a state where the ink cartridge 1110 is being mounted in or dismounted from the accommodating case 1130. Broken lines represent the ink cartridge 1110 in a state where the ink cartridge 1110 is slid slightly to the right from the mounted attitude. When the ink cartridge 1110 is being mounted in or dismounted from the accommodating case 1130, the ink cartridge 1110 moves between the position indicated by the broken lines and the position in the mounted attitude. At this time, the irradiation range 1142 moves relative to the detection section 1115*b*, such that the irradiation range 1142 cuts the detection section 1115*b* in a direction parallel to a direction 1143, for example.

FIG. 21(*a*), FIG. 21(*c*), and FIG. 21(*e*) are enlarged views of a region enclosed by a single-dot chain line in FIG. 20. FIG. 21(*a*), FIG. 21(*c*), and FIG. 21(*e*) show respective states where the irradiation range 1142 moves relative to the detection section 1115*b* when the ink cartridges 1110 having a different residual amount of ink 99 are mounted in the accommodating case 1130 along a direction of an arrow 1144. The remaining amounts of ink 99 in FIG. 21(*a*), FIG. 21(*c*), and FIG. 21(*e*) respectively correspond to the remaining amounts of ink 99 in FIG. 18(*a*) through FIG. 18(*c*). In FIG. 21(*a*), FIG. 21(*c*), and FIG. 21(*e*), solid lines show the ink cartridge 1110 in the mounted attitude, while broken lines show the ink cartridge 1110 immediately before the ink cartridge 1110 takes the mounted attitude. Further, FIG. 21(*b*), FIG. 21(*d*), and FIG. 21(*f*) are graphs that represent changes in the intensity of light received by the light receiving element 31*b*, when the irradiation range 1142 moves relative to the detection section 1115*b* as shown in FIG. 21(*a*), FIG. 21(*c*), and FIG. 21(*e*), respectively.

In case of FIG. 21(*a*), the intensity of light received by the light receiving element 31*b* changes as shown in FIG. 21(*b*). First, prior to a state shown by the broken lines in FIG. 21(*a*), light from the light emitting element 31*a* is received by the light receiving element 31*b* without being blocked. At this time, the intensity of light is A1 (t32). Next, as the irradiation range 1142 reaches the casing 1114 of the ink cartridge 1110, the light path is blocked by the casing 1114. At this time, the intensity of light is A0 (t33). Next, when the irradiation range 1142 finishes passing through the casing 1114, the light path is formed in a space between the casing 1114 and the detection section 1115*b*, and thus the intensity of light becomes A1 (t34). Next, the irradiation range 1142 is located at the slit-formed section 1115*c* of the detection section 1115*b*, the intensity of light becomes A2 (t35). Then, in the mounted attitude shown by the solid lines in FIG. 21(*a*), because the irradiation range 1142 is completely blocked by the detection section 1115*b*, the intensity of light becomes A0 (t36).

In case of FIG. 21(*c*), the intensity of light received by the light receiving element 31*b* changes as shown in FIG. 21(*d*). First, prior to a state shown by the broken lines in FIG. 21(*c*), light from the light emitting element 31*a* is received by the light receiving element 31*b* without being blocked. At this time, the intensity of light is A1 (t37). Next, as the irradiation range 1142 reaches the casing 1114 of the ink cartridge 1110, the light path is blocked by the casing 1114. At this time, the intensity of light is A0 (t38). Next, when the irradiation range 1142 finishes passing through the casing 1114, the light path is formed in the space between the casing 1114 and the detection section 1115*b*, and thus the intensity of light becomes A1 (t39). Next, the irradiation range 1142 is located at the slit-formed section 1115*c* of the detection section 1115*b*, the intensity of light becomes A2 (t40). Here, as shown by the solid lines in FIG. 21(*c*), when the ink cartridge 1110 is inserted and takes the mounted attitude, the irradiation range 1142 is located within the region of the slit-formed section 1115*c*. Accordingly, the intensity of light is A2 at t40 and thereafter.

In case of FIG. 21(*e*), the intensity of light received by the light receiving element 31*b* changes as shown in FIG. 21(*f*). First, prior to a state shown by the broken lines in FIG. 21(*e*), light from the light emitting element 31*a* is received by the light receiving element 31*b* without being blocked. At this time, the intensity of light is A1 (t41). Next, as the irradiation range 1142 reaches the casing 1114 of the ink cartridge 1110, the light path is blocked by the casing 1114. At this time, the intensity of light is A0 (t42). Next, when the irradiation range 1142 finishes passing through the casing 1114, the light path is formed in the space between the casing 1114 and the detection section 1115*b*, and thus the intensity of light becomes A1 (t43). Here, as shown by the solid lines in FIG. 21(*e*), when the ink cartridge 1110 is inserted and takes the mounted attitude, the irradiation range 1142 is located between the detection section 1115*b* and the casing 1114. Accordingly, the intensity of light is A1 at t43 and thereafter.

As described above, in the eleventh embodiment, when the ink cartridge 1110 is being mounted in the accommodating case 1130, the pattern of change in the intensity of light received by the light receiving element 31*b* differs depending on the amount of ink 99 left in the mounted ink cartridge 1110. The control section 22 acquires the remaining amount of ink 99 within the ink cartridge 1110 based on signals from the light receiving element 31*b*, when the ink cartridge 1110 is being mounted in the accommodating case 1130. Specifically, for example, a memory included in the control section 22 stores the patterns of change in the intensity of light shown in FIG. 21(*b*), FIG. 21(*d*), and FIG. 21(*f*), in association with the remaining amount of ink 99 corresponding to each pattern of change. The control section 22 determines which pattern of change stored in the memory corresponds to the pattern of change in the light intensity indicated by the signals from the light receiving element 31*b*, and acquires the remaining amount of ink 99 from the determination results. Then, the control section 22 notifies the user of the acquired remaining amount of ink 99 via the notifying section 29. For example, when the remaining amount of ink 99 is smaller than a predetermined value, the user may be warned that the remaining amount of ink 99 is small via the notifying section 29.

Note that, in the eleventh embodiment, the remaining amount of ink 99 can be detected in at least three stages at the time of mounting of the ink cartridge 1110, as shown in FIG. 21. However, the remaining amount of ink 99 can be obtained in more than or equal to four stages. For example, as shown in FIGS. 21(*a*) and 21(*c*), the separation distance between the detection section 1115*b* and the casing 1114 is different depending on the remaining amount of ink 99. Thus, as shown in FIGS. 21(*b*) and 21(*d*), lengths of a time period 1171 and a time period 1172 during which the intensity of light is A1 are different from each other. Based on this information, the remaining amount of ink 99 can be grasped in more than or equal to four stages in total, by determining that the remaining amount of ink 99 becomes smaller as the time period 1172 is longer.

The above description shows the case in which the remaining amount of ink 99 is acquired when the ink cartridge 1110 is being mounted. However, the remaining amount of ink 99 can also be grasped when the ink cartridge 1110 is being dismounted from the accommodating case 1130. When the ink cartridge 1110 is being dismounted from the accommodating case 1130, the changing patterns of the intensity of light received by the light receiving element 31*b* can be obtained by temporally-reversing the patterns of change shown in FIG. 21(*b*) or the like. Accordingly, by comparing the patterns of change obtained by reversing those shown in FIG. 21(*b*) and the like with the actual patterns of change in the intensity of light received by the light receiving element 31*b*, the remaining amount of ink 99 can also be obtained when the ink cartridge 1110 is being dismounted from the accommodating case 1130.

Twelfth Embodiment

Figure 22:
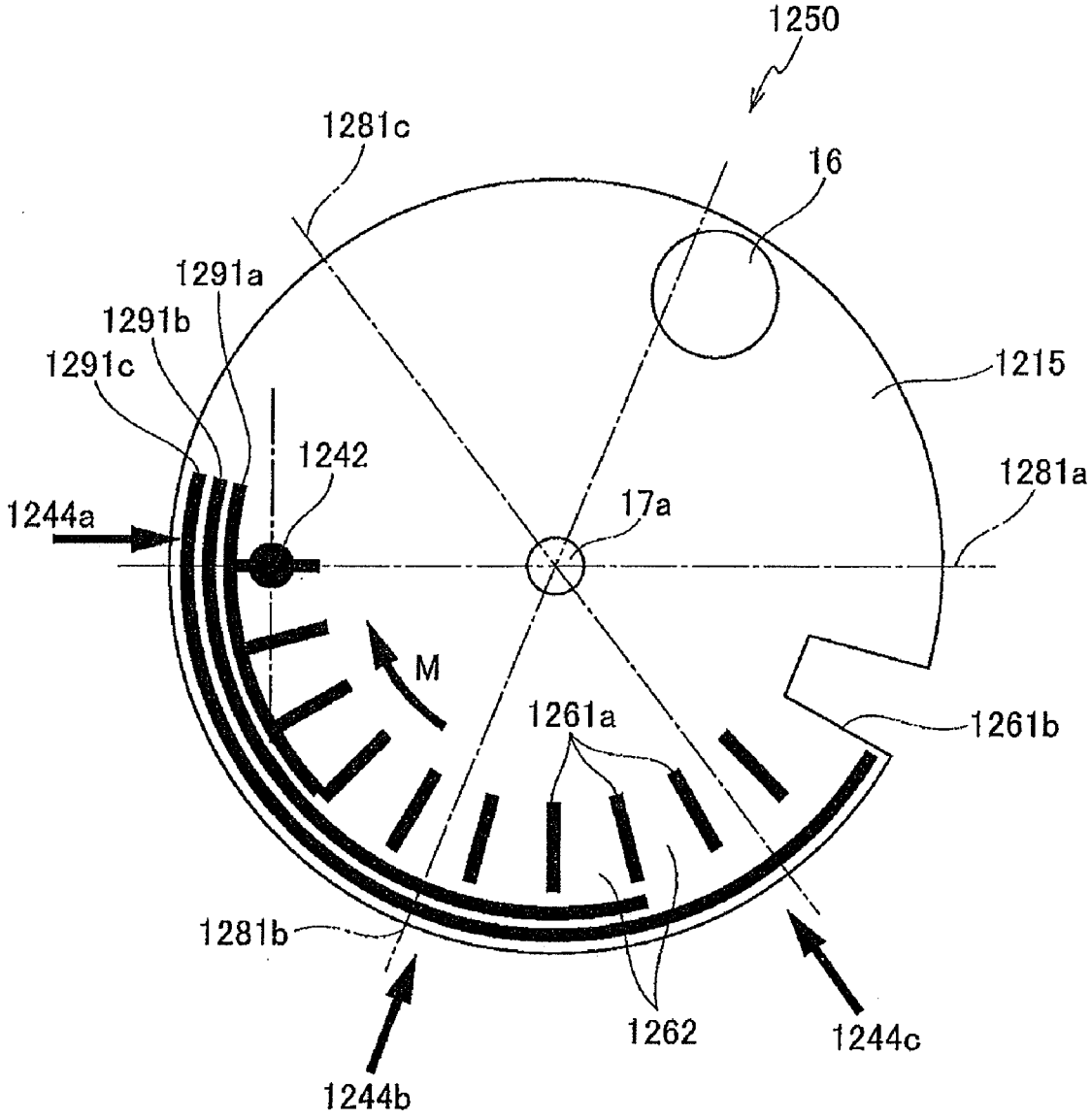
FIG. 22 An elevation view of a remaining-amount detecting member in an ink cartridge according to a twelfth embodiment.

In a twelfth embodiment, as in the eleventh embodiment, the remaining amount of ink 99 within an ink cartridge can be acquired not only while the ink cartridge is being used (in a case where the ink cartridge has been in the mounted attitude since the beginning of use), but also when the ink cartridge is being mounted in and dismounted from the accommodating case. FIG. 22 shows a remaining-amount detecting member 1250 according to the twelfth embodiment.

The remaining-amount detecting member 1250 includes a detection member 1215 and the float member 16. The detection member 1215 has a substantially disk shape. The float member 16 is fixed to a position vicinity of the circumference of the disk of the detection member 1215.

The detection member 1215 is formed with a plurality of slits 1261. These slits 1261 are arranged at equal intervals in the circumferential direction of the detection member 1215. A slit 1261*b* of the slits 1261 closest to the float member 16 in the circumferential direction of the detection member 1215 is formed such that the slit 1261*b* has a width larger than that of other slits 1261*a* in the circumferential direction. On the other hand, the widths of the slits 1261*a* in the circumferential direction are equal to one another. Further, each of the slits 1261*a* has a length identical to each other and extends from the vicinity of the circumference of the detection member 1215 toward its center. Light blocking sections 1262 are formed between the slits 1261.

The detection member 1215 is formed with slits 1291*a* through 1291*c* extending along the circumferential direction, in addition to the slits 1261. Each of the slits 1291*a* through 1291*c* is formed in a region between the slits 1261*a* and the circumference of the detection member 1215. Of these, the slit 1291*c* is closest to the circumference of the detection member 1215, whereas the slit 1291*a* is farthest from the circumference of the detection member 1215. Each of one ends of the slits 1291*a* through 1291*c* is arranged at a position slightly closer to the float member 16 than the slit 1261*a* farthest from the slit 1261*b* in the circumferential direction. The other ends of the slits 1291*a* through 1291*c* are arranged at positions different from one another. The other end of the slit 1291*a* is farthest from the slit 1261*b* in the circumferential direction, whereas the other end of the slit 1291*c* is closest to the slit 1261*b*.

Having the above-described slits 1261, the remaining-amount detecting member 1250 can acquire the remaining amount of ink 99 while the ink cartridge is used. Further, the remaining-amount detecting member 1250 can also acquire the remaining amount of ink 99 when the ink cartridge is being mounted in and dismounted from the accommodating case, as described below.

FIG. 22 shows a detection position 1242 in a case where the amount of ink 99 is nearly at the maximum amount. When the ink cartridge is being mounted in the accommodating case in this state, the detection position 1242 moves relative to the remaining-amount detecting member 1250 in a direction of an arrow 1244*a* along a single-dot chain line 1281*a*. Accordingly, by the time the ink cartridge is mounted, the slits 1291*a* through 1291*c* have passed through the detection position 1242. That is, when the remaining amount of ink 99 is close to the maximum amount, the optical sensor section 31 detects that all of the slits 1291*a* through 1291*c* have passed through the detection position 1242.

As the remaining amount of ink 99 decreases, the remaining-amount detecting member 1250 rotates within the ink cartridge in a direction M. Assume that the remaining amount of ink 99 has decreased to m1 (not shown) which is smaller than the maximum amount, and that the remaining-amount detecting member 1250 has rotated from a position shown in FIG. 22 to a position where a single-dot chain line 1281*b* overlaps with the single-dot chain line 1281*a*. In such a state, when the ink cartridge is mounted in the accommodating case, the detection position 1242 relatively moves in a direction of an arrow 1244*b* along the single-dot chain line 1281*b*. Accordingly, by the time the ink cartridge is mounted, the slit 1291*b* and the slit 1291*c* have passed through the detection position 1242. That is, when the remaining amount of ink 99 is m1, the optical sensor section 31 detects that two of the slits 1291*a* through 1291*c* have passed through the detection position 1242.

Assume that the remaining amount of ink 99 has further decreased from m1 to become m2 (not shown) which is smaller than m1, and that the remaining-amount detecting member 1250 has rotated to a position where a single-dot chain line 1281*c* overlaps with the single-dot chain line 1281*a*. In such a state, when the ink cartridge is mounted in the accommodating case, the detection position 1242 relatively moves in a direction of an arrow 1244*c* along the single-dot chain line 1281*c*. Accordingly, by the time the ink cartridge is mounted, only the slit 1291*c* has passed through the detection position 1242. That is, when the remaining amount of ink 99 is m2, the optical sensor section 31 detects that one of the slits 1291*a* through 1291*c* has passed through the detection position 1242.

As described above, according to the twelfth embodiment, acquiring how many of the slits 1291*a* through 1291*c* has passed through the detection position 1242 via the optical sensor section 31 enables the remaining amount of ink 99 to be detected in three stages when the ink cartridge having the remaining-amount detecting member 1250 is being mounted in and dismounted from the accommodating case.

Thirteenth Embodiment

Figure 23:
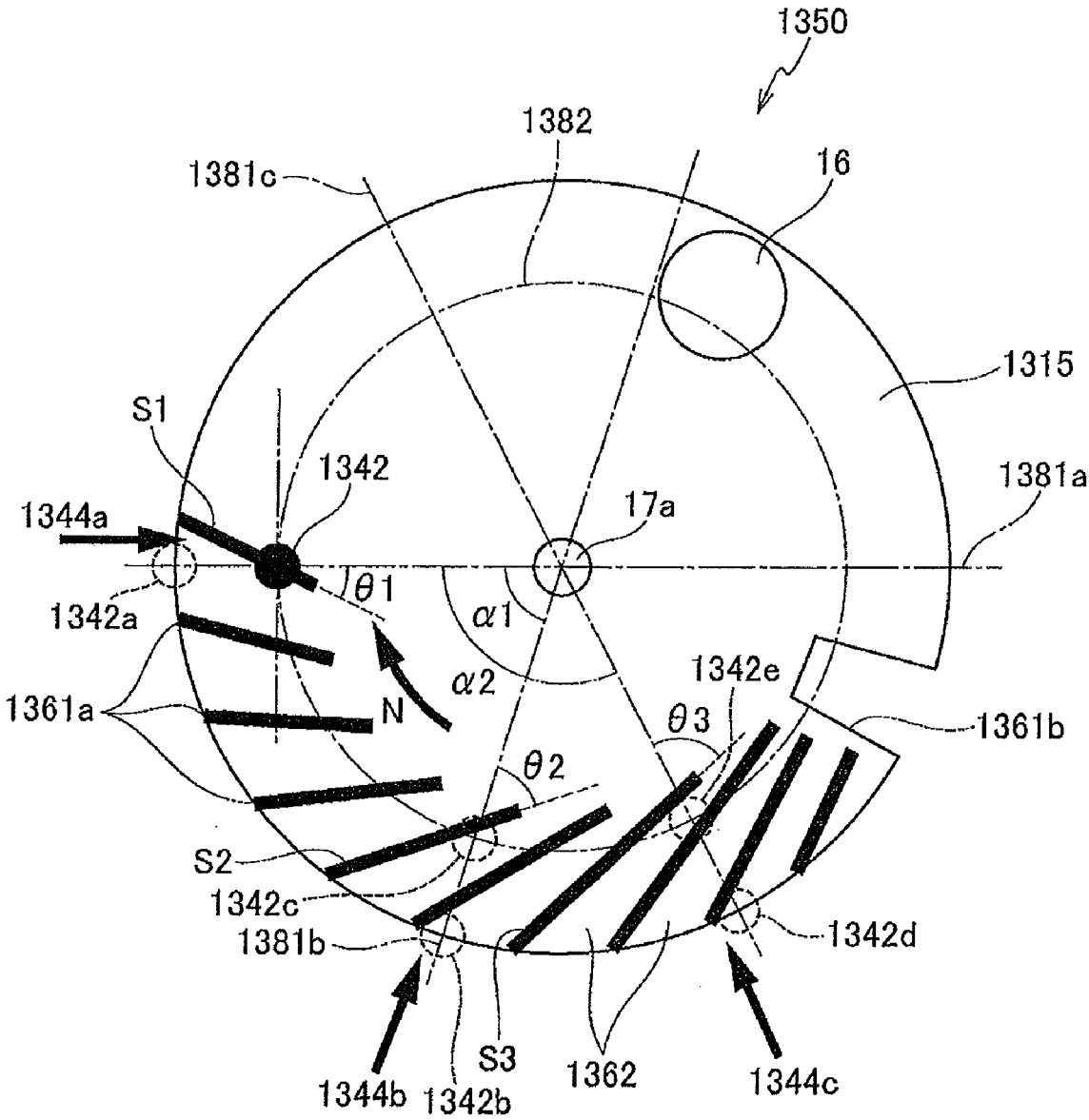
FIG. 23 An elevation view of a remaining-amount detecting member in an ink cartridge according to a thirteenth embodiment.

In a thirteenth embodiment, like the twelfth embodiment, the remaining amount of ink 99 within the ink cartridge can be acquired both while the ink cartridge being is used and when the ink cartridge is being mounted in and dismounted from the accommodating case. FIG. 23 shows a remaining-amount detecting member 1350 according to the thirteenth embodiment.

The remaining-amount detecting member 1350 includes a detection member 1315 and the float member 16. The detection member 1315 is formed with a plurality of slits 1361*a* and a slit 1361*b*. The remaining-amount detecting member 1350 corresponds to the remaining-amount detecting member 1250 of the twelfth embodiment, but slits 1361*a* are formed instead of the slits 1261*a* and the slit slits 1291*a* through 1291*c*. Light blocking sections 1362 are formed between the slits 1361.

One ends of the slits 1361*a* are each arranged on the circumference of the detection member 1315. The slits 1361*a* are formed such that each slit 1361*a* extends linearly from the one end in a direction away from the circumference of the detection member 1315. The other ends of the slits 1361*a* are respectively arranged inside a circle 1382 and adjacent to the circle 1382, the circle 1382 being concentric with the detection member 1315 and being smaller than the detection member 1315. The slits 1361*a* are formed such that acute angles formed between each slit 1361*a* and the radial direction of the detection member 1315 are made to be greater as the slit 1361*a* is located closer to the slit 1361*b*. For example, among slits s1-s3, the slit s1 is farthest from the slit 1361*b*, whereas the slit s3 is closest to the slit 1361*b*. Further, among the acute angles θ1-θ3 formed between the slits s1-s3 and the radial direction, the acute angle θ1 of the slit s1 farthest from the slit 1361*b* is the smallest, whereas the acute angle θ3 of the slit s3 closest to the slit 1361*b* is the largest.

Here, assume that an imaginary line 1381*a* and a plurality of imaginary lines are drawn, the imaginary line 1381*a* passing through the slit s1 and the center of the detection member 1315, the plurality of imaginary lines being obtained by rotating the imaginary line 1381*a* about the center of the detection member 1315 in the counterclockwise direction of FIG. 23 (For example, imaginary lines 1381*b* and 1381*c* correspond to these imaginary lines). At this time, the slits 1361*a* are formed in the detection member 1315 such that the slits 1361*a* further satisfy the following Condition 1 and Condition 2.

(Condition 1) The slits 1361*a* are formed such that the number of the slits 1361*a* intersected by the above-described imaginary line at a region outside the circumference of the circle 1382 changes depending on rotational angles from the imaginary line 1381*a*. The reason why the number of the slits 1361*a* located only at the outer circumferential region is counted is that, this is the region that passes through a detection position 1342 when the ink cartridge is being mounted or dismounted.

For example, the number of the slits 1361*a* intersected by the imaginary line 1381*a* at the outer circumferential region of the circle 1382 is one. The number of the slits 1361*a* intersected by the imaginary line 1381*b* at the outer circumferential region of the circle 1382 is two, the imaginary line 1381*b* being obtained by rotating the imaginary line 1381*a* by an angle α1. The number of the slits 1361*a* intersected by the imaginary line 1381*c* at the outer circumferential region of the circle 1382 is three, the imaginary line 1381*c* being obtained by rotating the imaginary line 1381*a* by an angle α2 (>α1).

(Condition 2) The number of the slits 1361*a* intersected by a certain imaginary line at the outer circumferential region of the circle 1382 is greater than or equal to the number of the slits 1361*a* intersected by any other imaginary line at the outer circumferential region of the circle 1382, the any other imaginary line being obtained by rotating the imaginary line 1381*a* by an angle smaller than the rotational angle of the certain imaginary line from the imaginary line 1381*a*. That is, the slits 1361*a* are formed such that the number of the slits 1361*a* intersected by an imaginary line at the outer circumferential region of the circle 1382 increases in a stepwise manner, as the rotational angle from the imaginary line 1381*a* increases.

The above-described Condition 1 and Condition 2 will be described more specifically with reference to FIG. 23. In the remaining-amount detecting member 1350 of FIG. 23, when the number of the slits 1361*a* intersected by an imaginary line is one, the slits 1361*a* are arranged as described below. For example, if the remaining-amount detecting member 1350 rotates slightly in a direction N, and the slit S1 has therefore moved away from the detection position 1342 of FIG. 23 and can no longer be detected, another slit 1361*a* adjacent to the slit S1 in a direction opposite to the direction N may be arranged such that the outer-circumferential-side end thereof can be located within the detectable area of the detection position 1342 which has moved relatively.

Similarly, if the number of the slits 1361*a* intersected by an imaginary line is two or more, the number of the slits 1361*a* intersected by the imaginary line at the outer circumferential region of the circle 1382 can be configured to increase in a stepwise manner in the remaining-amount detecting member 1350 of FIG. 23, in consideration of the positional relationship between each slit 1361*a* and each imaginary line together with the number of the intersected slits.

Having the slits 1361*a* formed as described above, the remaining amount of ink 99 can be obtained by the remaining-amount detecting member 1350 when the ink cartridge is being mounted in the accommodating case.

FIG. 23 shows the detection position 1342 in a case where the remaining amount of ink 99 is close to the maximum amount. When the ink cartridge including the remaining-amount detecting member 1350 therein is being mounted in the accommodating case, the detection position 1342 moves relative to the detection member 1315 in a direction of an arrow 1344*a* along the imaginary line 1381*a*. In this case, the detection position 1342 moves relative to the remaining-amount detecting member 1350 from a detection position 1342*a* to the detection position 1342. Hence, the number of the slits 1361*a* detected by the optical sensor section 31 (corresponding to the slit s1) is one, when the remaining amount of ink 99 is close to the maximum amount.

Next, when the ink 99 decreases from the state of FIG. 23, the remaining-amount detecting member 1350 is in a position rotated in the direction N. When this ink cartridge is mounted in the accommodating case, the detection position 1342 moves along one of imaginary lines X which is rotated about the center of the detection member 1315 from the imaginary line 1381*a*. For example, the detection position 1342 moves in a direction of an arrow 1344*b* along the imaginary line 1381*b*. At this time, the number of slits 1361*a* detected by the optical sensor section 31 at the detection position 1342 is equal to the number of the slits 1361*a* intersected by the imaginary line X at the region outside of the circumference of the circle 1382. On the other hand, the slits 1361*a* are formed so as to satisfy the above-described Condition 1 and Condition 2. Thus, as the number of the slits 1361*a* intersected by the imaginary line X at the outer circumferential region of the circle 1382 increases, the remaining-amount detecting member 1350 is moved to a position rotated by a larger angle from the state of FIG. 23. That is, the remaining amount of ink 99 is determined to be smaller, as the number of slits 1361*a* detected by the optical sensor section 31 at the detection position 1342 is larger.

For example, when the detection position 1342 moves along the imaginary line 1381*b*, the detection position 1342 moves relative to the remaining-amount detecting member 1350 from a detection position 1342*b* to a detection position 1342*c*. Hence, the optical sensor section 31 detects two slits 1361*a*. When the detection position 1342 moves along the imaginary line 1381*c*, the detection position 1342 moves relative to the remaining-amount detecting member 1350 from a detection position 1342*d* to a detection position 1342*e*. Hence, the optical sensor section 31 detects three slits 1361*a*. Accordingly, the remaining amount of ink 99 is determined to be smaller in the latter case than in the former case.

Further, if the ink cartridge having the remaining-amount detecting member 1350 is in use, as the ink 99 decreases, the detection position 1342 moves relative to the detection member 1315 along the circle 1382 in a direction opposite the direction N. Accordingly, the slits 1361*a* and the light blocking sections 1362 are detected alternately at the detection position 1342. Hence, the remaining-amount detecting member 1350 can also detect the remaining amount of ink 99 in multiple stages, during use of the ink cartridge.

As described above, according to the thirteenth embodiment, the remaining-amount detecting member 1350 is configured such that the number of the slits 1361*a* detected at the detection position 1342 during detachment of the ink cartridge increases as ink decreases. Specifically, as ink decreases, the number of the detected slits 1361*a* changes like (1) one→(2) two→(3) three. However, the remaining-amount detecting member may be configured such that the number of the detected slits 1361*a* temporarily decreases as ink decreases. For example, the remaining-amount detecting member 1350 may be configured such that the number of the detected slits 1361*a* changes like (1) one→(2) zero→(3) one→(4) two→(5) one (6) two→(7) three, as ink decreases. In this case as well, if the number of the detected slits 1361*a* is zero, for example, the remaining amount of ink is determined to be at least greater than the state of (3) or later. If the number of the detected slits 1361*a* is three, the remaining amount of ink is known to be small.

Fourteenth Embodiment

Figure 24:
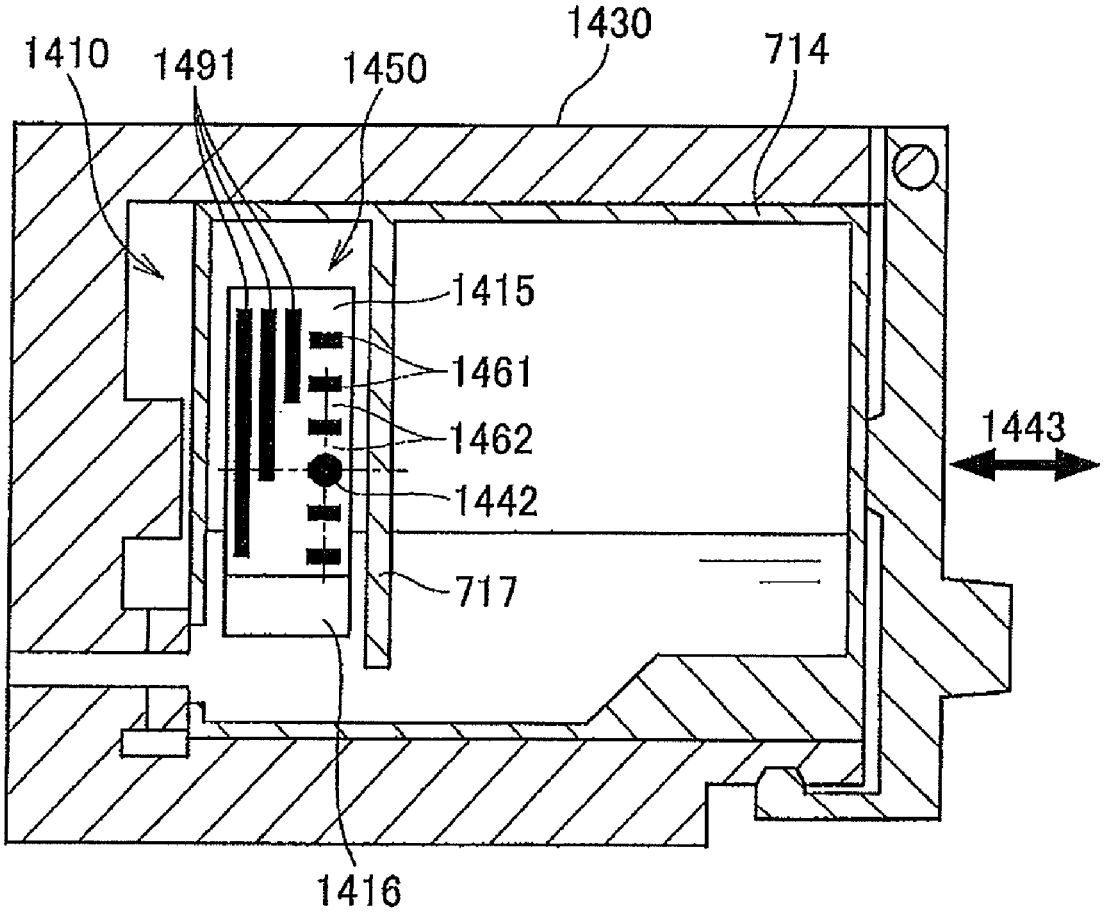
FIG. 24 A cross-sectional view showing a detailed configuration around an ink cartridge according to a fourteenth embodiment mounted in the printer of FIG. 1.

FIG. 24 is a view showing an ink cartridge 1410 and an accommodating case 1430 according to a fourteenth embodiment. In the fourteenth embodiment, the remaining-amount detecting member 750 of the seventh embodiment is replaced by a remaining-amount detecting member 1450.

The remaining-amount detecting member 1450 includes a detection member 1415 and a float member 1416 fixed to a lower end of the detection member 1415. The detection member 1415 is formed with slits 1461 and slits 1491. The slits 1461 are arranged in the up-down direction, and light blocking sections 1462 are formed between each slit 1461. The slits 1461 and the light blocking sections 1462 in the fourteenth embodiment correspond to the slits 761 and the light blocking sections 762 in the seventh embodiment. Accordingly, the ink cartridge 1410 can acquire residual amounts of ink 99 while being in use.

The slits 1491 include three slits extending along the up-down direction. Each upper end of these slits is arranged at a position the same with each other with respect to the up-down direction and at a position close to the upper end of the detection member 1415, whereas each lower end is arranged at positions different from each other in the up-down direction. Thus, when the ink cartridge 1410 is being mounted in or dismounted from the accommodating case 1430, the number of the slits 1491 through which a detection position 1442 passes in a direction 1443 changes in response to the remaining amount of ink 99 within the ink cartridge 1410 in a stepwise manner. Accordingly, the remaining amount of ink 99 can be grasped when the ink cartridge 1410 is being mounted in the accommodating case 1430.

<Relationship Between Inventions and Embodiments in this Application>

The inventions embodied in the above-described first through fourteenth embodiments are as follows.

An ink cartridge according to a first invention includes a float member, a detection member that moves in conjunction with the float member, and restricting portion. When the float member and the detection member move by following the liquid surface of ink 99 within the ink accommodating chamber, the restricting portion restricts the movement of the float member and the detection member to a predetermined path. Further, a part of the casing of the ink cartridge has light transmissive characteristics. Through this part having light transmissive characteristics, light coming from outside of the ink cartridge is outputted to outside via a predetermined detection position. Then, when the detection member moves along the above-described predetermined path, a light transmission section (slit) and first and second light blocking sections pass through the above-described detection position in the order of the first light blocking section, the light transmission section, and the second light blocking section, wherein the light transmission section (slit) is provided in the detection member, and the first and second light blocking sections are provided at positions with the light transmission section of the detection member interposed therebetween.

The first invention is embodied in each of the first through fourteenth embodiments. For example, in the sixth embodiment, the first and second light blocking sections correspond to the light blocking sections 662*a* and 662*b*, respectively. The light transmission section corresponds to the slit 661. The restricting member 17 (the pivot shaft 17*a* and the bearing 17*b*) restricts the movement of the detection member 615 (and the float member 16) such that the detection member 615 (and the float member 16) pivotally moves about the pivot shaft 17*a*. When the detection member 615 pivotally moves, the light blocking section 662*a*, the slit 661, and the light blocking section 662*b* pass through the detection position 642 sequentially.

In the seventh embodiment, the light transmission section corresponds to the slits 761. The first and second light blocking sections correspond to the pair of light blocking sections 762 with the slit 761 interposed therebetween. The restricting portion 717 restricts the movement of the detection member 715 (and the float member 716) such that the detection member 715 (and the float member 716) moves in the up-down direction between the restricting member 717 and the casing 714. When the detection member 715 moves down, one of the above-described pair of light blocking sections 762, the slit 761 interposed between the pair of light blocking sections 762, and the other one of the pair of light blocking sections 762 sequentially pass through the detection position 742.

An ink cartridge according to a second invention includes a float member, a detection member that moves in conjunction with the float member, and restricting portion. When the float member and the detection member move by following the liquid surface of ink 99 within the ink accommodating chamber, the restricting portion restricts the movement of the float member and the detection member to a predetermined path. A part of the detection member is located above the liquid surface of ink 99 when ink is accommodated within the ink accommodating chamber to a predetermined maximum amount. Further, a part of the casing of the ink cartridge has light transmissive characteristics. When the ink cartridge is in the mounted attitude, light from outside the ink cartridge is outputted to outside via a predetermined detection position through the part of the casing having light transmissive characteristics, without passing through the ink 99 accommodated to the predetermined maximum amount. When the detection member moves along the above-described predetermined path, the detection member passes through the above-described detection position.

The second invention is embodied in the ninth embodiment. FIG. 15 shows the ninth embodiment and shows the state where the ink 99 is accommodated within the ink accommodating chamber 914*c* to the maximum amount. The positions of the optical sensor section 931 (the light emitting element 931*a* and the light receiving element 931*b*) and the detection windows 911*a* and 911*b* are adjusted so that the detection position 942 can be located above the liquid surface of ink 99 at this time.

Further, in each of the first through sixth, eighth, and tenth through thirteenth embodiments, the restricting portion restricts the movement of the detection member such that the detection member pivotally moves about the pivot shaft and passes through the detection position. In this way, in the embodiments where the detection member is configured to pivotally move to pass through the detection position, the detection member can be made to pass through the detection position if the detection position is provided above the liquid surface of ink 99 when the ink 99 is fully accommodated within the ink accommodating chamber. For example, in the eleventh embodiment, the detection windows are formed in the upper portion of the casing 1114 and the optical sensor section 31 of the accommodating case 1130 is provided at the position of the detection window, thereby allowing the detection position 1142 to be provided above. The second invention is embodied in the eleventh embodiment by providing the pivot shaft 17*a* above that of FIG. 17, and by adjusting the moving path of the detection member 1115 so that the detection member 1115 can pass through the upper detection position 1142.

Further, the remaining-amount detecting member 950 of the ninth embodiment embodies the second invention by moving the fixing position of the float member 16 in the remaining-amount detecting member 350 of the third embodiment to the position near the slit. Accordingly, in embodiments where a disk-shaped detection member such as the remaining-amount detecting member 350 is used, the second invention can be embodied by adjusting the fixing position of the float member, as described above.

<Other Modifications etc.>

A liquid cartridge and a recording system according to the present invention are not limited to the above-described embodiments, and various modifications and improvements can be made therein without departing from the scope of the claims. For example, the above-described embodiments employ such a configuration that a detection member and a float member are fixed integrally. However, these need not be fixed integrally if the detection member is configured to be able to move in conjunction with the movement of the float member. For example, the float member and the detection member are separate members, and the float member is in contact with the detection member. The float member moves to push the detection member in response to the movement of the float member as the ink 99 decreases, thereby making the detection member move along the predetermined path.

Figure 25A:
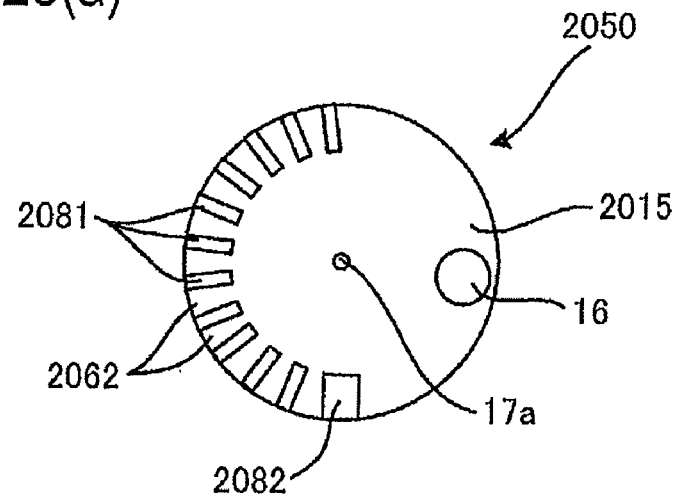
FIG. 25 Views illustrating a variation of the first through fourteenth embodiments, wherein (a) is an elevation view of a remaining-amount detecting member, (b) is a view showing light emitted from a light emitting element shown in a cross-sectional view in which a detailed configuration around the ink cartridge according to the present variation mounted in the printer of FIG. 1, and (c) is a view showing light detected by a light receiving element in the cross-sectional view of (b).
Figure 25B:
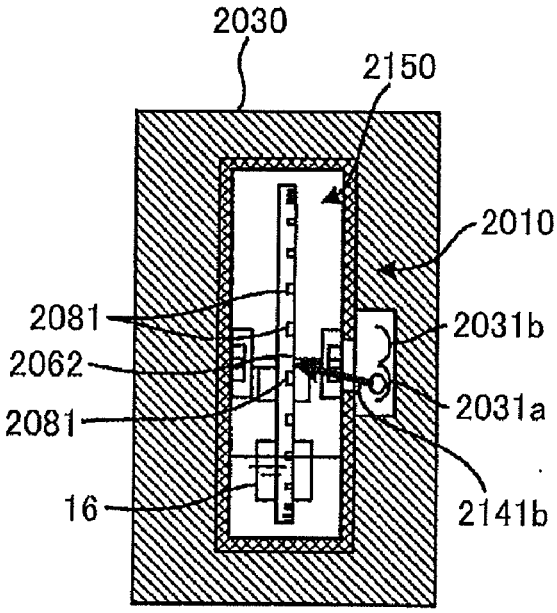
Figure 25C:
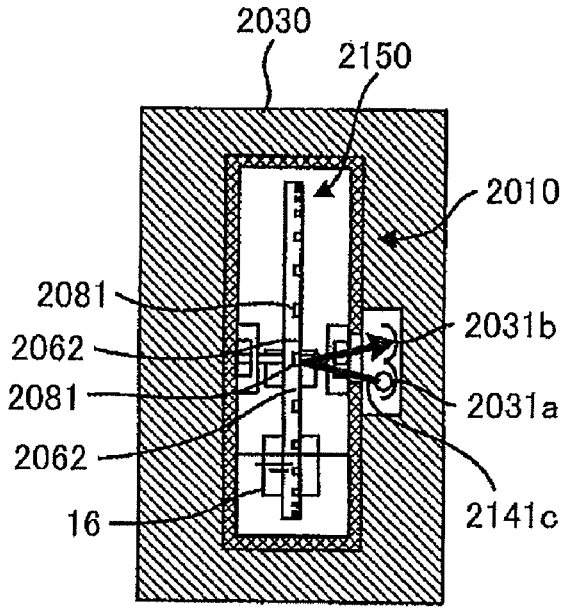

Further, the above-described embodiments have such a configuration that the detection member blocks light, thereby decreasing the intensity of light received by the light receiving element 31*b*. However, residual amounts of ink 99 may be detected in such a configuration that the detection member reflects light from a light emitting element, and that a light receiving element detects the reflected light. For example, FIG. 25 shows an embodiment with such a configuration. FIG. 25(*a*) shows a remaining-amount detecting member 2050 including a detection member 2015 and the float member 16. In the detection member 2015, light reflecting sections 2081 and 2082 that reflect light are formed, instead of slits. The light reflecting sections 2081 and 2082 are formed in regions corresponding to the slits 361*a* and 361*b* formed in the detection member 315 of the third embodiment. The light reflecting sections 2081 and 2082 correspond to the slits 361*a* and 361*b*, respectively. Further, light blocking sections 2062 are formed between the light reflecting sections 2081 and 2082.

FIGS. 25(*b*) and 25(*c*) show an ink cartridge 2010 having the remaining-amount detecting member 2050 shown in FIG. 25(*a*) and an accommodating case 2030. A light emitting element 2031*a* and a light receiving element 2031*b* are provided to the accommodating case 2030. The angles formed between the light emitting element 2031*a* and the light receiving element 2031*b* are adjusted so that light from the light emitting element 2031*a* is reflected by the surface of the detection member 2015, and that the reflected light is received by the light receiving element 2031*b*. Thus, as shown in FIG. 25(*c*), when light 2141*c* from the light emitting element 2031*a* reaches the light reflecting section 2081 or 2082, the reflected light reflected by the light reflecting section 2081 or the like reaches the light receiving element 2031*b*. In contrast, as shown in FIG. 25(*b*), when light 2141*b* from the light emitting element 2031*a* reaches the light blocking section 2062, the reflected light does not reach the light receiving element 2031*b* because the light is blocked by the light blocking section 2062.

In other words, the intensity of light received by the light receiving element 2031*b* when the light reflecting section 2081 or 2082 is located at the detection position at which light from the light emitting element 2031*a* arrives is greater than the intensity of light received by the light receiving element 2031*b* when the light blocking section 2062 is located at the detection position. Thus, as in the above-described embodiments, an ink cartridge capable of detecting residual amount of ink 99 therein based on the intensity of light received by the light receiving element 2031*b* can be realized. Note that, in the detection member 2015, the region other than the light reflecting sections 2081 and 2082 may be made of a material having light transmissive characteristics. In this case, too, since light is not reflected in the region other than the light reflecting sections 2081 and 2082, the detection member 2015 has a function that prevents the reflected light from reaching the light receiving element 2031*b*, which is similar to the function of the light blocking sections 2062.

Further, the above-described embodiments include configurations where the detection member is formed with slits. These slits may be made of any material and have any shape, as long as the slits are configured to transmit light readily compared with the light blocking section. For example, a transparent resin material may be filled in through-holes penetrating the detection member, or slits may have a shape other than a rectangular shape or circular shape. Further, the light blocking section need not block light completely, and may be made of a material that does not transmit light readily, compared with the light transmission section such as slits.

Further, in the above-described embodiments, slits or through-holes that transmit light are formed in the detection member made of a material having light blocking characteristics. However, a seal material having light blocking characteristics may be affixed to the detection member made of a material having light transmissive characteristics, with shapes and at positions the same as the slits or the like in the above-described embodiments. Hence, the light transmission section having a function similar to that in the above-described embodiments can be formed in a simple manner, and thus the remaining-amount detecting member can be manufactured easily.

What is claimed is:

1. A liquid cartridge comprising:

a liquid accommodating chamber accommodating liquid therein;

a float member movably disposed in the liquid accommodating chamber to be movable in accordance with a change in a liquid surface of the liquid accommodated in the liquid accommodating chamber, mass per unit volume of the float member being smaller than mass per unit volume of the liquid;

a detection member that moves in conjunction with the float member, the detection member being subject to light detection for determining remaining amounts of liquid accommodated in the liquid accommodating chamber; and a restricting portion that restricts movement of the float member and the detection member along a predetermined path, wherein a part of the detection member is located at a detection position located above an uppermost liquid surface reached when a predetermined maximum amount of liquid, corresponding to the liquid surface being higher than or equal to 70% of the height of the liquid accommodating chamber, is accommodated in the liquid accommodating chamber;

wherein at least a part of the liquid accommodating chamber is configured to have light transmissive characteristics so that light can reach the detection position without passing through the liquid;

wherein the detection member passes the detection position in conjunction with the float member that moves following the liquid surface of liquid in the liquid accommodating chamber; and wherein the detection member is disk-shaped having a circumference along which a plurality of light transmission sections, which permit light to pass therethrough, are formed at an equi-interval.

2. The liquid cartridge as claimed in claim 1, wherein accommodation of the predetermined maximum amount of liquid corresponds to the liquid surface being higher than or equal to 70% of and lower than 90% of height of the liquid accommodating chamber.

3. The liquid cartridge as claimed in claim 1, wherein the detection member is configured to have light blocking characteristics;

wherein the liquid accommodating chamber includes a pair of wall sections with a portion of the detection member interposed therebetween, the portion being located at the detection position; and wherein at least a part of each of the pair of wall sections has light transmissive characteristics so that light from the external optical sensor can exit outside via the detection position.

4. The liquid cartridge as claimed in claim 3, wherein the float member and the detection member are formed integrally; and wherein the restricting portion pivotally supports the integrally formed float member and the detection member.

5. The liquid cartridge as claimed in claim 4, wherein each light transmission section passes the detection position when the detection member moves along the predetermined path.

6. The liquid cartridge as claimed in claim 5, wherein the light transmission section is a through-hole.

7. The liquid cartridge as claimed in claim 5, wherein the light transmission section is made of a material having light transmissive characteristics.

8. The liquid cartridge as claimed in claim 1, wherein one of the plurality of light transmission sections farthest away from the uppermost liquid surface has a larger width along the circumference than width of any other light transmission section.

9. The liquid cartridge as claimed in claim 8, wherein the disk-shaped detection member is pivotally movable about a center thereof.

10. The liquid cartridge as claimed in claim 9, wherein the light transmission section is a slit extending in a radial direction of the disk-shaped detection member.

11. The liquid cartridge as claimed in claim 1, wherein the liquid accommodated in the liquid accommodating chamber has characteristics that do not transmit light.

12. A liquid ejecting system comprising:

a liquid cartridge; and a liquid ejecting device including:

a mount section in which the liquid cartridge is mounted;

a liquid ejecting head that ejects liquid supplied from the liquid cartridge mounted in the mount section; and a light detector provided at an upper side of the mount section, wherein the liquid cartridge comprises:

a liquid accommodating chamber accommodating liquid therein;

a float member movably disposed in the liquid accommodating chamber to be movable in accordance with a change in a liquid surface of the liquid accommodated in the liquid accommodating chamber, mass per unit volume of the float member being smaller than mass per unit volume of the liquid;

a detection member that moves in conjunction with the float member, the detection member being subject to detection by the light detector for determining remaining amounts of liquid accommodated in the liquid accommodating chamber; and a restricting portion that restricts movement of the float member and the detection member along a predetermined path, wherein a part of the detection member is located at a detection position located above an uppermost liquid surface reached when a predetermined maximum amount of liquid is accommodated in the liquid accommodating chamber;

wherein at least a part of the liquid accommodating chamber is configured to have light transmissive characteristics so that light from the light detector can reach the detection position without passing through the liquid;

wherein the detection member passes the detection position in conjunction with the float member that moves following the liquid surface of liquid in the liquid accommodating chamber; and wherein the detection member is disk-shaped having a circumference along which a plurality of light transmission sections, which permit light from the light detector to pass through the detection member, are formed at an equi-interval.

* * * * *